US009910383B2

(12) United States Patent
Kuboki et al.

(10) Patent No.: US 9,910,383 B2
(45) Date of Patent: Mar. 6, 2018

(54) POWDER CONTAINER AND IMAGE FORMING APPARATUS

(71) Applicants: Shingo Kuboki, Kanagawa (JP); Jun Shiori, Kanagawa (JP); Hideo Yoshizawa, Kanagawa (JP); Natsumi Matsue, Kanagawa (JP); Daisuke Hamada, Kanagawa (JP)

(72) Inventors: Shingo Kuboki, Kanagawa (JP); Jun Shiori, Kanagawa (JP); Hideo Yoshizawa, Kanagawa (JP); Natsumi Matsue, Kanagawa (JP); Daisuke Hamada, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 15/026,090

(22) PCT Filed: Mar. 16, 2015

(86) PCT No.: PCT/JP2015/058640
§ 371 (c)(1),
(2) Date: Mar. 30, 2016

(87) PCT Pub. No.: WO2015/141859
PCT Pub. Date: Sep. 24, 2015

(65) Prior Publication Data

US 2017/0212449 A1 Jul. 27, 2017

(30) Foreign Application Priority Data

Mar. 17, 2014 (JP) ..... 2014-053627
Oct. 23, 2014 (JP) ..... 2014-216451
Dec. 12, 2014 (JP) ..... 2014-252409

(51) Int. Cl.
*G03G 15/08* (2006.01)

(52) U.S. Cl.
CPC ..... *G03G 15/0872* (2013.01)

(58) Field of Classification Search
None
See application file for complete search history.

(56) References Cited

U.S. PATENT DOCUMENTS 5,185,616 A 2/1993 Wilcke
5,455,662 A 10/1995 Ichikawa et al.
(Continued)

FOREIGN PATENT DOCUMENTS

JP 9-197819 7/1997
JP 3942678 B2 7/2007
(Continued)

OTHER PUBLICATIONS

International Search Report dated May 26, 2015 in PCT/JP2015/058640 filed Mar. 16, 2015.
(Continued)

*Primary Examiner* — Thomas Giampaolo, II
(74) *Attorney, Agent, or Firm* — Oblon, McClelland, Maier & Neustadt, L.L.P.

(57) ABSTRACT

A powder container for an image forming apparatus includes: a rotatable powder storage storing powder; an opening on one end of the powder storage, through which a nozzle can be inserted; and a scooping portion to scoop up powder on an opening side, and supply the powder to a powder receiving hole of the nozzle when the powder storage rotates. The scooping portion includes a scooping surface extending inwardly from an inner wall surface of the powder storage and an inner end portion extending in a rotation axis direction of the powder storage, with an edge approximately parallel to the rotation axis. In a cross-section perpendicular to the rotation axis, the scooping surface is inclined toward an upstream side in a rotation direction of
(Continued)

the powder storage with respect to a virtual line that passes through the rotation axis and is tangent to the edge of the inner end portion.

24 Claims, 36 Drawing Sheets

(56) References Cited

U.S. PATENT DOCUMENTS

| | | | | |
|---|---|---|---|---|
| 5,495,323 | A * | 2/1996 | Meetze, Jr. ..... | G03G 15/0884 222/DIG. 1 |
| 5,576,816 | A | 11/1996 | Staudt et al. | |
| 6,229,976 | B1 | 5/2001 | Kimura | |
| 7,321,744 | B2 | 1/2008 | Hosokawa et al. | |
| 7,822,371 | B2 | 10/2010 | Taguchi et al. | |
| 7,835,675 | B2 | 11/2010 | Taguchi et al. | |
| 2003/0152857 | A1* | 8/2003 | Sugiura ..... | G03G 5/0564 430/109.2 |
| 2008/0124133 | A1 | 5/2008 | Yoshizawa et al. | |
| 2009/0136266 | A1 | 5/2009 | Ichikawa | |
| 2009/0324297 | A1 | 12/2009 | Usui | |
| 2010/0143000 | A1 | 6/2010 | Matsue et al. | |
| 2011/0008075 | A1 | 1/2011 | Taguchi et al. | |
| 2011/0211854 | A1 | 9/2011 | Shiori et al. | |
| 2011/0268478 | A1 | 11/2011 | Ohmura et al. | |
| 2013/0272750 | A1 | 10/2013 | Matsumoto et al. | |
| 2014/0270859 | A1 | 9/2014 | Hosokawa et al. | |
| 2015/0037051 | A1* | 2/2015 | Iikura ..... | G03G 21/1676 399/13 |

FOREIGN PATENT DOCUMENTS

| | | |
|---|---|---|
| JP | 2009-276659 | 11/2009 |
| JP | 2012-133349 | 7/2012 |
| JP | 2013-113946 | 6/2013 |
| RU | 2 414 734 C2 | 3/2011 |

OTHER PUBLICATIONS

Extended European Search Report dated Apr. 11, 2017 in European Patent Application No. 15765841.0.

Office Action dated Mar. 22, 2017 in Korean Patent Application No. 10-2016-7008496 with English translation.

Combined Office Action and Search Report dated Aug. 31, 2017 in Russian Patent Application No. 2016111900 (with English language translation).

* cited by examiner

POWDER CONTAINER AND IMAGE FORMING APPARATUS

TECHNICAL FIELD

The present invention relates to a powder container and an image forming apparatus.

BACKGROUND ART

An electrophotography image forming apparatus, such as a printer, a facsimile machine, a copier, or a multifunction peripheral with a plurality of functions of the printer, the facsimile machine, and the copier, supplies (replenishes) toner that is powder from a toner container serving as a powder container containing the toner to a developing device by using a powder replenishing device. The toner container includes a powder storage for storing toner, an opening provided on one end of the powder storage, a nozzle insertion member provided on an opening that receives a nozzle having a powder receiving hole for receiving the toner from the toner container, a conveyor that conveys the toner to the opening side of the powder storage, and a scooping portion that scoops up the toner on the opening side and causes the toner to fall and be supplied to the powder receiving hole along with rotation of the powder storage. An example of the toner container is disclosed in Japanese Laid-open Patent Publication No. 2012-133349.

In a system that scoops up toner and supplies the toner to the powder receiving hole of the nozzle inserted in the opening of the nozzle insertion member, it may be difficult to efficiently supply the toner to the powder receiving hole depending on the fluidity of the toner.

It is an object of the present invention to efficiently supply developer to the powder receiving hole of the nozzle inserted in the powder container.

SUMMARY OF THE INVENTION

According to an embodiment, a powder container used in an image forming apparatus. The powder container includes a rotatable powder storage that stores therein the powder for image formation, the rotatable powder storage to rotate about a rotation axis; an opening on one end of the powder storage, through which a nozzle of the image forming apparatus is to be inserted; and a scooping portion to scoop up powder on an opening side, and to supply the powder to a powder receiving hole of the nozzle when the powder storage rotates. The scooping portion includes a scooping surface that extends inwardly from an inner wall surface of the powder storage. The inner end portion of the scooping surface extends in a rotation axis direction of the powder storage. The edge of the inner end portion is approximately parallel to the rotation axis. In a cross-section perpendicular to the rotation axis, the scooping surface is inclined toward an upstream side in a rotation direction of the powder storage with respect to a virtual line that passes through the rotation axis and is tangent to the edge of the inner end portion.

DESCRIPTION OF EMBODIMENTS

Figure 1:
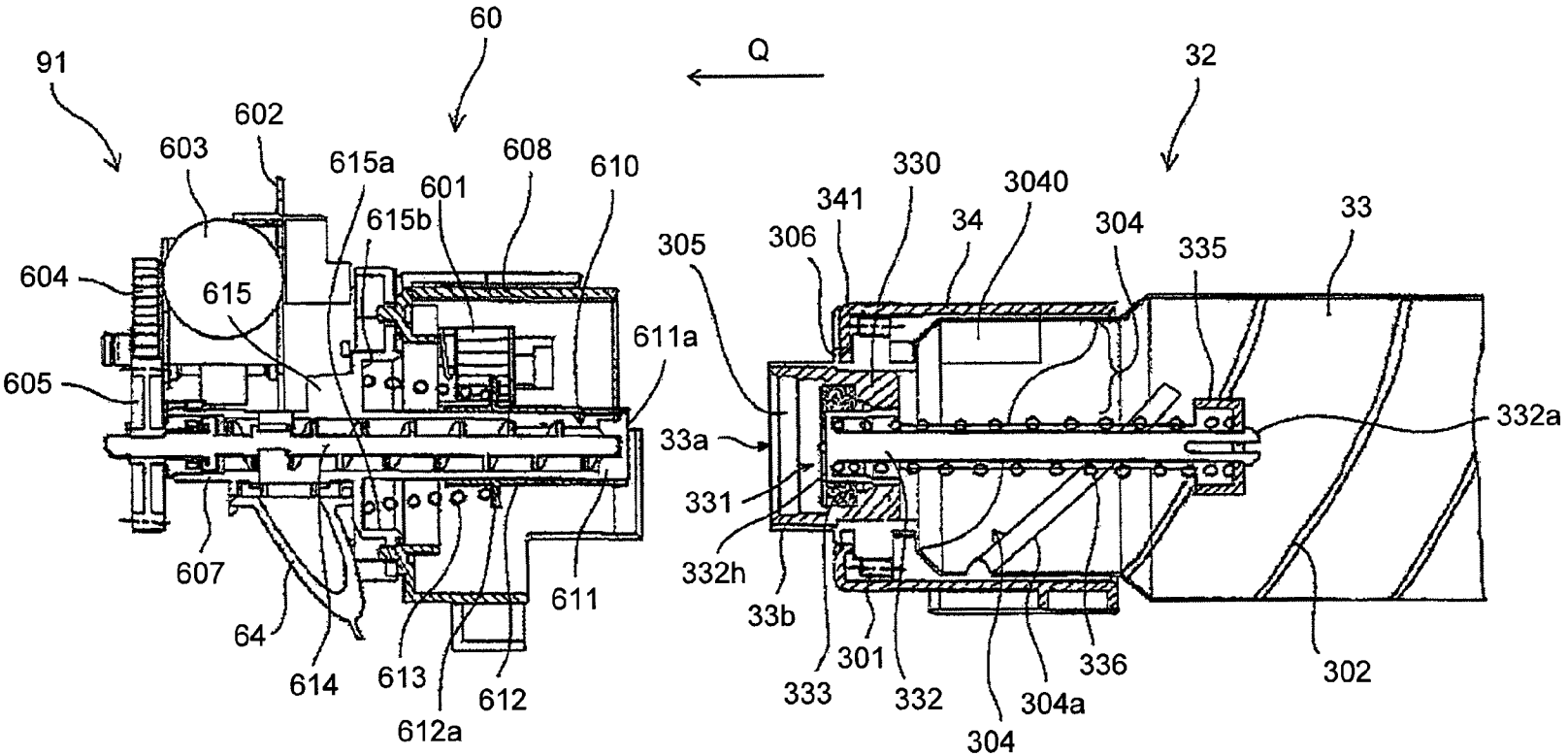
FIG. 1 is an explanatory cross-sectional view of a powder replenishing device before a powder container according to an embodiment of the present invention is attached and the powder container.

Various embodiments of the present invention will be described below with reference to the accompanying drawings. In the descriptions of the embodiments, the same components or components with the same functions are denoted by the same reference symbols, and the same explanation will not be repeated in subsequent embodiments. The descriptions below are mere examples and do not limit the scope of the appended claims. Further, a person skilled in the art may easily conceive other embodiments by making modifications or changes within the scope of the appended claims; however, such modifications and changes obviously fall within the scope of the appended claims. In the drawings, Y, M, C, and K are symbols appended to components corresponding to yellow, magenta, cyan, and black, respectively, and will be omitted appropriately.

Figure 2:
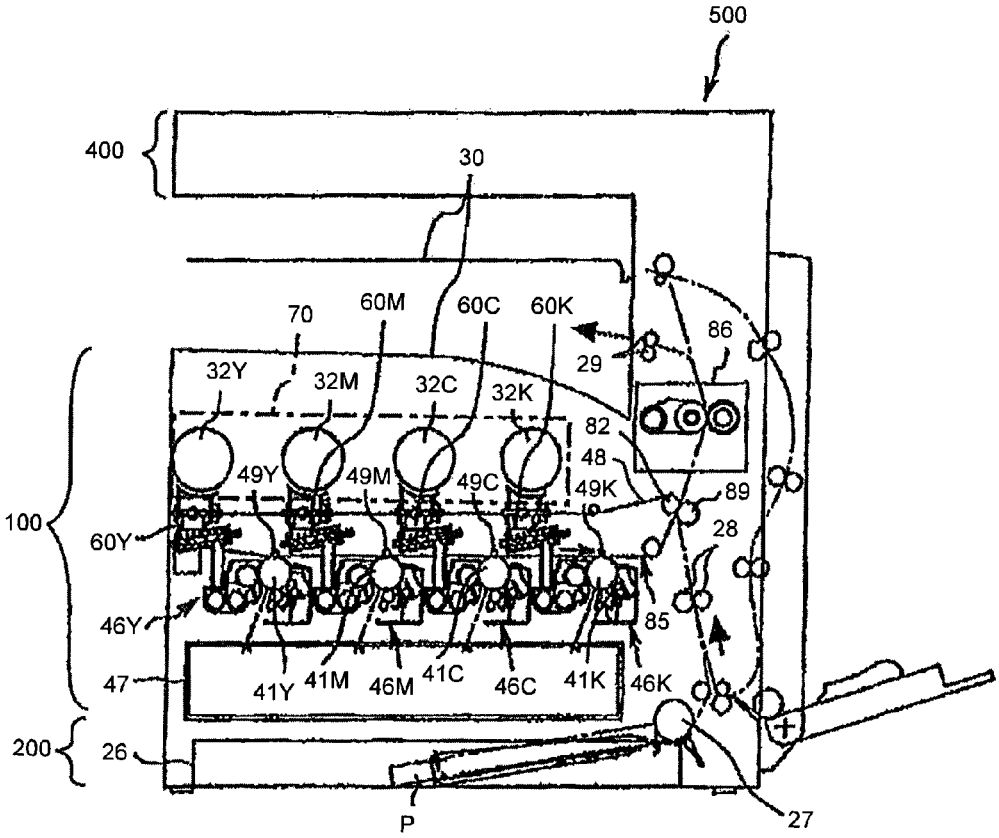
FIG. 2 is a diagram illustrating an overall configuration of an image forming apparatus according to the embodiment.

FIG. 2 is an overall configuration diagram of an electrophotography tandem-type color copier (hereinafter, referred to as "a copier 500") serving as an image forming apparatus according to an embodiment. The copier 500 may be a monochrome copier. The image forming apparatus may be a printer, a facsimile machine, or a multifunction peripheral with the functions of a copier, a printer, a facsimile machine, and a scanner, instead of the copier. The copier 500 mainly includes a copier main-body (hereinafter, referred to as "a printer 100"), a sheet feed table (hereinafter, referred to as "a sheet feeder 200"), and a scanner section (hereinafter, referred to as "a scanner 400") mounted on the printer 100.

Four toner containers 32 (Y, M, C, K) serving as powder containers corresponding to multiple colors (yellow, magenta, cyan, black) are detachably (replaceably) attached to a toner container holder 70 serving as a container holding section provided in the upper part of the printer 100. An intermediate transfer device 85 is arranged below the toner container holder 70.

The intermediate transfer device 85 includes an intermediate transfer belt 48 serving as an intermediate transfer medium, four primary-transfer bias rollers 49 (Y, M, C, K), a secondary-transfer backup roller 82, multiple tension rollers, an intermediate-transfer cleaning device, and the like. The intermediate transfer belt 48 is stretched and supported by multiple rollers and endlessly moves in the arrow direction in FIG. 2 along with rotation of the secondary-transfer backup roller 82 serving as one of the rollers.

In the printer 100, four image forming sections 46 (Y, M, C, K) corresponding to the respective colors are arranged in tandem so as to face the intermediate transfer belt 48. Four toner replenishing devices 60 (Y, M, C, K) serving as powder supply (replenishing) devices corresponding to the four toner containers 32 (Y, M, C, K) of the four colors are arranged below the toner containers 32 (Y, M, C, K), respectively. The toner replenishing devices 60 (Y, M, C, K) respectively supply (replenish) toner that is powder developer contained in the toner containers 32 (Y, M, C, K) to developing devices of the image forming sections 46 (Y, M, C, K) for the respective colors. In the embodiment, the four image forming sections 46 (Y, M, C, K) form an image forming unit.

As illustrated in FIG. 2, the printer 100 includes an exposing device 47 serving as a latent-image forming means below the four image forming sections 46. The exposing device 47 exposes and scans the surfaces of photoconductors 41 (Y, M, C, K) serving as image bearers (to be described later) with light based on image information of an original image read by the scanner 400, so that electrostatic latent images are formed on the surfaces of the photoconductors. The image information may be input from an external apparatus, such as a personal computer, connected to the copier 500, instead of being read by the scanner 400.

In the embodiment, a laser beam scanning system using a laser diode is employed as the exposing device 47. However, other configurations, such as a configuration including an LED array, may be employed as the exposing means.

Figure 3:
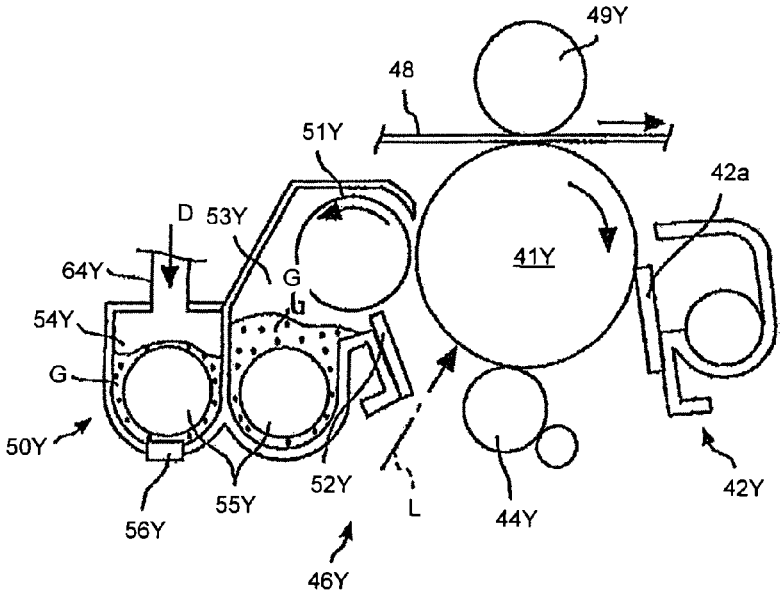
FIG. 3 is a schematic diagram illustrating a configuration of an image forming section of the image forming apparatus illustrated in FIG. 2.

FIG. 3 is a schematic diagram illustrating an overall configuration of the image forming section 46Y corresponding to yellow.

The image forming section 46Y includes the drum-shaped photoconductor 41Y. The image forming section 46Y includes a charging roller 44Y serving as a charging device, a developing device 50Y serving as a developing means, a cleaning device 42Y serving as a photoconductor cleaning device, a neutralizing device, and the like, all of which are arranged around the photoconductor 41Y. Image forming processes (a charging process, an exposing process, a developing process, a transfer process, and a cleaning process) are performed on the photoconductor 41Y, so that a yellow toner image is formed on the photoconductor 41Y.

The other three image forming sections 46 (M, C, K) have almost the same configurations as the image forming section 46Y for yellow except that colors of toner to be used are different and toner images corresponding to the respective toner colors are formed on the photoconductors 41M, 41C, 41K. Hereinafter, explanation of only the image forming section 46Y for yellow will be given, and explanation of the other three image forming sections 46 (M, C, K) will be omitted appropriately.

The photoconductor 41Y is rotated clockwise in FIG. 3 by a drive motor. The surface of the photoconductor 41Y is uniformly charged at a position facing the charging roller 44Y (charging process). Subsequently, the surface of the photoconductor 41Y reaches a position of irradiation with laser light L emitted by the exposing device 47, where an electrostatic latent image for yellow is formed through exposure scanning (exposing process). The surface of the photoconductor 41Y then reaches a position facing the developing device 50Y, where the electrostatic latent image is developed with yellow toner to form a yellow toner image (developing device).

The four primary-transfer bias rollers 49 (Y, M, C, K) of the intermediate transfer device 85 and the photoconductors 41 (Y, M, C, K) sandwich the intermediate transfer belt 48, so that respective primary transfer nips are formed. A transfer bias with polarity opposite to the polarity of toner is applied to each of the primary-transfer bias rollers 49 (Y, M, C, K).

The surface of the photoconductor 41Y, on which the toner image is formed through the developing process, reaches the primary transfer nip facing the primary-transfer bias roller 49Y across the intermediate transfer belt 48, and the toner image on the photoconductor 41Y is transferred to the intermediate transfer belt 48 at the primary transfer nip (primary transfer process). At this time, a slight amount of non-transferred toner remains on the photoconductor 41Y. The surface of the photoconductor 41Y, from which the toner image has been transferred to the intermediate transfer belt 48 at the primary transfer nip, reaches a position facing the cleaning device 42Y. At this position, the non-transferred toner remaining on the photoconductor 41Y is mechanically collected by a cleaning blade 42*a* included in the cleaning device 42Y (cleaning process). The surface of the photoconductor 41Y finally reaches a position facing the neutralizing device, where the residual potential on the photoconductor 41Y is removed. In this way, a series of the image forming processes performed on the photoconductor 41Y is completed.

The above described image forming processes are also performed on the other image forming sections 46 (M, C, K) in the same manner as the image forming section 46Y for yellow. Specifically, the exposing device 47 arranged below the image forming sections 46 (M, C, K) emits laser light L based on the image information toward the photoconductors 41 (M, C, K) of the image forming sections 46 (M, C, K). More specifically, the exposing device 47 emits the laser light L from a light source and irradiates each of the photoconductors 41 (M, C, K) with the laser light L via multiple optical elements while performing scanning with the laser light L by a rotating polygon mirror. Subsequently, the toner images of the respective colors formed on the photoconductors 41 (M, C, K) through the developing process are transferred to the intermediate transfer belt 48.

At this time, the intermediate transfer belt 48 runs in the arrow direction in FIG. 2 and sequentially passes through the primary transfer nips of the primary-transfer bias rollers 49 (Y, M, C, K). Therefore, the toner images of the respective colors on the photoconductors 41 (Y, M, C, K) are primary-transferred to the intermediate transfer belt 48 in a superimposed manner, so that a color toner image is formed on the intermediate transfer belt 48.

The intermediate transfer belt 48, on which the color toner image is formed by the superimposed toner images of the respective colors, reaches a position facing a secondary-transfer roller 89. At this position, the secondary-transfer backup roller 82 and the secondary transfer roller 89 sandwich the intermediate transfer belt 48, so that a secondary transfer nip is formed. The color toner image formed on the intermediate transfer belt 48 is transferred to a recording medium P, such as a sheet of paper, conveyed to the position of the secondary transfer nip, due to the action of a transfer bias applied to the secondary-transfer backup roller 82, for example. At this time, non-transferred toner which has not been transferred to the recording medium P remains on the intermediate transfer belt 48. The intermediate transfer belt 48 that has passed through the secondary transfer nip reaches the position of the intermediate-transfer cleaning device, where the non-transferred toner remaining on the surface is collected. In this way, a series of transfer processes performed on the intermediate transfer belt 48 is completed.

Movement of the recording medium P will be explained below.

The recording medium P is conveyed to the secondary transfer nip from a feed tray 26 provided in the sheet feeder 200 arranged below the printer 100 via a feed roller 27, a registration roller pair 28, and the like. Specifically, multiple recording media P are stacked in the feed tray 26. When the feed roller 27 is rotated counterclockwise in FIG. 2, the topmost recording medium P is fed to a nip between two rollers of the registration roller pair 28.

The recording medium P conveyed to the registration roller pair 28 temporarily stops at the position of the nip between the rollers of the registration roller pair 28, the rotation of which is being suspended. The registration roller pair 28 is rotated to convey the recording medium P toward the secondary transfer nip in accordance with the timing at which the color toner image on the intermediate transfer belt 48 reaches the secondary transfer nip. Accordingly, a desired color image is formed on the recording medium P.

The recording medium P on which the color toner image is transferred at the secondary transfer nip is conveyed to the position of a fixing device 86. In the fixing device 86, the color toner image transferred to the surface of the recording medium P is fixed to the recording medium P by heat and pressure applied by a fixing belt and a pressing roller. The recording medium P that has passed through the fixing device 86 is discharged to the outside of the apparatus via a nip between rollers of a discharge roller pair 29. The recording medium P discharged to the outside of the apparatus by the discharge roller pair 29 is sequentially stacked, as an output image, on a stack section 30. In this way, a series of the image forming processes in the copier 500 is completed.

A configuration and operation of the developing device 50 in the image forming section 46 will be explained in detail below. In the following, the image forming section 46Y for yellow will be explained by way of example. However, the image forming sections 46 (M, C, K) for the other colors have the same configurations and perform the same operation.

As illustrated in FIG. 3, the developing device 50Y includes a developing roller 51Y serving as a developer bearer, a doctor blade 52Y serving as a developer regulating plate, two developer conveying screws 55Y, a toner density sensor 56Y, and the like. The developing roller 51Y faces the photoconductor 41Y. The doctor blade 52Y faces the developing roller 51Y. The two developer conveying screws 55Y are arranged inside two developer accommodating sections, that is, first and second developer accommodating sections 53Y and 54Y. The developing roller 51Y includes a magnet roller disposed inside thereof, a sleeve that rotates around the magnet roller, and the like. Two-component developer G containing carrier and toner is stored in the first developer accommodating section 53Y and the second developer accommodating section 54Y. The second developer accommodating section 54Y communicates with a toner dropping passage 64Y via an opening provided in the upper part thereof. The toner density sensor 56Y detects a toner density in the developer G stored in the second developer accommodating section 54Y.

The developer G in the developing device 50 circulates between the first developer accommodating section 53Y and the second developer accommodating section 54Y while being stirred by the two developer conveying screws 55Y. The developer G in the first developer accommodating section 53Y is supplied to and borne on the surface of the sleeve of the developing roller 51Y due to a magnetic field generated by the magnet roller in the developing roller 51Y while the developer G is being conveyed by one of the developer conveying screws 55Y. The sleeve of the developing roller 51Y rotates counterclockwise as indicated by an arrow in FIG. 3, and the developer G borne on the developing roller 51Y moves on the developing roller 51Y along with the rotation of the sleeve. At this time, the toner in the developer G electrostatically adheres to the carrier by being charged to the potential opposite to the polarity of the carrier due to triboelectric charging with the carrier in the developer G, and is borne on the developing roller 51Y together with the carrier that is attracted by the magnetic field generated on the developing roller 51Y.

The developer G borne on the developing roller 51Y is conveyed in the arrow direction in FIG. 3 and reaches a doctor section where the doctor blade 52Y and the developing roller 51Y face each other. The amount of the developer G on the developing roller 51Y is regulated and adjusted to an appropriate amount when the developer G passes through the doctor section, and then the developer G is conveyed to a development area facing the photoconductor 41Y. In the development area, the toner in the developer G adheres to the latent image formed on the photoconductor 41Y by a developing electric field generated between the developing roller 51Y and the photoconductor 41Y. The developer G remaining on the surface of the developing roller 51Y that has passed through the development area reaches the upper side of the first developer accommodating section 53Y along with the rotation of the sleeve. At this position, the developer G is separated from the developing roller 51Y.

The developer G in the developing device 50Y is adjusted so that the toner density falls within a predetermined range. Specifically, toner contained in the toner container 32Y is replenished to the second developer accommodating section 54Y by the toner replenishing device 60Y (to be described later) through the toner dropping passage 64Y in accordance with the consumption of toner of the developer G in the developing device 50Y through the development. The toner replenished to the second developer accommodating section 54Y circulates between the first developer accommodating section 53Y and the second developer accommodating section 54Y while being mixed and stirred with the developer G by the two developer conveying screws 55Y.

Figure 4:
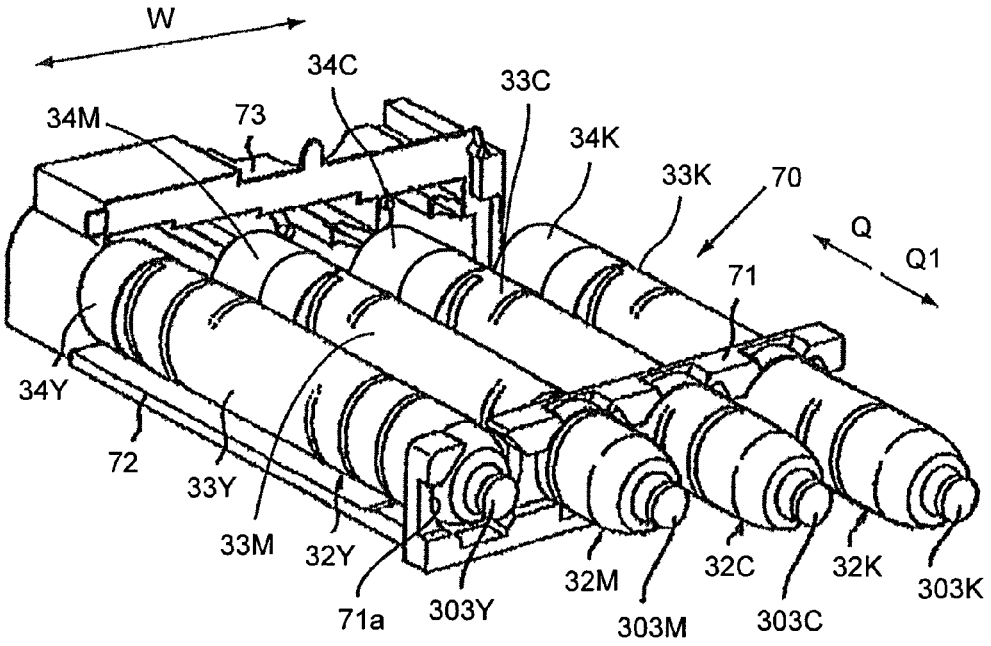
FIG. 4 is a schematic perspective view illustrating a state in which the powder containers are set in a container holding section.
Figure 5:
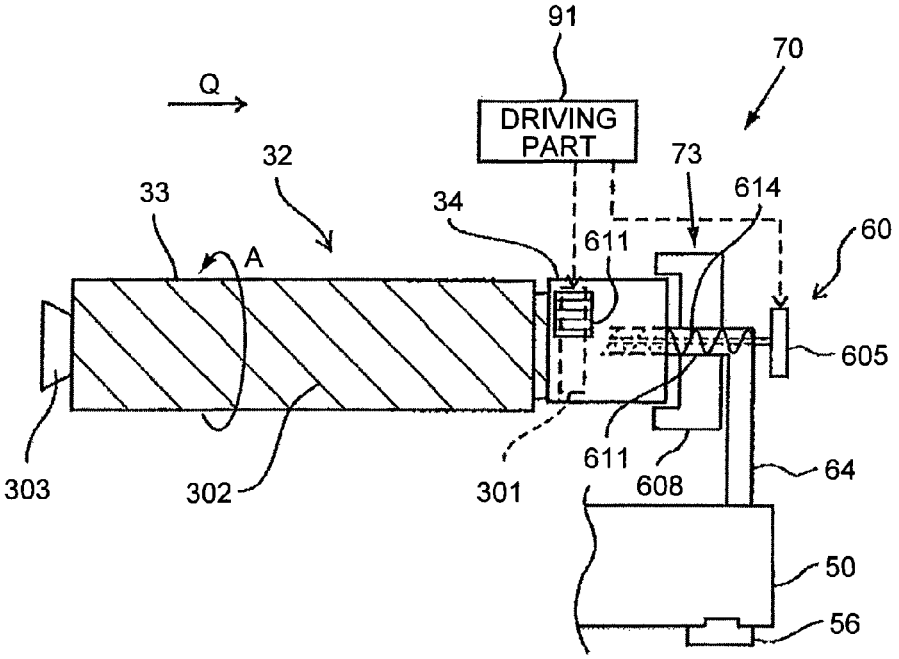
FIG. 5 is a schematic diagram illustrating a state in which the powder container is set in the powder replenishing device of the image forming apparatus illustrated in FIG. 2.

FIG. 4 is a schematic perspective view illustrating a state in which the four toner containers 32 (Y, M, C, K) are attached to the toner container holder 70. FIG. 5 is a schematic diagram illustrating a state in which the toner container 32Y is attached to the toner replenishing device 60. The toner replenishing devices 60 (Y, M, C, K) for the respective colors have the same configurations except that the colors of toner are different. Therefore, in FIG. 5, explanation of only the toner replenishing device 60 and the toner container 32Y will be given without a symbol (Y, M, C, K). When the configurations vary depending on the colors, a symbol Y, M, C, or K representing a specific color is used. When the configurations do not vary depending on the colors or common to all of the colors, a symbol (Y, M, C, K) may be used or the symbols may be omitted appropriately. In FIG. 4, an arrow Q indicates an attachment direction in which the toner containers 32 of the respective colors are attached to the toner replenishing devices 60, and Q1 indicates a detachment direction in which the toner containers 32 of the respective colors are detached from the toner replenishing devices 60.

The toner contained in the toner containers 32 (Y, M, C, K) attached to the toner container holder 70 of the printer 100 illustrated in FIG. 4 is appropriately replenished to the developing device in accordance with the consumption of toner in the developing device 50 as illustrated in FIG. 5. At this time, the toner in each of the toner containers 32 is replenished by the toner replenishing device 60 for each color. The toner replenishing device 60 includes the toner container holder 70, a conveying nozzle 611 serving as a nozzle, a conveying screw 614 serving as a main body conveyor, the toner dropping passage 64, a driving part 91 serving as a container rotating part, and the like. When a user performs attachment operation to push the toner container 32 in the attachment direction Q in FIG. 5 and the toner container 32 is moved inside the toner container holder 70 of the printer 100 along with the attachment direction Q, the conveying nozzle 611 of the toner replenishing device 60 is inserted from a front side of the toner container 32 in the attachment operation. Therefore, the toner container 32 and the conveying nozzle 611 communicate with each other. A configuration for the communication along with the attachment operation will be described in detail later.

The toner container 32 for each color may be referred to as a toner bottle. The toner container 32 mainly includes a container front end cover 34 serving as a container cover that is non-rotatably held by the toner container holder 70, and includes an approximately cylindrical container body 33 serving as a powder storage integrated with a container gear 301 serving as a container-side gear. Each of the container bodies 33 is rotatably held by the container front end cover 34. In FIG. 5, a setting cover 608 is a part of a container cover receiving section 73 of the toner container holder 70.

As illustrated in FIG. 4, the toner container holder 70 mainly includes an insertion hole part 71, a container receiving section 72, and the container cover receiving section 73.

An insertion hole 71*a* serving as an insertion opening used in the attachment operation of the toner containers 32 (Y, M, C, K) is defined by the insertion hole part 71. When a main-body cover arranged on the front side of the copier 500 (the front side in the direction normal to the sheet of FIG. 2) is opened, the insertion hole part 71 of the toner container holder 70 is exposed. Attachment/detachment operation of the toner containers 32 (attachment/detachment operation with the longitudinal direction of the toner containers 32 (Y, M, C, K) taken as an attachment/detachment direction in which the toner containers 32 of the respective colors are attached to and detached from the toner replenishing devices 60) is performed from the front side of the copier 500 while the toner containers 32 (Y, M, C, K) are oriented with their longitudinal directions being parallel to the horizontal direction.

The container receiving section 72 is a section for supporting the container bodies 33 (Y, M, C, K) of the toner containers 32. The container receiving section 72 is a part that enables the toner containers 32 (Y, M, C, K) to slide and move when the toner containers 32 (Y, M, C, K) are attached to the toner replenishing devices 60. The container receiving section 72 is divided into four sections in a width direction W perpendicular to the longitudinal direction (attachment/detachment direction) of the toner containers 32 (Y, M, C, K). The container receiving section 72 includes gutters that serves as container mounting sections extending from the insertion hole part 71 to the container cover receiving section 73 along the longitudinal direction of each of the container bodies 33. The toner containers 32 (Y, M, C, K) for the respective colors are able to move on the gutters in a sliding manner in the longitudinal direction. The container receiving section 72 is provided such that its longitudinal length becomes approximately the same as the longitudinal length of the container bodies 33 (Y, M, C, K) of the respective colors.

The container cover receiving section 73 is a section for holding the container front end covers 34 (Y, M, C, K) and the container bodies 33 (Y, M, C, K) of the toner containers 32 (Y, M, C, K) for the respective colors. The container cover receiving section 73 is arranged on a container front side (on the downstream in the attachment direction Q) of the container receiving section 72 in the longitudinal direction (attachment/detachment direction), and the insertion hole part 71 is on one end side (on the downstream in the detachment direction Q1) of the container receiving section 72 in the longitudinal direction.

The four toner containers 32 (Y, M, C, K) are able to move on the container receiving section 72 in a sliding manner. Therefore, along with the attachment operation of the toner containers (Y, M, C, K), the container front end covers 34 (Y, M, C, K) first pass through the insertion hole part 71, slides on the container receiving section 72 for a while, and are finally attached to the container cover receiving section 73.

As illustrated in FIG. 5, the container gear 301 serving as a gear is provided on each of the container bodies 33. In each of the container bodies 33, while the container front end cover 34 is attached to the container cover receiving section 73, the driving part (container rotating part) 91 including a driving motor, a driving gear, and the like inputs rotation drive to each of the container gears 301 via a container driving gear 601 serving as an apparatus main-body gear. Therefore, the container bodies 33 of the respective colors are rotated in a rotation direction indicated by arrow A (hereinafter, referred to as the rotation direction A) in FIG. 5. With the rotation of each of the container bodies 33, a spiral rib 302 formed in a spiral shape on the inner surface of the container body 33 conveys toner in the container body 33 from one end on the right side in FIG. 5 to the other end on the left side in FIG. 5 along the longitudinal direction of the container body. Namely, in the embodiment, the spiral rib 302Y serves as a rotary conveyor. Consequently, the toner of each color is supplied to the inside of the conveying nozzle 611 via a nozzle hole 610 opened upward and serving as a powder receiving hole provided on the conveying nozzle 611Y, and supplied from the other side of the toner container 32 where the container front end cover 34 is attached. Each of the nozzle holes 610 communicates with openings 335*b*, as shutter side openings, of a shutter supporting portion (to be described later), at an inner position relative to the position where the container gear 301 is arranged in the longitudinal direction of each of the container bodies 33Y. Specifically, each of the container gears 301 meshes with the container driving gear 601 at the position closer to a container opening 33*a* relative to the position where each of the nozzle holes 610 and the opening 335*b* of the shutter supporting portion communicate with each other.

The conveying screw 614Y is arranged in each of the conveying nozzles 611. When the driving part (container rotating part) 91 inputs rotation drive to a conveying screw gear 605, each of the conveying screws 614Y rotates to convey the toner supplied in the conveying nozzle 611. A downstream end of the conveying nozzle 611 in the conveying direction is connected to the toner dropping passage 64. The toner conveyed by each of the conveying screws 614 falls along the toner dropping passage 64 by gravity and is replenished to the developing device 50 (the second developer accommodating section 54).

The toner containers 32 (Y, M, C, K) are replaced with new ones at the end of their lifetimes (when the containers become empty because almost all of the contained toner is consumed). Grippers 303 (Y, M, C, K) are arranged on one ends of the toner containers 32 (Y, M, C, K) opposite to the container front end covers 34 (Y, M, C, K) in the longitudinal direction in FIG. 4, that is, on the downstream in the detachment direction Q1. When the toner containers are to be replaced, an operator can grip the grippers 303 (Y, M, C, K) to pull out and detach the toner containers 32 (Y, M, C, K) attached to the toner container holder 70.

Figure 6:
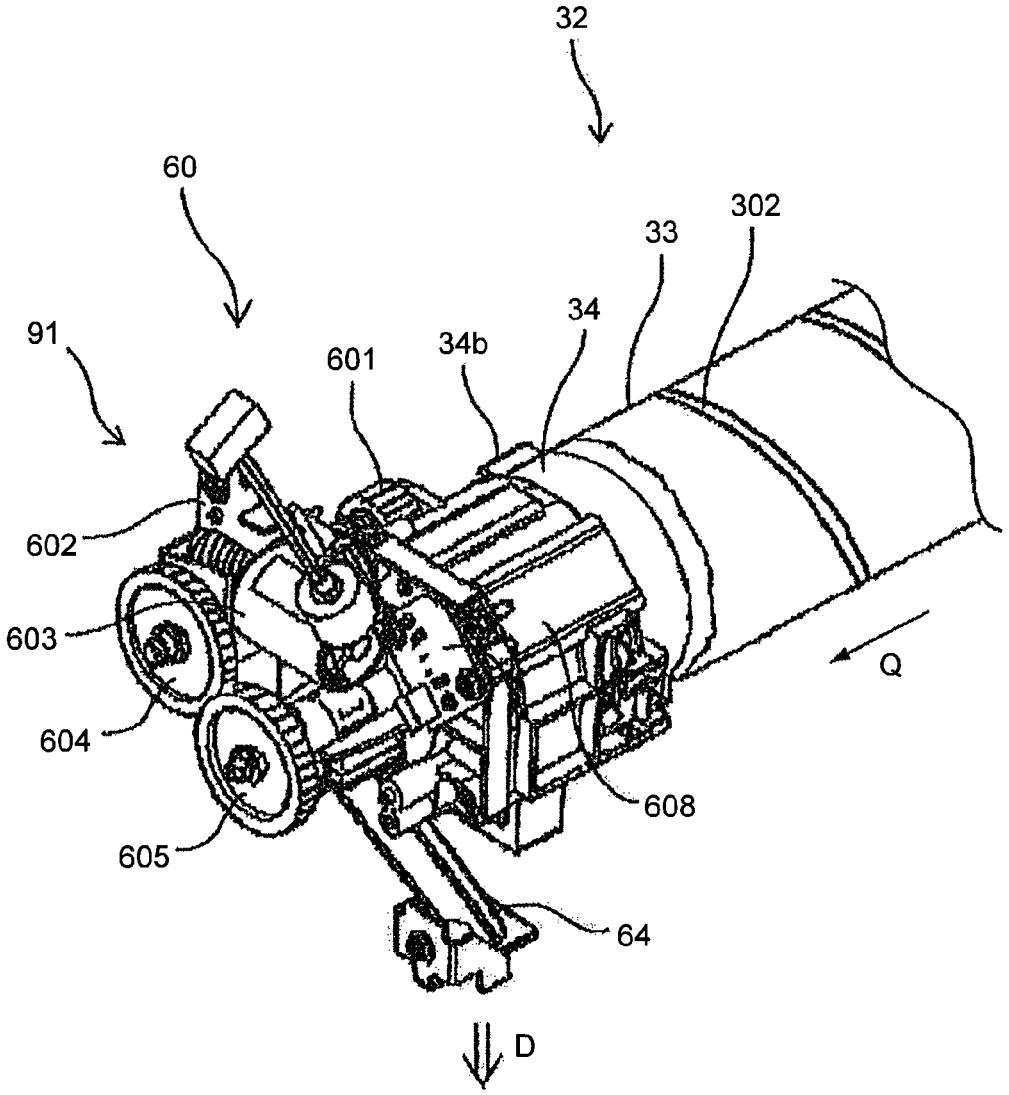
FIG. 6 is an explanatory perspective view of the powder replenishing device and the powder container when the powder container is attached.

The configuration of the driving part 91 will be further described below with reference to FIG. 6. In FIG. 6, symbols representing the colors are omitted. The driving part 91 includes the container driving gear 601 and the conveying screw gear 605 for each color. When a driving motor 603 mounted on each mounting frame 602 is driven and an output gear is rotated, the container driving gear 601 rotates. Each of the conveying screw gears 605 rotates by receiving the rotation of the output gear via a coupled gear 604 for each color.

As illustrated in FIG. 5, the toner replenishing device 60 controls the amount of toner supplied to the developing device 50 in accordance with the rotation frequency of each of the conveying screws 614. Therefore, toner that has passed through each of the conveying nozzles 611 is directly conveyed to the developing device 50 through the toner dropping passage 64 without the need to control the amount of toner supplied to the developing device 50. Even in the toner replenishing device 60 configured to insert the conveying nozzle 611 in the toner container 32 as described in the embodiment, it may be possible to arrange a temporary toner storage, such as a toner hopper.

The toner containers 32 (Y, M, C, K) and the toner replenishing devices 60 (Y, M, C, K) according to the embodiment will be described in detail below. As described above, the toner containers 32 (Y, M, C, K) and the toner replenishing devices 60 (Y, M, C, K) have almost the same configurations except that the colors of toner to be used are different. Therefore, in the following descriptions, symbols Y, M, C, and K representing the colors of toner will be omitted, and the configurations of the single toner container 32 and the single toner replenishing device 60 will be described.

Figure 7:
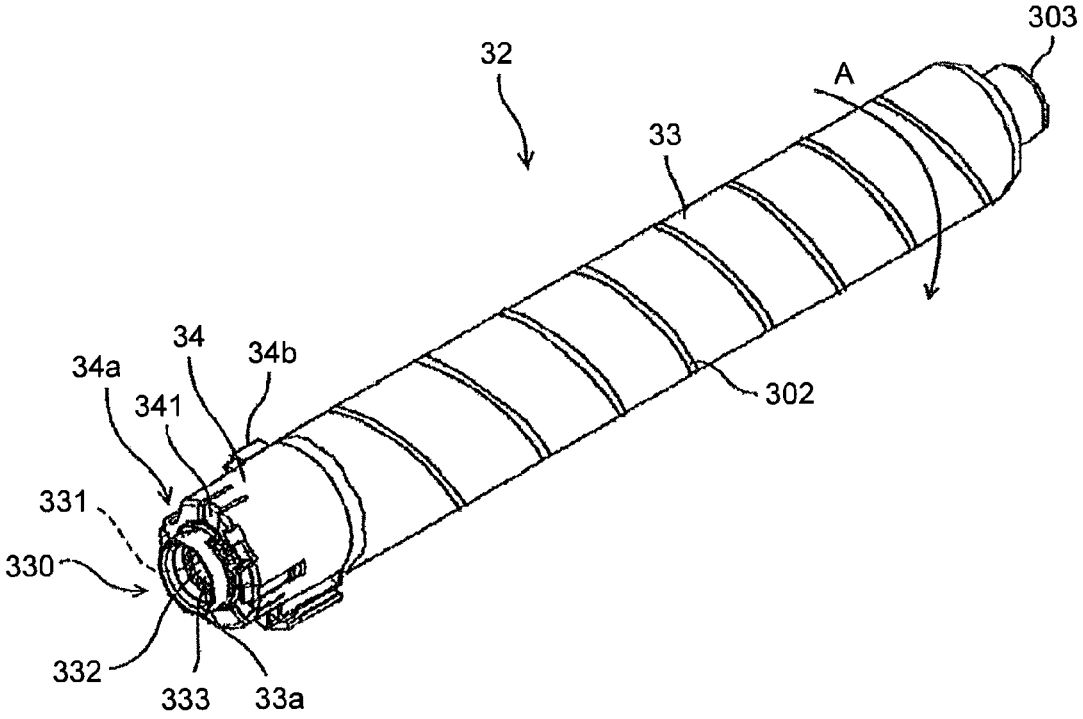
FIG. 7 is an explanatory perspective view illustrating a configuration of the powder container according to the embodiment.
Figure 8:
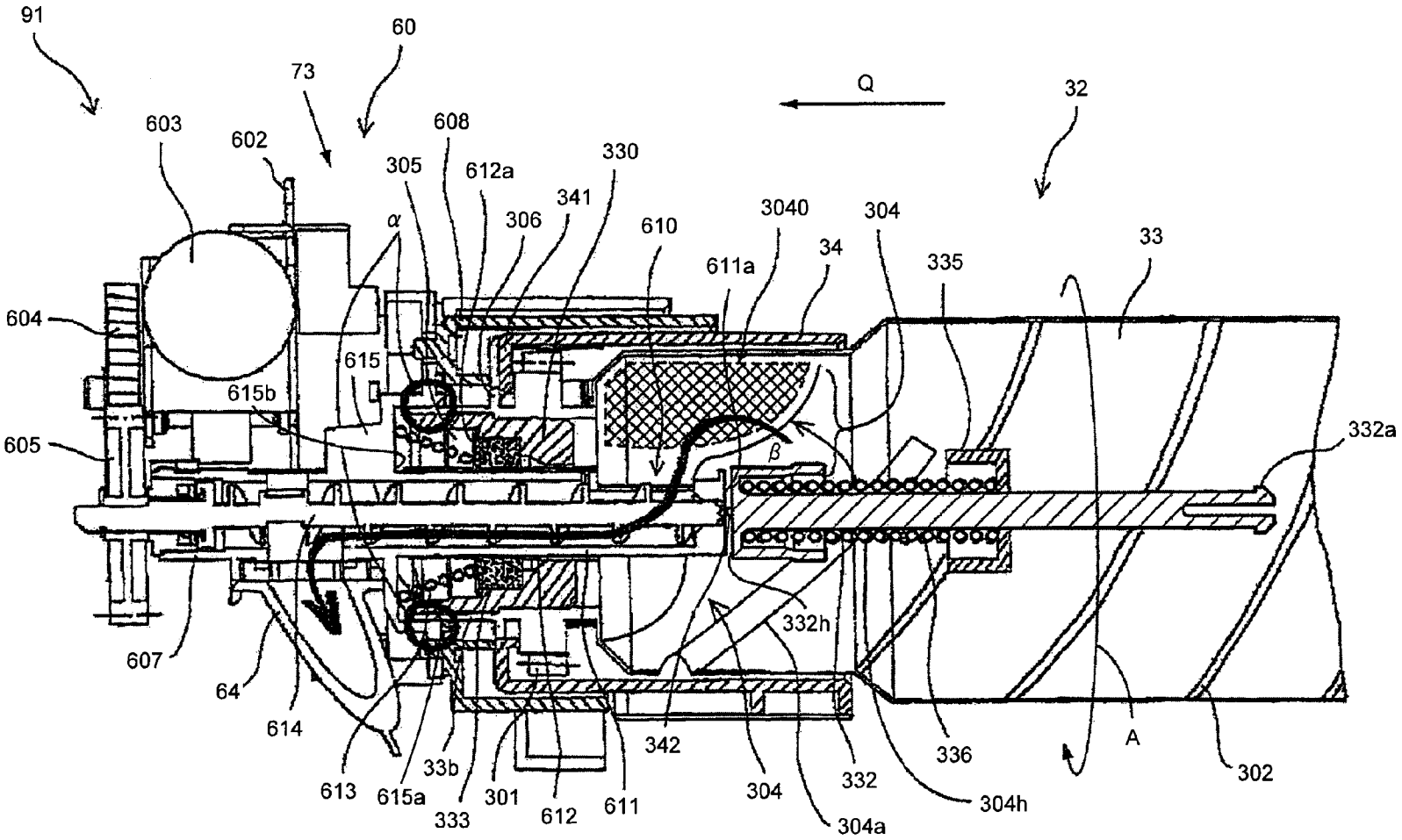
FIG. 8 is an explanatory cross-sectional view of the powder replenishing device to which the powder container is attached and the powder container.

FIG. 1 is an explanatory cross-sectional view of the toner replenishing device 60 before the toner container 32 is attached and a front end of the toner container 32. FIG. 7 is an explanatory perspective view of the toner container 32. FIG. 8 is an explanatory cross-sectional view of the toner replenishing device 60 to which the toner container 32 is attached and the front end of the toner container 32.

As illustrated in FIG. 1, the toner replenishing device 60 includes the conveying nozzle 611 in which the conveying screw 614 is arranged, and a nozzle shutter 612 serving as a nozzle opening/closing member. The nozzle shutter 612 is slidably mounted on the outer surface of the conveying nozzle 611 so as to close the nozzle hole 610 at the time of detachment, which is before the toner container 32 is attached (in the state in FIG. 1), and to open the nozzle hole 610 at the time of attachment, which is when the toner container 32 is attached (in the state in FIG. 8). The nozzle shutter 612 includes a nozzle shutter flange 612*a* serving as a flange on the downstream side in the attachment direction relative to an end surface of a nozzle receiver 330, which serving as a nozzle insertion member (to be described later), in contact with the conveying nozzle 611.

A receiving opening 331, which serves as a nozzle insertion opening into which the conveying nozzle 611 is inserted at the time of attachment, is arranged in the center of the front end of the toner container 32 (container body), and a container shutter 332, which serves as an opening/closing member that closes the receiving opening 331 at the time of detachment, is arranged.

The conveying nozzle 611 is arranged in the center of the setting cover 608. The conveying nozzle 611 is arranged so as to protrude from an end surface 615*b*, which is on the inner side in the attachment direction, of a container setting section 615, which is located on the downstream side in the attachment direction Q of the toner container 32, toward the upstream side in the attachment direction inside the container cover receiving section 73. The container setting section 615 serving as the container receiving section is arranged in a standing manner in the protruding direction of the conveying nozzle 611, that is, toward the upstream side in the attachment direction of the toner container 32 so as to surround the conveying nozzle 611. Specifically, the container setting section 615 is arranged at the base of the conveying nozzle 611 and serves as a positioner to determine the position of the container opening 33*a* relative to the toner container holder 70, where the container opening 33*a* functions as a rotational axis portion when the rotary conveyor inside the toner container 32 rotates to convey the toner contained in the toner container 32. Namely, when the container opening 33*a* is inserted in and mated to the container setting section 615, the radial position of the container opening 33*a* is determined. When the toner container 32 is attached to the toner replenishing device 60, an outer surface 33*b* of the container opening 33*a* of the toner container 32 is slidably mated to the container setting section 615.

By the mating of an inner surface 615*a* of the container setting section 615 and the outer surface 33*b* of the container opening 33*a* of the toner container 32, the position of the toner container 32 relative to the toner replenishing device 60 in the radial direction perpendicular to the longitudinal direction (attachment/detachment direction) of the toner container 32 is determined. Further, when the toner container 32 rotates, the outer surface 33*b* of the container opening 33*a* functions as a rotation axis portion, and the inner surface 615*a* of the container setting section 615 functions as a bearing. In FIG. 8, a indicates the position at which the outer surface 33*b* of the container opening 33*a* comes in sliding contact with the inner surface 615*a* of the container setting section 615 and at which the radial position of the toner container 32 relative to the toner replenishing device 60 is determined.

The toner container 32 will be described below.

Figure 9:
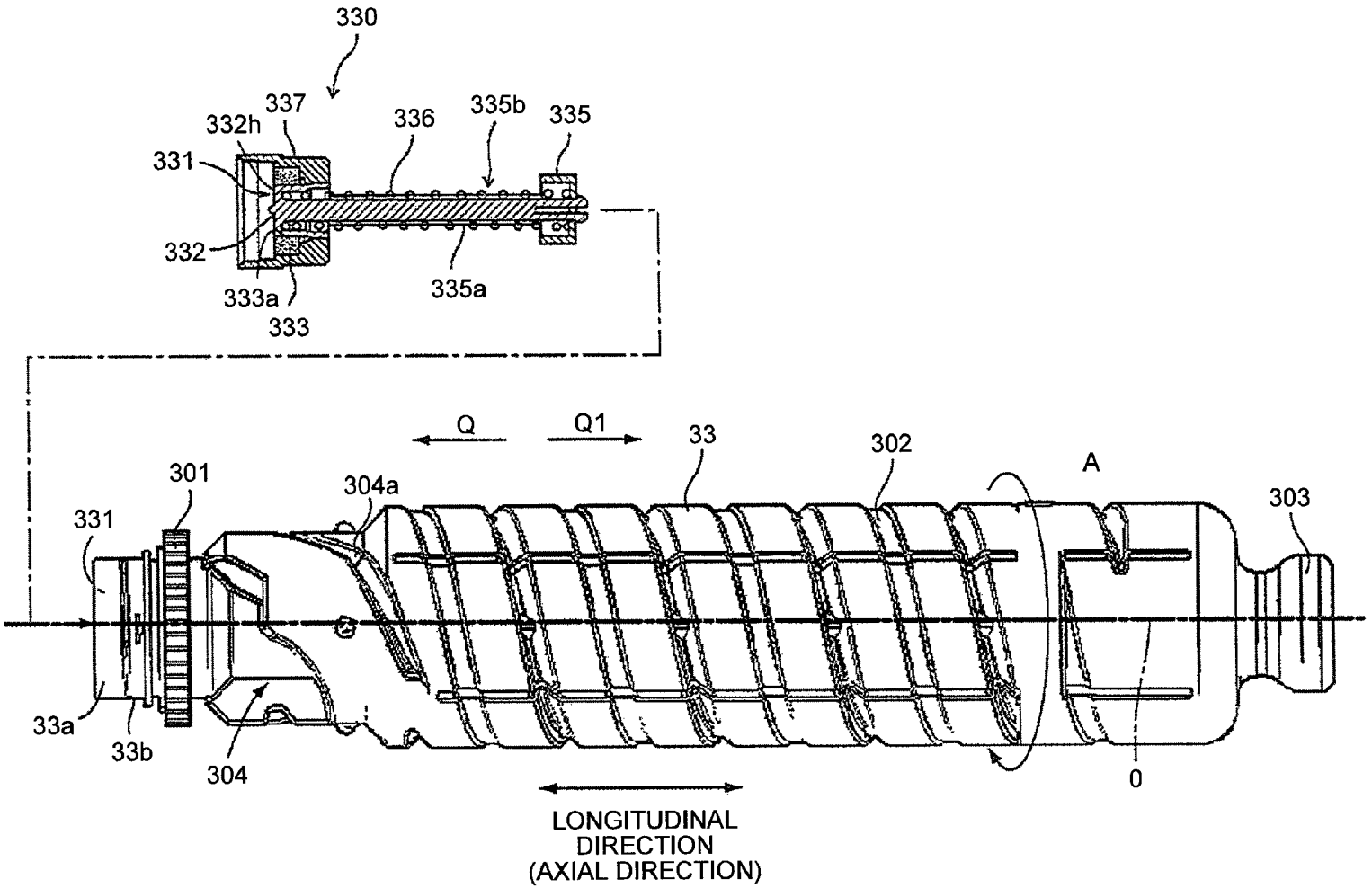
FIG. 9 is a diagram for explaining a configuration of a powder storage of the powder container according to the embodiment and a state in which a nozzle receiver is detached.
Figure 10:
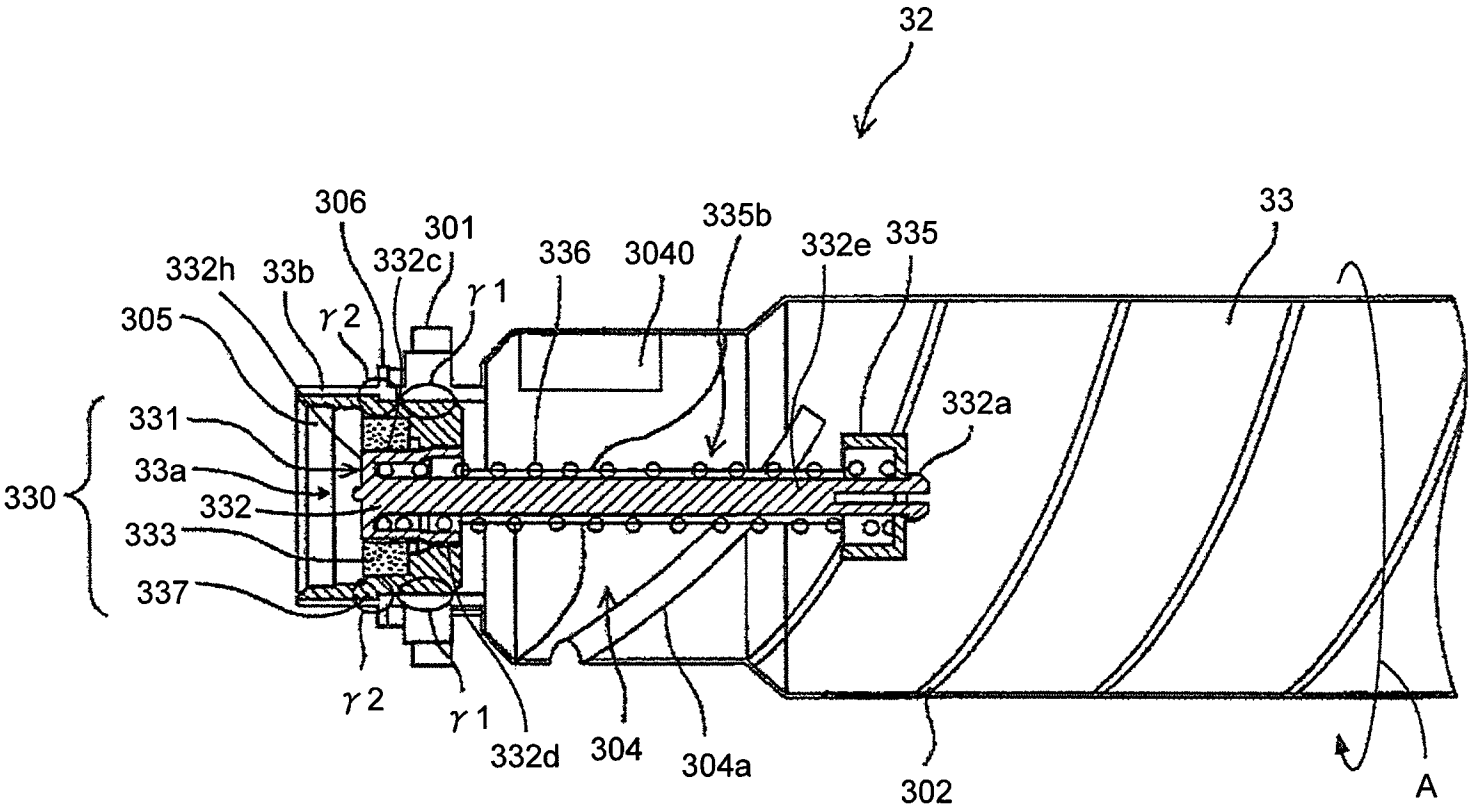
FIG. 10 is a diagram for explaining a state in which the nozzle receiver is attached to the powder storage.

As described above, the toner container 32 mainly includes the container body 33 containing toner, and includes the container front end cover 34. FIG. 9 is a side view of the configuration of the container body 33 from which the container front end cover 34 is detached and the configuration of the nozzle receiver 330 attached to the container body 33. FIG. 10 is a diagram for explaining a state in which the nozzle receiver 330 is attached to the container body 33.

As illustrated in FIG. 9, the container body 33 is in the form of an approximate cylinder and rotates about a central axis of the cylinder as a rotation axis O, which is a central axis of the toner container 32 in the longitudinal direction. Hereinafter, one side of the toner container 32 where the receiving opening 331 is provided (the side where the container front end cover 34 is arranged) in the longitudinal direction of the toner container 32 may be referred to as "a container front end". The other side of the toner container 32 where the gripper 303 is arranged (the side opposite the container front end) may be referred to as "a container rear end". The longitudinal direction of the toner container 32 is the rotation axis direction, and corresponds to the horizontal direction when the toner container 32 is attached to the toner replenishing device 60. The container rear end of the container body 33 relative to the container gear 301 has a greater outer diameter than that of the container front end, and the spiral rib 302 is provided on the inner surface of the container body 33. When the container body 33 rotates in the rotation direction A in the figures, a conveying force for moving toner from one end (the container rear end) to the other end (the container front end) in the rotation axis direction is applied to the toner in the container body 33 due to the action of the spiral rib 302.

As illustrated in FIGS. 9 and 10, a scooping portion 304 serving as a powder scooping portion is provided on the inner wall of the container front end of the container body 33. The scooping portion scoops up the toner conveyed to the container front end by the spiral rib 302 along with the rotation of the container body 33 in the arrow A direction in the figures. The scooping portion 304 scoops toner, which has been conveyed by the conveying force of the spiral rib 302, upward by using a scooping surface 3040 along with the rotation of the container body 33. Therefore, the toner can be scooped up so as to be located above the inserted conveying nozzle 611. As illustrated in FIGS. 9 and 10, a spiral rib 304*a* at the scooping portion is also provided on the inner surface of the scooping portion 304, similarly to the spiral rib 302. The spiral rib 304*a* at the scooping portion has a spiral shape and serves as a conveying portion to convey internally-located toner to the scooping surface 3040. Details of the scooping portion 304 will be described later.

The container gear 301 is provided on the container front end relative to the scooping portion 304 of the container body 33. A gear exposing opening 34*a* is arranged on the container front end cover 34 so that a part of the container gear 301 (on the far side in FIG. 7) is exposed when the container front end cover 34 is attached to the container body 33. When the toner container 32 is attached to the toner replenishing device 60, the container gear 301 exposed from the gear exposing opening 34*a* meshes with the container driving gear 601 of the toner replenishing device 60. The container gear 301 is arranged near the container opening 33*a* (near the container opening 33*a*) relative to the nozzle hole 610 in the longitudinal direction of the container body 33 so as to be able to mesh with the container driving gear 601. The container gear 301 meshes with the container driving gear 601, thereby enabling the rotary conveyor to rotate.

The container opening 33*a* in the form of a cylinder is provided on the container front end relative to the container gear 301 of the container body 33 so as to be coaxial with the container gear 301. As illustrated in FIG. 10, a nozzle receiver attachment portion 337 of the nozzle receiver 330 is press fitted to the container opening 33*a* so as to be coaxial with the container opening 33*a*, so that the nozzle receiver 330 is attached to the container body 33. The toner container 32 is configured such that toner is replenished from the container opening 33*a* serving as an opening provided on one end of the container body 33, and thereafter, the nozzle receiver 330 is inserted in and attached to the container opening 33*a* of the container body 33 as illustrated in FIG. 10. Namely, the container opening 33*a* enables the conveying nozzle 611 to be inserted in a position that serves as a rotation center of the toner container 32.

As illustrated in FIG. 10, a cover hook stopper 306 serving as a restrictor is provided between the container opening 33*a* and the container gear 301 of the container body 33. The cover hook stopper 306 has a ring shape extending in the rotation direction (circumferential direction) on the front end of the container front end cover 34 in the attachment direction.

As illustrated in FIGS. 1 and 8, the container front end cover 34 is attached to the toner container 32 (the container body 33) from the container front end (from the bottom left side in FIG. 8). Therefore, the container body 33 penetrates through the container front end cover 34 in the longitudinal direction, and a cover hook 341 is engaged with the cover hook stopper 306 serving as the restrictor. The container body 33 and the container front end cover 34 are attached so as to rotate relative to each other when the cover hook 341 is engaged with the cover hook stopper 306.

When the toner container 32 is held by the toner container holder 70 illustrated in FIG. 5, a stress (restoring force) for compressing a container shutter spring 336 serving as a biasing member and a stress caused by the compression of a nozzle shutter spring 613 are applied to the toner container 32 as illustrated in FIG. 8.

The toner container 32 according to the embodiment is attachable to the copier 500, to which the toner container 32 containing toner for image formation is attached. The copier 500 includes the conveying nozzle 611 for conveying the toner; the nozzle shutter 612 serving as a powder-receiving-hole opening/closing member that opens and closes the nozzle hole 610 serving as a powder receiving hole provided on the conveying nozzle; the nozzle shutter spring 613 serving as a biasing member that biases the nozzle shutter 612 to close the nozzle hole 610; the container driving gear 601 serving as an apparatus main-body gear that transmits a drive force to the rotary conveyor in the toner container 32; and the container setting section 615 serving as a container receiving section that is arranged around the conveying nozzle 611 so as to be coaxial with the conveying nozzle 611 and that receives the toner container 32.

The nozzle receiver 330 attached to the container body 33 will be described below.

Figure 11:
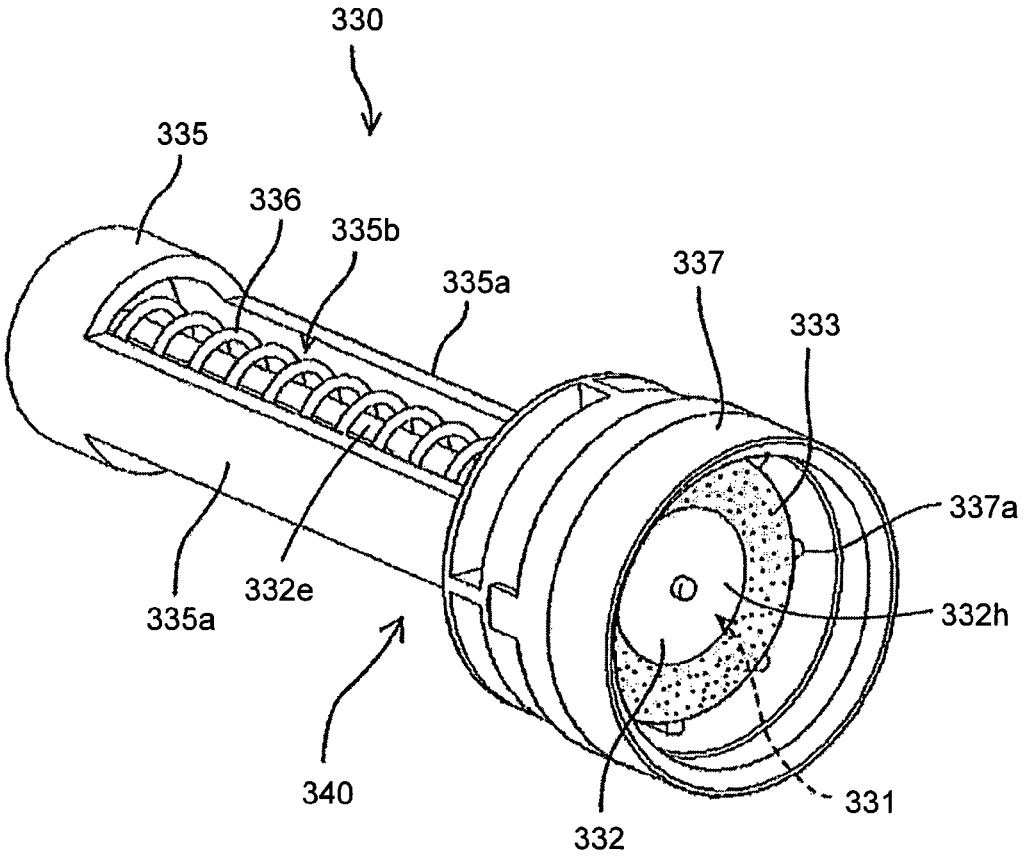
FIG. 11 is a perspective view for explaining the nozzle receiver viewed from a container front end.

As illustrated in FIG. 11, the nozzle receiver 330 includes a container shutter supporter 340 serving as a supporter, the container shutter 332, a container seal 333 serving as a seal, the container shutter spring 336 serving as a biasing means, and the nozzle receiver attachment portion 337. The container shutter supporter 340 includes a shutter rear end supporting portion 335 serving as a shutter rear portion, shutter side supporting portions 335*a* serving as side portions, the openings 335*b*, as shutter side openings, of the shutter supporting portion, and the nozzle receiver attachment portion 337. The container shutter spring 336 is configured by a coil spring. The shutter side supporting portions 335*a* and the openings 335*b* of the shutter supporting portion are provided on the container shutter supporter 340 and are arranged adjacent to each other in the rotation direction of the toner container such that the two opposing shutter side supporting portions 335*a* constitute a part of a cylinder and portions (two portions) corresponding to the openings 335*b* of the shutter supporting portion are largely cut out from the cylinder. With this shape, it is possible to guide the container shutter 332 to move in the longitudinal direction in a cylindrical space located inside the cylinder.

The nozzle receiver 330 attached to the container body 33 rotates together with the container body 33 along with rotation of the container body 33. At this time, the shutter side supporting portions 335*a* of the nozzle receiver 330 rotate around the conveying nozzle 611 of the toner replenishing device 60. Therefore, the shutter side supporting portions 335*a* being rotated alternately pass a space just above the nozzle hole 610 provided in the upper part of the conveying nozzle 611. Consequently, even if toner is accumulated for a moment above the nozzle hole 610, because the shutter side supporting portions 335*a* cross the accumulated toner and alleviate the accumulation, it is possible to prevent cohesion of the accumulated toner when the apparatus is not used and prevent a toner conveying failure when the apparatus is resumed. In contrast, when the shutter side supporting portions 335*a* are located on the sides of the conveying nozzle 611 and the nozzle hole 610 and the opening 335*b* of the shutter supporting portion face each other, toner in the container body 33 is supplied to the conveying nozzle 611 as indicated by an arrow p in FIG. 8.

As illustrated in FIG. 10, the container shutter 332 includes a front cylindrical portion 332*c* serving as a closure, a slide area 332*d* serving as a gliding portion or a sealing portion, a guiding rod 332*e* serving as an elongated portion, and shutter hooks 332*a*. The front cylindrical portion 332*c* is a container front end portion to be tightly fitted to a cylindrical opening (the receiving opening 331) of the container seal 333. The slide area 332*d* is a cylindrical portion provided on the container rear end relative to the front cylindrical portion 332*c*. The slide area 332*d* has an outer diameter slightly greater than that of the front cylindrical portion 332*c* and slides on the inner surfaces of the shutter side supporting portions 335*a* as a pair.

The guiding rod 332*e* is a cylinder that stands from the inner side of the cylinder of the front cylindrical portion 332*c* toward the container rear end. The guiding rod 332*e* serves as a rod portion that is inserted to the inside of the coil of the container shutter spring 336 and that guides the container shutter spring 336 such that the container shutter spring 336 does not buckle. The shutter hooks 332*a* are provided on an end opposite to the base from which the guiding rod 332*e* stands, and serve as a pair of engaging portions that prevent the container shutter 332 from coming off from the container shutter supporter 340.

A front end of the container shutter spring 336 abuts against an inner wall surface of the front cylindrical portion 332*c*, and a rear end of the container shutter spring 336 abuts against a wall surface of the shutter rear end supporting portion 335. At this time, the container shutter spring 336 is in a compressed state, so that the container shutter 332 receives a biasing force in a direction away from the shutter rear end supporting portion 335 (toward the container front end). However, the shutter hooks 332*a* provided on the container rear end of the container shutter 332 are hooked on an outer wall of the shutter rear end supporting portion 335. Therefore, the container shutter 332 is prevented from moving further in the direction away from the shutter rear end supporting portion 335. Due to the hooked state between the shutter hooks 332*a* and the shutter rear end supporting portion 335 and the biasing force of the container shutter spring 336, positioning is performed.

As illustrated in FIG. 8, when the toner container 32 is attached to the toner replenishing device 60, the nozzle shutter flange 612*a* of the nozzle shutter 612 of the toner replenishing device 60 presses and deforms a protruding portion of the container seal 333 by being biased by the nozzle shutter spring 613. The nozzle shutter flange 612*a* further moves inward and abuts against the container front ends of nozzle shutter positioning ribs 337*a* illustrated in FIG. 11, thereby covering and sealing the front end surface of the container seal 333 from the outside of the container. Therefore, it becomes possible to ensure the sealing performance in the periphery of the conveying nozzle 611 at the receiving opening 331 in the attached state, enabling to prevent toner leakage.

As illustrated in FIG. 8, the back side of a biased surface 612*f* of the nozzle shutter flange 612*a* biased by the nozzle shutter spring 613 abuts against the nozzle shutter positioning ribs 337*a*, so that the position of the nozzle shutter 612 relative to the toner container 32 in the longitudinal direction is determined. Therefore, a positional relationship of the front end surface of the container seal 333, the front end surface of a front end opening 305 (an internal space of the cylindrical nozzle receiver attachment portion 337 arranged in the container opening 33*a* as will be described later), and the nozzle shutter 612 in the longitudinal direction is determined.

Figure 12A:
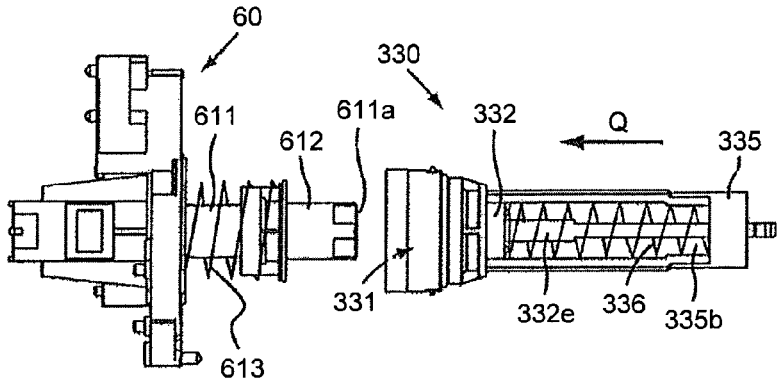
FIGS. 12A to 12D are top plan views for explaining states of an opening/closing member and a nozzle in attachment operation.
Figure 12B:
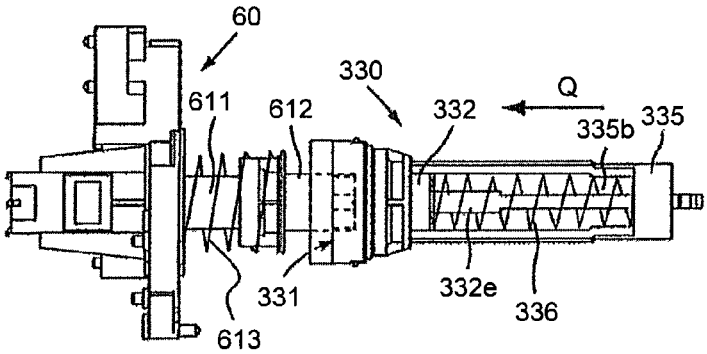
Figure 12C:
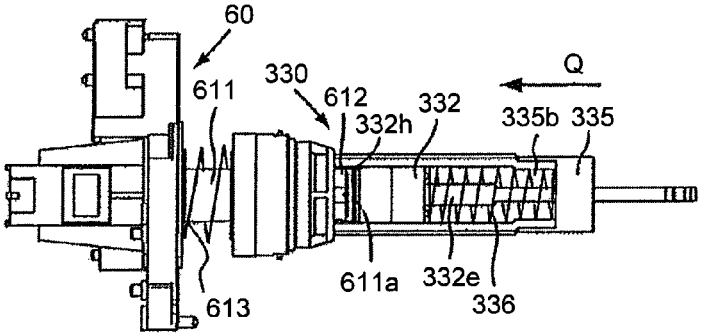
Figure 12D:
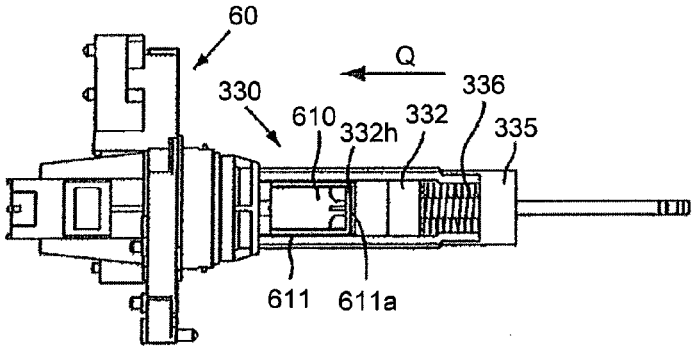

The operation of the container shutter 332 and the conveying nozzle 611 will be described below with reference to FIGS. 1, 8, and 12A to 12D. Before the toner container 32 is attached to the toner replenishing device 60, as illustrated in FIG. 1, the container shutter 332 is biased by the container shutter spring 336 toward the closing position so as to close the receiving opening 331. The appearance of the container shutter 332 and the conveying nozzle 611 at this time is illustrated in FIG. 12A. When the toner container 32 is attached to the toner replenishing device 60, as illustrated in FIG. 12B, the conveying nozzle 611 is inserted in the receiving opening 331. When the toner container 32 is further pushed into the toner replenishing device 60, an end surface 332*h* of the front cylindrical portion 332*c*, which serves as an end surface of the container shutter 332 (hereinafter, referred to as "the end surface 332*h* of the container shutter") and a front end 611*a*, as an end surface, of the conveying nozzle 611 in the insertion direction of the conveying nozzle 611 (hereinafter, referred to as "the front end (end surface) 611*a* of the conveying nozzle") come in contact with each other. When the toner container 32 is further pushed from the state as described above, the container shutter 332 is pushed as illustrated in FIG. 12C. Accordingly, as illustrated in FIG. 12D, the conveying nozzle 611 is inserted in the shutter rear end supporting portion 335 from the receiving opening 331. Therefore, as illustrated in FIG. 8, the conveying nozzle 611 is inserted in the container body 33 and located at the set position. At this time, as illustrated in FIG. 12D, the nozzle hole 610 is located at a position overlapping the opening 335*b* of the shutter supporting portion.

Subsequently, when the container body 33 rotates, toner scooped up so as to be located above the conveying nozzle 611 by the scooping portion 304 falls in and is introduced into the conveying nozzle 611 via the nozzle hole 610 that is opened upward. The toner introduced into the conveying nozzle 611 is conveyed inside the conveying nozzle 611 toward the toner dropping passage 64 along with the rotation of the conveying screw 614. Subsequently, the toner falls in and is supplied to the developing device 50 through the toner dropping passage 64.

As described above, when the toner is scooped up by the scooping portion 304 and supplied to the nozzle hole 610 of the conveying nozzle 611 inserted in the front end opening 305 serving as an opening of the nozzle receiver 330 attached to the container body 33, in some cases, it may be difficult to efficiently supply toner T from the scooping portion 304 to the nozzle hole 610 depending on the fluidity of the toner, the rotation frequency of the container body 33, or the like. Therefore, the present inventors have studied configurations of the scooping portion 304 (the container body 33), and found some effective configurations. The configurations will be described in detail below.

First Embodiment

Figure 13:
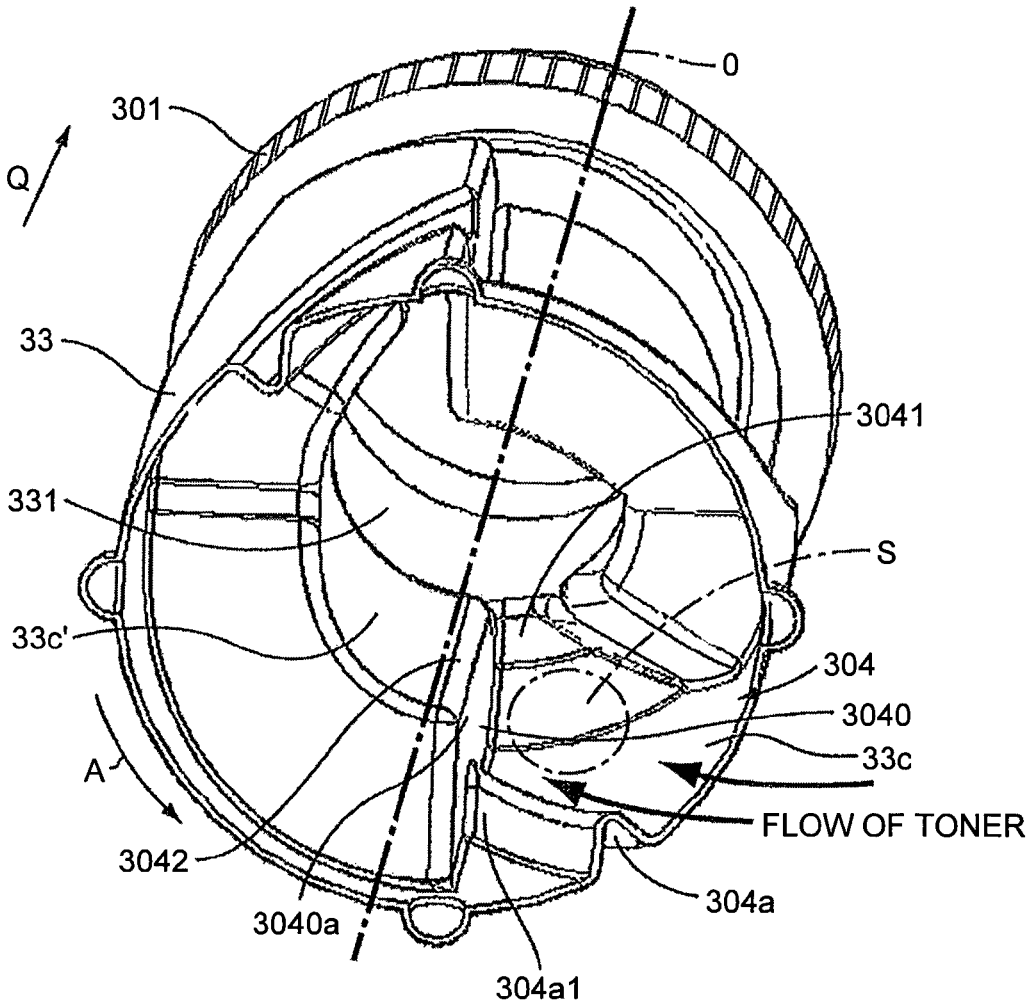
FIG. 13 is an enlarged perspective view for explaining a configuration of an opening side of the powder storage of the powder container according to the embodiment.
Figure 14:
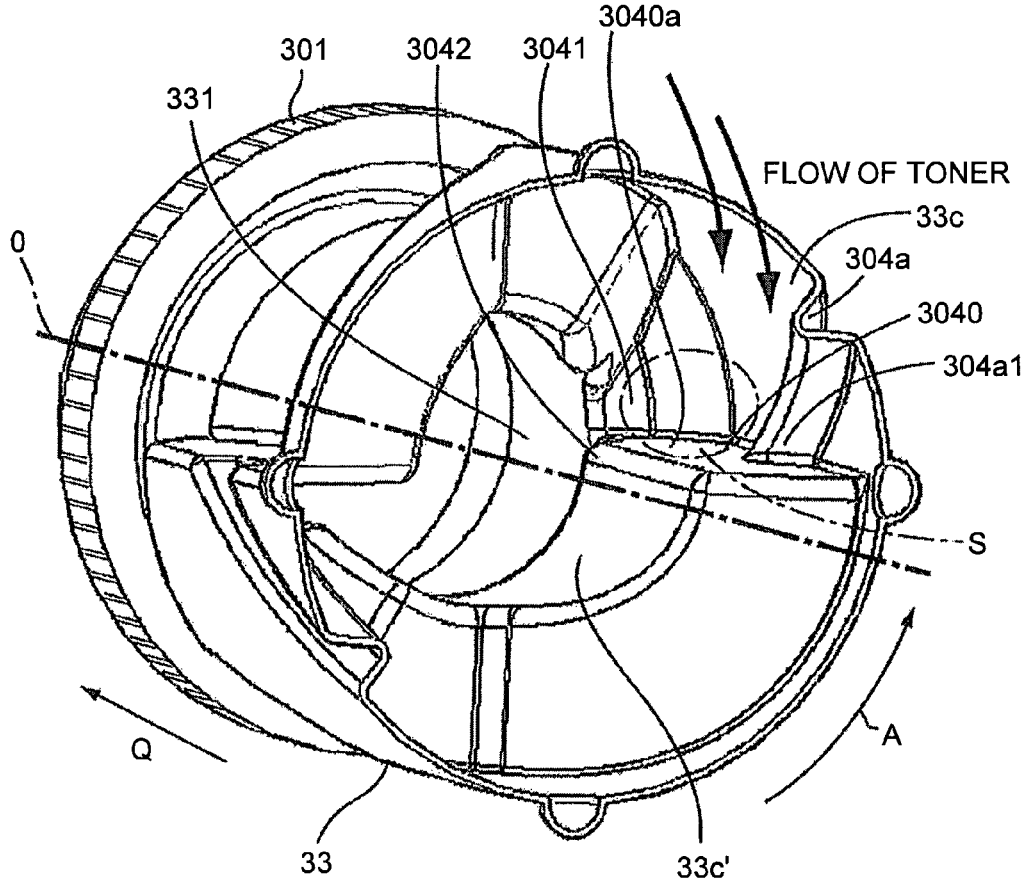
FIG. 14 is an enlarged perspective view for explaining a configuration of the opening side when the powder storage illustrated in FIG. 13 rotates.
Figure 15:
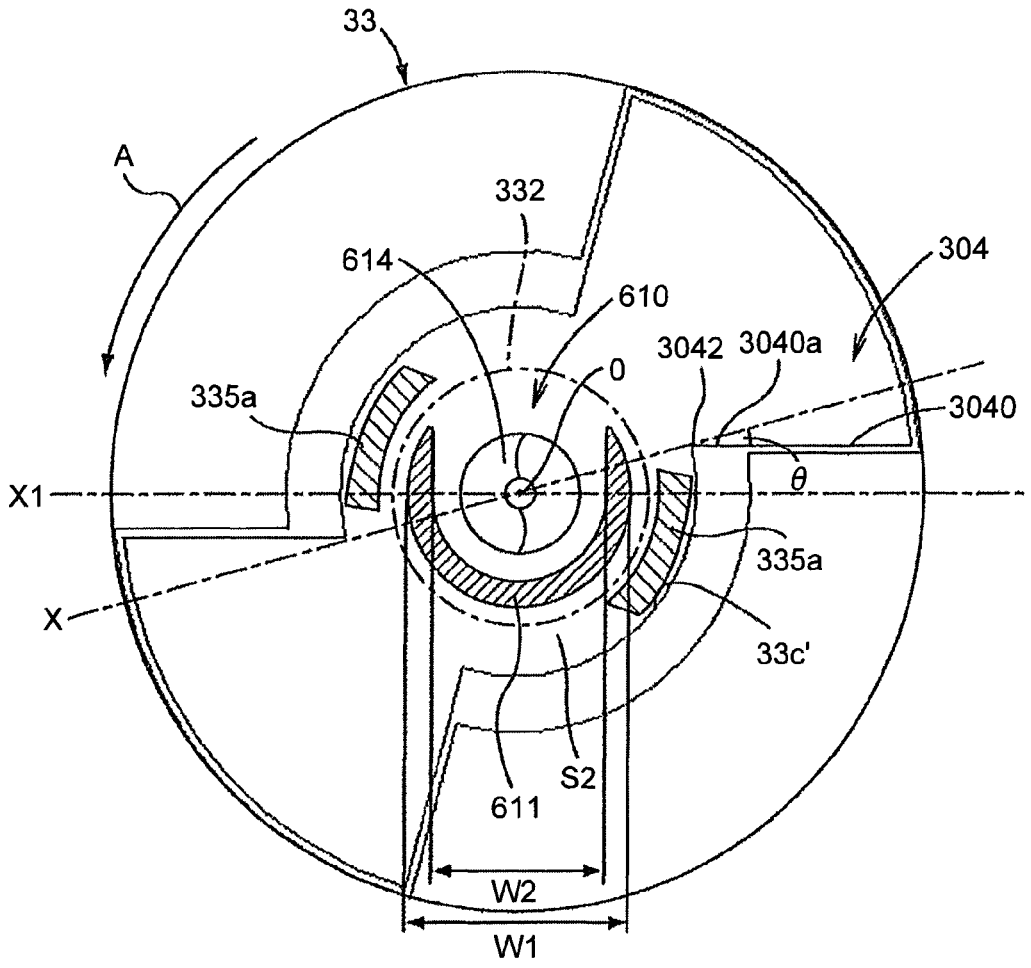
FIG. 15 is an enlarged view illustrating a configuration of a scooping surface of a scooping portion (powder scooping portion) according to a first embodiment of the present invention.

As illustrated in FIGS. 13, 14, and 15, in a first embodiment, the scooping portion 304 provided on the container opening 33*a* side of the container body 33 scoops up the toner T that is conveyed to the container opening 33*a* along with rotation of the container body 33 in the rotation direction A, and supplies the toner T to the nozzle hole 610 (see FIG. 15) when the container body 33 rotates. The nozzle receiver 330 is inserted in and attached to the container opening 33*a*; therefore, in the description of the scooping portion 304 below, the container opening 33*a* of the container body 33 is described as the receiving opening 331.

In the first embodiment, as illustrated in FIGS. 13 and 14, the scooping portion 304 includes the scooping surface 3040 that extends inwardly from an inner wall surface 33*c* of the container body 33. In the scooping surface 3040, an inner end portion 3040*a* of the scooping surface on the rotation axis O side extends in a direction along the rotation axis direction of the container body 33. Specifically, an edge (side) 3042 closest to the rotation axis O side on the inner end portion 3040*a* of the scooping surface extends approximately parallel to the rotation axis O and constitutes a ridge line along the rotation axis O between a portion 33*c*' protruding toward the rotation axis O of the inner wall surface 33*c* of the container body 33 and the scooping surface 3040. Further, as illustrated in FIG. 15, in the cross-section perpendicular to the rotation axis, the scooping surface 3040 is inclined by a certain angle in a predetermined range toward the upstream side in the rotation direction A of the container body 33 with respect to a virtual line X. The virtual line X passes through the rotation axis O and is tangent to the edge (side) 3042 of the inner end portion of the scooping surface 3040 in the cross-section perpendicular to the rotation axis. In the first embodiment, the predetermined range of an inclined angle θ is set to 25±5 degrees. The edge (side) may be a sharp edge or a round edge.

In FIG. 15, a configuration that includes the two scooping surfaces 3040 in the rotation direction is illustrated; however, the number of the scooping surfaces 3040 is not limited thereto. If a plurality of the scooping surfaces 3040 are provided, it is preferable to arrange the scooping surfaces at positions at which a plurality of the edges (sides) 3042 are point-symmetric with respect to the rotation axis O and equally spaced from each other in the rotation direction (for example, at 180-degrees intervals).

As for the effective range of the inclined angle θ of the scooping surface 3040, an evaluation model was generated and evaluation was performed. This will be described in detail below. As an evaluation method, toner bottles manufactured (experimentally produced) as a plurality of evaluation models with scooping surfaces at different inclined angles θ were attached to the copier 500 serving as an image forming apparatus for evaluation, the container bodies 33 were rotated for a certain period of time at a constant speed, and thereafter, toner remaining amounts in the containers were measured.

TABLE 1

| Inclined angle θ of scooping surface (degrees (°)) | Toner remaining amount (grams (g)) | Following capability (percent (%)) of toner replenishing amount |
|---|---|---|
| negative (−) | not good | no evaluation |
| 0 | good | 35 |
| 15 | good | 70 |
| 25 | good | 100 |

Table 1 is a list of evaluation results.

In Table 1, assuming that the inclined angle θ of the scooping surface 3040 is 0 degree when the scooping surface 3040 is located approximately parallel to a virtual line X1 that passes horizontally through the rotation axis O (see FIG. 15), positive (+) indicates a case where the scooping surface 3040 is located above the virtual line X1 (on the downstream side in the rotation direction A) and negative (−) indicates a case where the scooping surface 3040 is located below the virtual line X1 (on the upstream side in the rotation direction A).

In other words, in the positional relationship in which the virtual lines X and X1 overlap each other, that is, when the rotation axis O and the edge (side) 3042 are arranged horizontally, positive (+) indicates a case where the scooping surface 3040 is inclined toward the upstream side in the rotation direction A of the container body 33 and negative (−) indicates a case where the scooping surface 3040 is inclined toward the downstream side in the rotation direction A of the container body 33.

Further, the angle θ of the scooping surface 3040 with respect to the virtual line X is referred to as the inclined angle θ. The virtual line X is constructed by drawing a straight line that passes through the rotation axis O and that is tangent to the edge (side) 3042 on a cross-section perpendicular to the rotation axis of the toner container 32. When the toner container 32 includes the two scooping surfaces 3040, the virtual line X may be constructed by drawing a straight line that is tangent to the two edges (sides) 3042.

The toner remaining amount (g) indicates an amount of the toner T remaining in the container body 33.

The following capability of the toner replenishing amount indicates a difference of an actually-replenished amount (actual replenishing amount) from a set replenishing amount determined in advance, and is represented by a ratio (%). The following capability of 100 percent indicates that the actual replenishing amount is equal to the set replenishing amount and there is no deficiency in toner replenishment. This is the most preferable state, in which the necessary and sufficient amount of the toner T is replenished to the developing device 50 (see FIG. 4). With a decrease in the value of the following capability, the actual replenishing amount decreases from the set replenishing amount, so that the amount of toner supplied to the developing device 50 (see FIG. 4) decreases. In a case where the inclined angle θ is negative (−), evaluation of the following capability was not performed because the toner remaining amount was not good (see Table 1).

Toner with the same apparent density (apparent bulk density or loose apparent density) (g/cm3) was used for the container bodies 33 with the scooping surfaces 3040 at different inclined angles θ. The apparent density (g/cm$^3$) was set in a range from 0.41 to 0.48 g/cm$^3$ by taking into account variations.

The amount of toner remaining in the container body 33 (the amount of remaining toner) is preferably set to be equal to or smaller than a reference value, where the reference value may be set to 15 grams for example. The reference value varies depending on the type of the container body 33, and is not limited to the value as described above.

Figure 16:
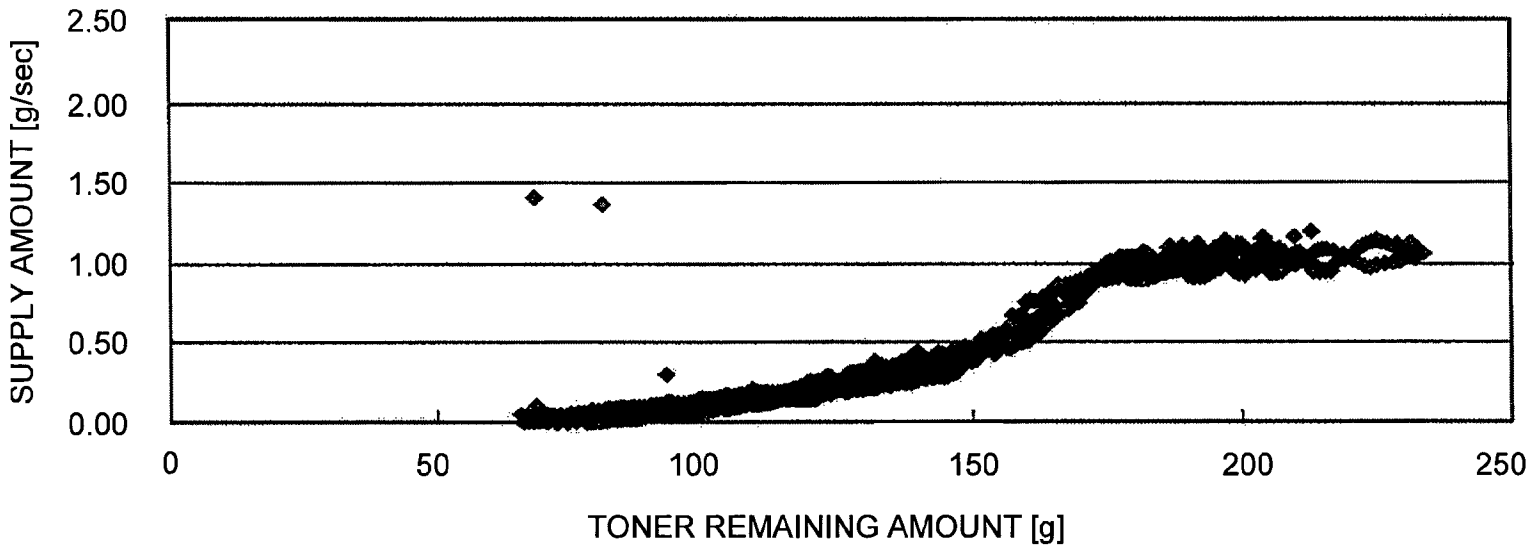
FIG. 16 is a diagram illustrating a relationship between a toner remaining amount and a replenishing amount, as a scooping characteristic when the scooping surface is inclined in a negative direction.

FIG. 16 illustrates a relationship between the toner remaining amount and the replenishing amount, as a scooping characteristic when the inclined angle θ of the scooping surface 3040 is set to the negative side. As illustrated in FIG. 16, if the inclined angle θ is set to the negative side, the toner remaining amount is far greater than the reference value, and the toner remaining amount does not reach the reference value.

Figure 17:
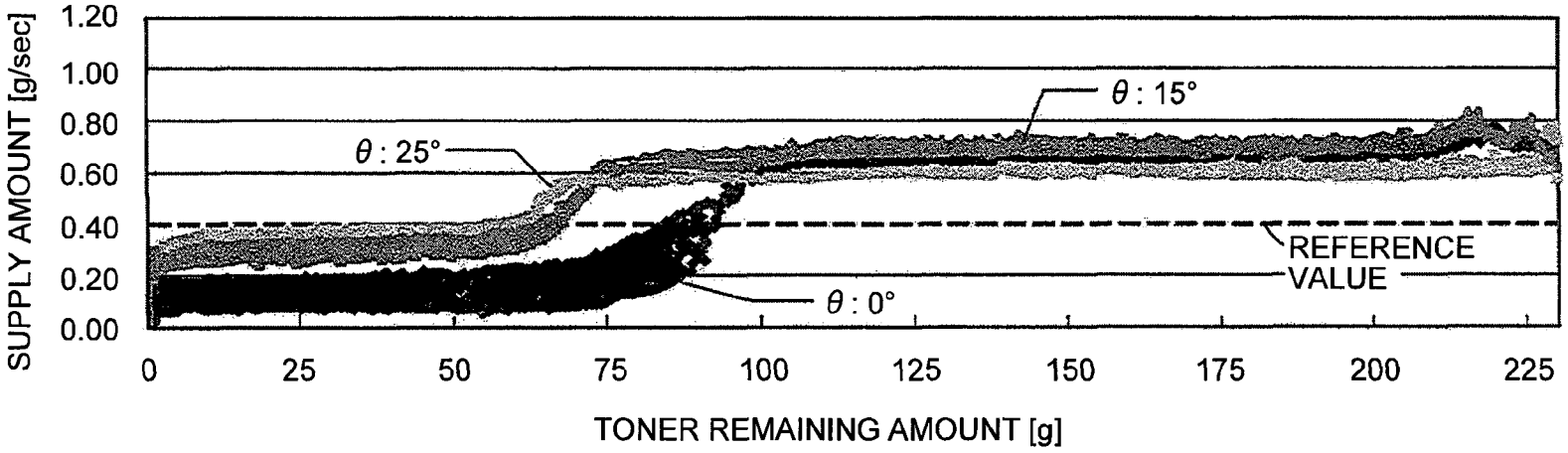
FIG. 17 is a diagram illustrating a relationship between the toner remaining amount and the replenishing amount, as a scooping characteristic when an inclined angle of the scooping surface is changed.

FIG. 17 illustrates a relationship between the toner remaining amount and the replenishing amount, as a scooping characteristic when the inclined angle θ of the scooping surface 3040 is changed. The inclined angle θ is set to 0 degree, 15 degrees, and 25 degrees. At all of the inclined angles θ, the toner remaining amount reaches the reference value. For example, focus is placed on a certain region, where the toner remaining amount falls in a predetermined region, such as a region of a small toner remaining amount of 75 grams or smaller. In this region, there is a tendency that the toner replenishing amount reaches the most stable state and the following capability reaches the highest value with an increase in the inclined angle θ such that 0 degree<15 degrees<25 degrees.

Therefore, if the toner remaining amount (g) and the following capability (%) of the toner replenishing amount are taken into account, it is most preferable to set the inclined angle θ of the scooping surface 3040 to 25 degrees. If manufacturing errors are also taken into account, it is preferable to set the inclined angle θ in the range of 25±5 degrees.

Next, the present inventors generated and evaluated evaluation models for a relationship between the rotation frequency (rpm) of the container body 33 and the inclined angle θ of the scooping surface 3040. This will be described below.

TABLE 2

| Rotation frequency of container body (rpm) | Toner discharge amount | Variation in toner replenishing amount due to environmental variation |
|---|---|---|
| 95 | good | — |
| 110 | better than 95 rpm | excellent |
| 130 | better than 110 rpm | good |

Table 2 is a list of evaluation results when the toner T with the same apparent density (g/cm$^3$) is used and the rotation frequency (rpm) of the container body 33 is changed. As an evaluation method, toner bottles manufactured (experimentally produced) as a plurality of evaluation models were attached to an image forming apparatus for evaluation, the rotation frequency of the container body 33 was changed, and the toner discharge amount was measured at each rotation frequency.

The toner discharge amount (g) indicates a discharge amount that was obtained when the container body 33 rotates at a predetermined rotation frequency. The value of the discharge amount corresponds to the toner replenishing amount.

The variation in the toner replenishing amount due to environmental variation indicates variation in toner dischargeability due to variation in conditions.

Figure 18:
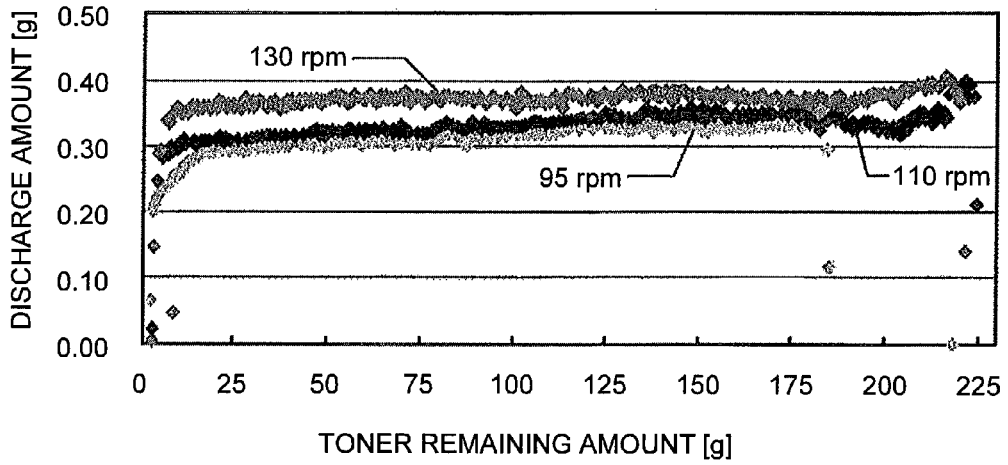
FIG. 18 is a diagram illustrating a relationship between the toner remaining amount and the replenishing amount, as a scooping characteristic of the scooping surface when a rotation frequency of the container body is changed.

FIG. 18 illustrates a relationship between the toner remaining amount (g) and the discharge amount (g) from the container body 33 when the rotation frequency (rpm) of the container body 33 is changed. In the first embodiment, the rotation frequency (rpm) of the container body 33 is set to three levels of 95 rpm, 110 rpm, and 130 rpm. As illustrated in FIG. 18, even when the rotation frequency (rpm) of the container body 33 is changed, the discharge amount (g) serving as the toner replenishing amount is stable, and the replenishing amount (g) increases with an increase in the rotation frequency such that 95 rpm<110 rpm<130 rpm.

Figure 19A:
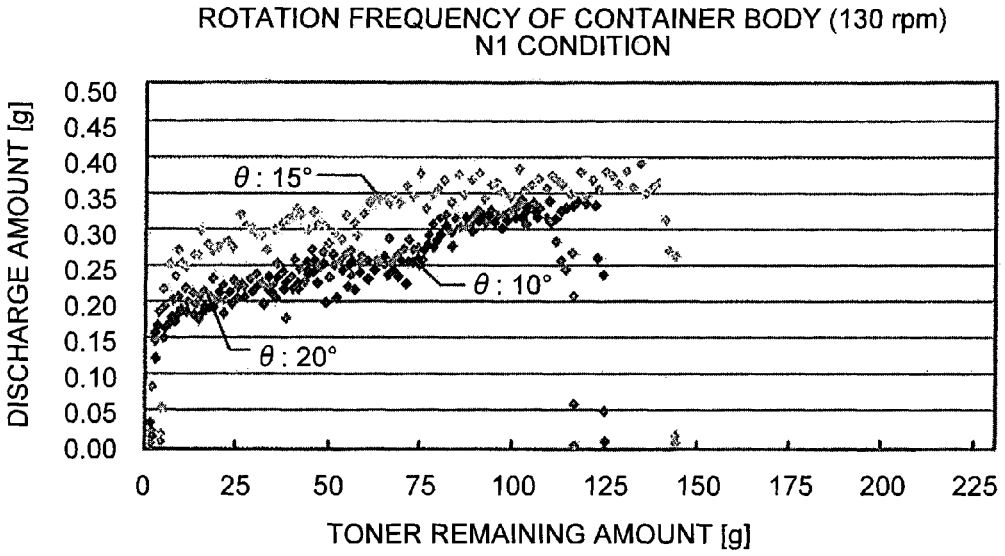
FIGS. 19A and 19B are diagrams for comparing relationships between the toner remaining amount and a discharge amount, as a scooping characteristic when the inclined angle of the scooping surface and a toner environmental condition are changed.
Figure 19B:
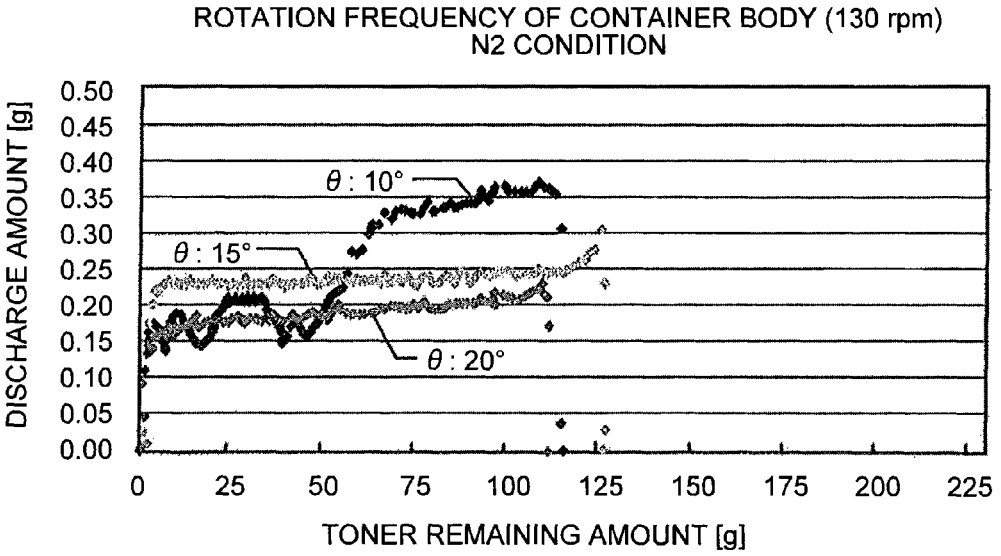

FIGS. 19A and 19B are diagrams for comparing relationships between the toner remaining amount and the discharge amount, as a scooping characteristic when the inclined angle θ of the scooping surface 3040 of the evaluation model and a toner environmental condition are changed. The inclined angle θ of the scooping surface 3040 is set to three levels of 10 degrees, 15 degrees, and 20 degrees. FIG. 19A illustrates a relationship between the toner remaining amount and the discharge amount when the container body 33 rotates at 130 rpm and the environmental condition is set to an N1 condition. FIG. 19B illustrates a relationship between the toner remaining amount and the discharge amount when the container body 33 rotates at 130 rpm and the environmental condition is set to an N2 condition. The N1 condition is a condition in which the toner dischargeability is high, and is, for example, an LL (low temperature/low humidity) environment or the like. The N2 condition is a condition in which the toner dischargeability is low, and is, for example, an HH (high temperature/high humidity) environment or the like. In FIGS. 19A and 19B, experiments were performed at the temperature and humidity of 10 degrees Celsius and 15 percent in the N1 condition, and at the temperature and humidity of 45 degrees Celsius and 32 percent in the N2 condition. Further, a standard condition is, for example, an MM (medium temperature/medium humidity) environment or the like, and experiments were performed at the temperature and humidity of 23 degrees Celsius and 50 percent. A change in the environment from the N1 condition to the N2 condition is assumed as the environmental variation.

Figure 20A:
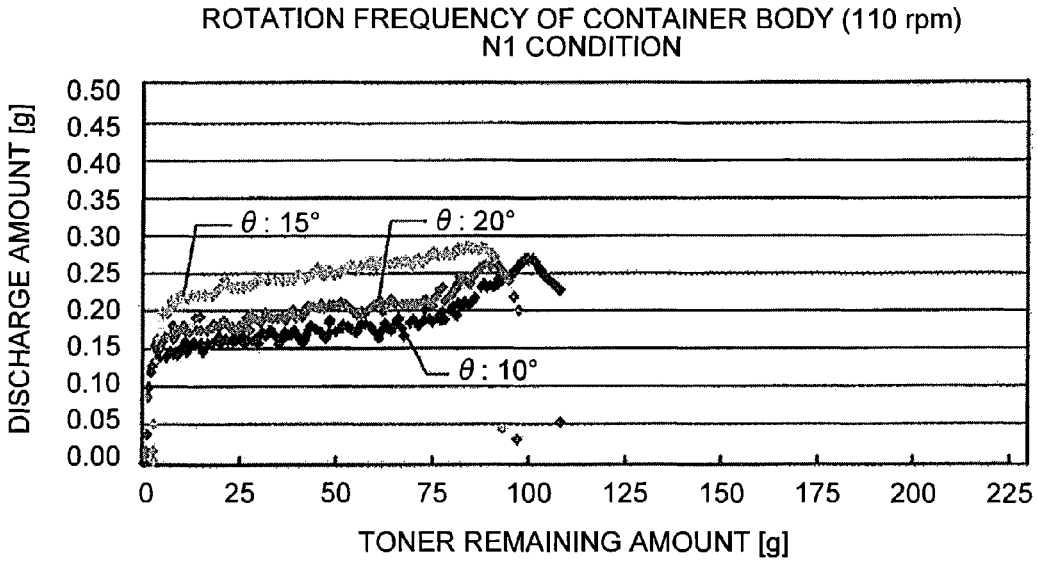
FIGS. 20A and 20B are diagrams for comparing relationships between the toner remaining amount and the discharge amount, as a scooping characteristic when the rotation frequency of the container body is changed relative to FIG. 19 and the inclined angle of the scooping surface and the toner environmental condition are changed.
Figure 20B:
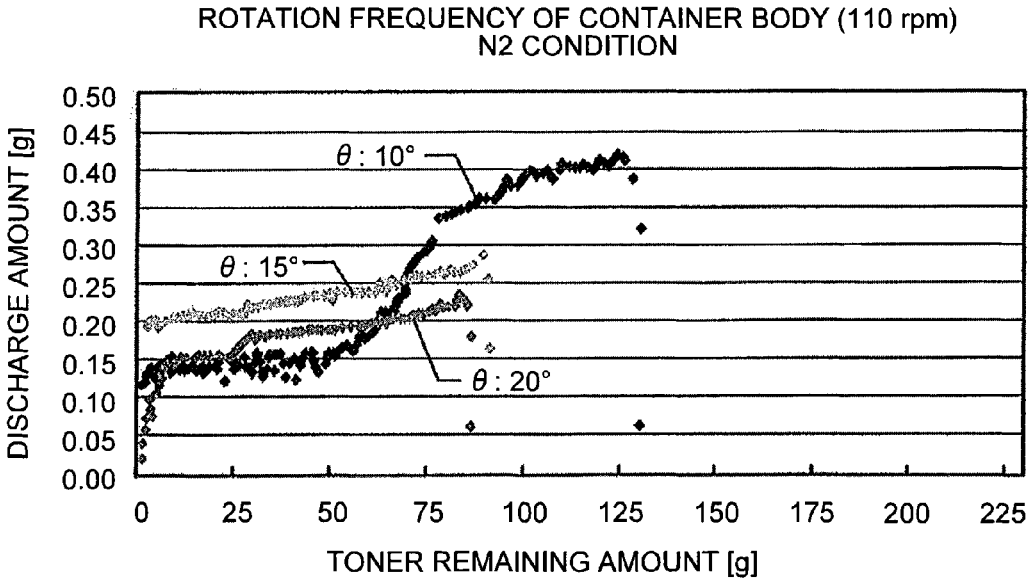

FIGS. 20A and 20B are diagrams for comparing relationships between the toner remaining amount and the discharge amount, as a scooping characteristic when the inclined angle θ of the scooping surface 3040 of the evaluation model and the environmental condition are changed. FIG. 20A illustrates a relationship between the toner remaining amount and the discharge amount when the container body 33 rotates at 110 rpm and the environmental condition is set to the N1 condition. FIG. 20B illustrates a relationship between the toner remaining amount and the discharge amount when the container body 33 rotates at 110 rpm and the environmental condition is set to the N2 condition. The conditions N1 and N2 are the same as those illustrated in FIGS. 19A and 19B.

As illustrated in FIGS. 19A and 19B, when the rotation frequency of the container body 33 is 130 rpm, even if the inclined angle θ of the scooping surface 3040 is changed to 10 degrees, 15 degrees, or 20 degrees, variation between the toner remaining amount and the discharge amount tends to be lower in the N1 condition than in the N2 condition.

As illustrated in FIGS. 20A and 20B, when the rotation frequency of the container body 33 is 110 rpm, similarly to the case of 130 rpm, even if the inclined angle θ of the scooping surface 3040 is changed to 10 degrees, 15 degrees, or 20 degrees, variation between the toner remaining amount and the discharge amount still tends to be lower in the N1 condition than in the N2 condition. However, if FIG. 19A and FIG. 20A are compared to each other, it is found that the variation tends to be lower in the case where the container body 33 rotates at 110 rpm as illustrated in FIG. 20A than in the case where the container body 33 rotates at 130 rpm as illustrated in FIG. 19A.

In view of the above, even when the inclined angle θ of the scooping surface 3040 is changed in a predetermined range, if the rotation frequency of the container body 33 is about 110 rpm, variation between the toner remaining amount and the discharge amount remains low and stable. Therefore, in the first embodiment, it is most preferable to set the rotation frequency (rpm) of the container body 33 to 110 rpm. Further, as for the upper and lower limits of the rotation frequency (rpm), because the characteristics of the toner remaining amount and the discharge amount at 95 rpm and 130 rpm are similar to the characteristics at 110 rpm as illustrated in FIG. 18, it is preferable to set the lower limit to 95 rpm and the upper limit to 130 rpm. Namely, in the first embodiment, it is preferable to rotate the container body 33 in the rotation direction A at 110±15 rpm as a predetermined range of the rotation frequency.

In this manner, if the inclined angle θ of the scooping surface 3040 is set to 25±5 degrees, the rotation frequency of the container body 33 in the rotation direction A is set to 110±15 rpm, and the toner T with the apparent density ($g/cm^3$) in a range from 0.41 to 0.48 $g/cm^3$ is used, toner does not wastefully spill from the scooping surface 3040 before the toner is supplied to the nozzle hole 610 of the conveying nozzle 611, and the scooping surface 3040 does not pass above the nozzle hole 610 while holding the toner T. Therefore, the scooping surface 3040 can scoop the toner T up to an appropriate position, so that it is possible to reduce variation in the amount of toner flowing in the nozzle hole 610 even in the conditions in which the fluidity of the toner changes due to the apparent density, an environment, or the like.

FIGS. 21A, 21B, 22A, and 22B illustrate results of evaluation that was performed such that the toner bottle 32 manufactured as a mass production model, rather than the above described powder container of the evaluation model (prototype model), was attached to and operated in a single-body test machine (toner replenishment single-body test machine) that was generated so as to be able to operate in the same manner as a real machine.

Figure 21A:
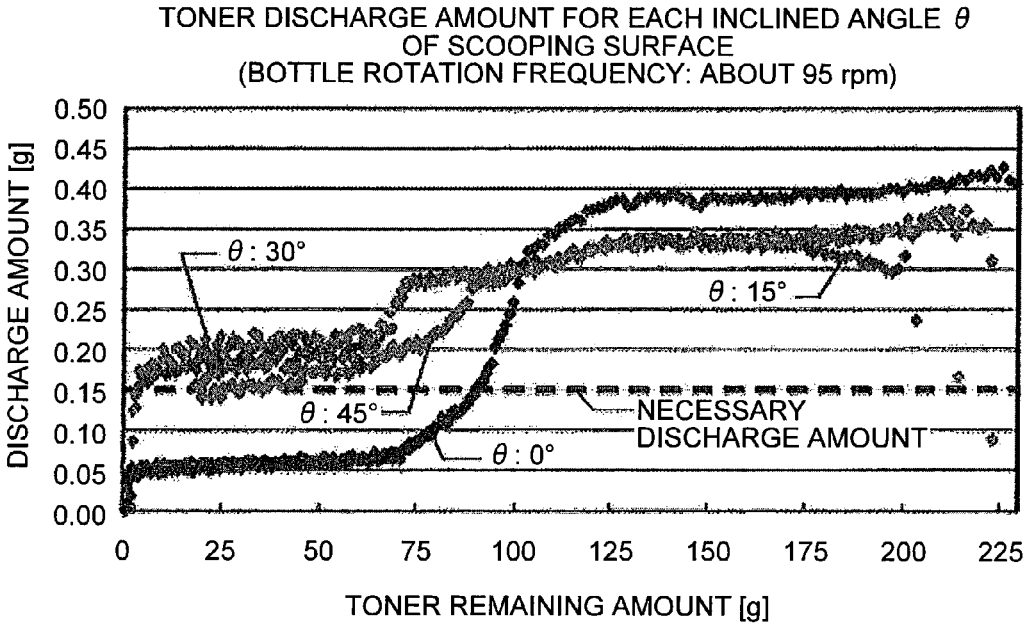
FIGS. 21A and 21B are diagrams for comparing relationships between the toner remaining amount and the discharge amount, as a scooping characteristic when an inclined angle of a scooping surface and a rotation frequency of a container body of a powder container of a mass production model according to the embodiment are changed.
Figure 21B:
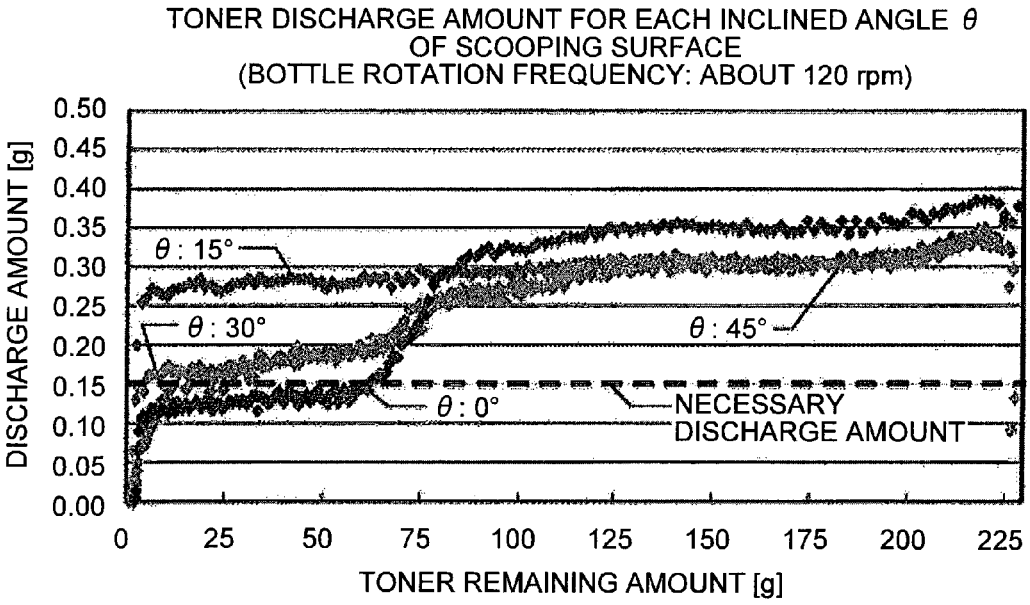

FIGS. 21A and 21B are diagrams for comparing the toner discharge amounts at the respective inclined angles θ of the scooping surfaces 3040 of the container bodies 33 of the mass production model under the same conditions. FIG. 21A illustrates evaluation results of the toner discharge amount (g) when the container bodies 33 of four mass production models, in which the inclined angles θ of the scooping surfaces 3040 were set to 0 degree, 15 degrees, 25 degrees, and 45 degrees, respectively, were attached to the real machine and rotated at the rotation frequency of 95 rpm. FIG. 21B illustrates evaluation results of the toner discharge amount (g) when the container bodies 33 of four mass production models, in which the inclined angles θ of the scooping surfaces 3040 were set to 0 degree, 15 degrees, 25 degrees, and 45 degrees, respectively, were attached to the real machine and rotated at the rotation frequency of 120 rpm.

The evaluation is superior when the toner discharge amount (g) is greater in a region of a small toner remaining amount. As illustrated in FIG. 21A, at the low rotation frequency (95 rpm), the discharge amounts at the inclined angles θ of 15 degrees and 30 degrees are approximately the same and at the peak. However, the discharge amount at the inclined angle θ of 0 degree is extremely inferior, and the discharge amount decreases if the inclined angle θ is increased to 45 degrees. In contrast, as illustrated in FIG. 21B, at the high rotation frequency (120 rpm), the inclined angle θ of 15 degrees is at the peak, the inclined angles θ of 30 degrees and 45 degrees are approximately the same and at the second peak, and the inclined angle θ of 0 degree is most inferior. A target value of the rotation frequency of a bottle of the real machine is set to between the above described two conditions; therefore, it is found that the optimal inclined angle θ is in a range from 15 degrees to 30 degrees.

Further, in the case of printing by the real machine, a greater toner discharge amount enables to cope with an image with a greater printing area; therefore, there may be a problem if the discharge amount at the level of a large toner remaining amount is lower than a necessary discharge amount that is indicated by a dashed line as a discharge amount needed for the machine. When plots of the respective inclined angles θ are compared to one another with reference to the necessary discharge amount, the inclined angles θ of 15 degrees and 30 degrees are the most superior and meet a target such that the discharge amounts are greater than the necessary discharge amount until the remaining amounts reach about 5 grams. The inclined angle θ of 45 degrees is the second superior and meets a target such that the discharge amount is greater than the necessary discharge amount until the remaining amount reaches about 15 to 25 grams. The inclined angle θ of 0 degree is most inferior and does not fully meet a target such that the discharge amount is greater than the necessary discharge amount only until the remaining amount reaches about 60 to 90 grams. In view of the above, it is found that the most optimal inclined angle θ is in the range of 15 degrees to 30 degrees.

Figure 22A:
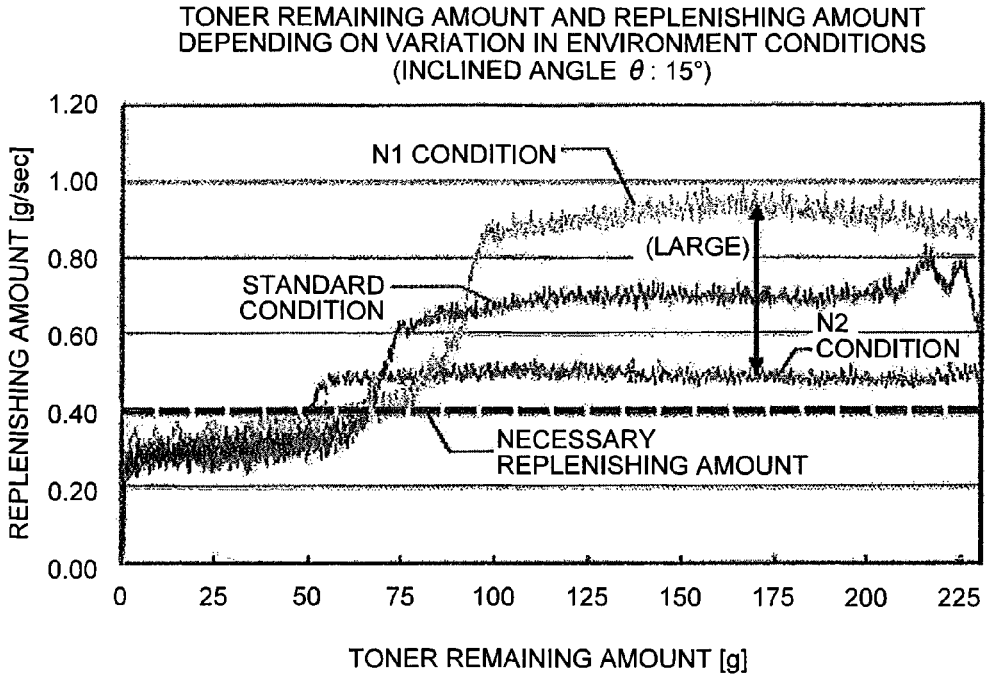
FIGS. 22A and 22B are diagrams for comparing relationships between the toner remaining amount and the replenishing amount, as a scooping characteristic when the inclined angle of the scooping surface and a toner environmental condition of the container body of the powder container of a mass production model according to the embodiment are changed.
Figure 22B:
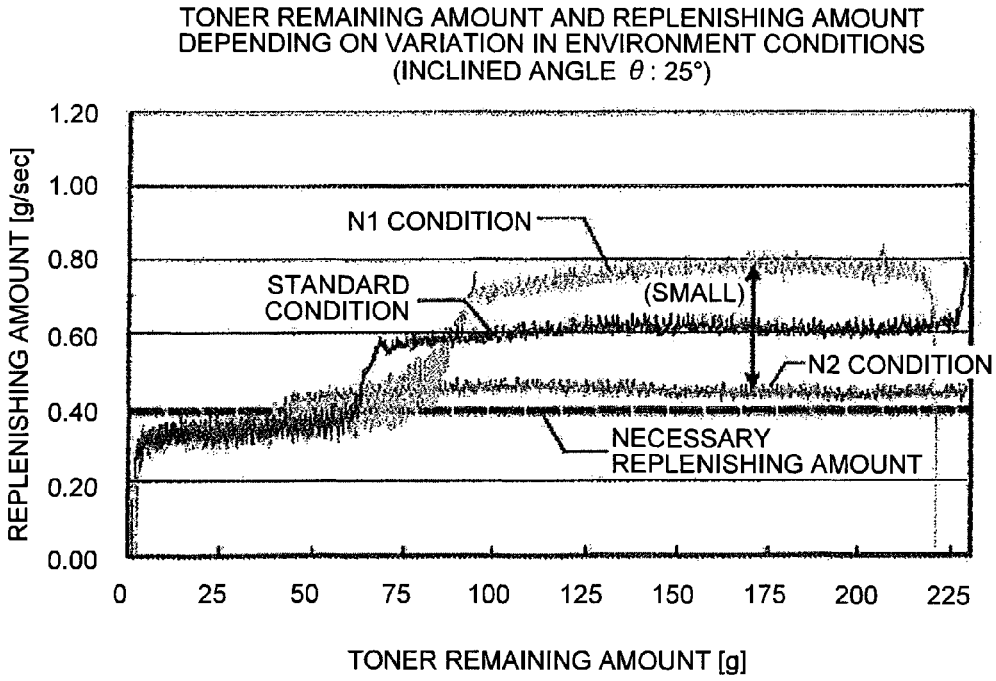

FIGS. 22A and 22B are diagrams for comparing variation ranges of the toner replenishing amounts at the respective inclined angles of the scooping surfaces 3040 of the container bodies 33 of the mass production model due to environmental load. FIG. 22A illustrates evaluation results of the toner replenishing amount (g/sec) when the container body 33 of a mass production model, in which the inclined angle θ of the scooping surface 3040 is set to 15 degrees, is attached to a real machine and rotated at a predetermined rotation frequency while environmental conditions are changed. FIG. 22B illustrates evaluation results of the toner replenishing amount (g/sec) when the container body 33 of a mass production model, in which the inclined angle θ of the scooping surface 3040 is set to 25 degrees, is attached to a real machine and rotated at a predetermined rotation frequency while environmental conditions are changed.

It can be said that the smaller the variation in the replenishing amount due to the environment or conditions, the more stable the replenishment is. Thus, the evaluation is superior when such replenishment is possible. As illustrated in FIGS. 22A and 22B, assuming that an N1 condition is set such that factors (the apparent density of toner, the temperature and humidity, and the like) that influence the replenishing amount are set to be the most advantageous conditions, and an N2 condition is set such that the factors are set to be the most disadvantageous conditions, the superiority and inferiority with respect to the environmental are compared at the bottle rotation frequency in the range of 95 to 120 rpm and at the inclined angle θ in the range of 15 degrees to 30 degrees, which are determined as superior in FIGS. 21A and 21B. As concrete values, the container bodies with the inclined angle θ of 15 degrees and the inclined angle θ of 25 degrees are compared at the bottle rotation frequency of 110 rpm. Dashed lines in the figures indicate a target replenishing amount (target value) per unit time. As a result of the comparison, in both of the container bodies with the inclined angles θ of the scooping surfaces 3040 of 15 degrees and 25 degrees, the target replenishing amount (target value) is achieved in the region of a small toner remaining amount, and the replenishing amounts are approximately the same. However, if focus is placed on a magnitude relationship of an environmental variation range, which is a difference in the replenishing amount between the N1 condition higher than the standard condition and the N2 condition lower than the standard condition, it is found that the environmental variation range at the inclined angle θ of 25 degrees is smaller than at the inclined angle θ of 15 degrees and the inclined angle θ of 25 degrees is superior. Incidentally, concrete examples of the N1 condition, the N2 condition, and the standard conditions are the same as those described above with reference to FIGS. 19A, 19B, 20A, and 20B.

In this manner, as for the inclined angle θ of the scooping surface 3040, it is preferable to incline the scooping surface 3040 by 25±5 degrees toward the upstream side in the rotation direction A of the container body 33 with respect to the virtual line X passing through the rotation axis O and the edge (side) 3042, regardless of whether it is the evaluation model or the mass production model. Further, it is preferable to set the rotation frequency of the toner container 32 in the range of 110±15 rpm.

Second Embodiment

Figure 23A:
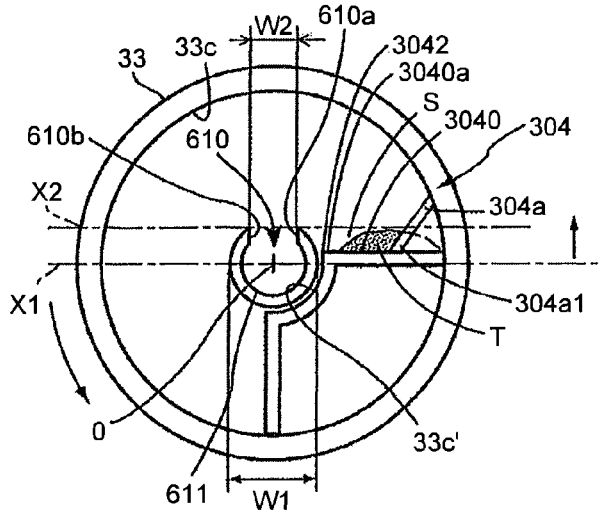
FIGS. 23A to 23C are operation diagrams for schematically explaining a change with rotation of a scooping portion according to a second embodiment of the present invention.
Figure 23B:
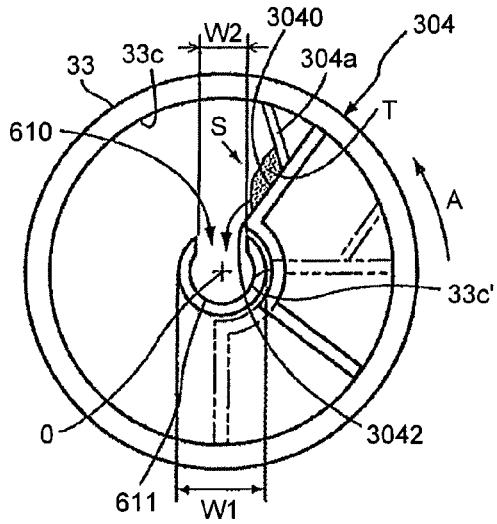

In a second embodiment, focus is placed on the position and the height (i.e., the length in the direction perpendicular to the rotation axis) of the scooping surface 3040. As illustrated in FIGS. 13 and 14, the edge (side) 3042 of the inner end portion of the scooping surface 3040 extends approximately parallel to the rotation axis O. When the edge (side) 3042 of the inner end portion of the scooping surface 3040 rotates from the position illustrated in FIG. 23A to the position illustrated in FIG. 23C upon attachment to the toner replenishing device 60 and upon rotation of the container body 33 in the rotation direction A, the edge (side) 3042 is located inside a cross-sectional range W1 of the conveying nozzle 611, and more preferably, inside an opening range W2 of the nozzle hole 610, above the nozzle hole 610 as illustrated in FIG. 23B. The cross-sectional range W1 serves as an opening range of the powder receiving hole in the axial direction.

In the second embodiment, a range in which the edge (side) 3042 of the inner end portion extends in the rotation axis direction is a range that overlaps with at least a part of the nozzle hole 610 in the rotation axis direction when the container body 33 is attached to the toner replenishing device 60. As illustrated in FIG. 23A, the scooping surface 3040 is located above the virtual line X1 in a horizontal state. In the second embodiment, the center of the nozzle hole 610 is arranged so as to coincide with the center of the rotation axis O. Therefore, the virtual line X1 crosses the nozzle hole 610 in the horizontal direction. In FIG. 23A, X2 indicates a virtual line as an extended line of an upper surface of the nozzle hole 610. The virtual line X2 is a plane approximately parallel to the virtual line X1. Namely, in the second embodiment, as illustrated in FIG. 23A, the scooping surface 3040 including the edge (side) 3042 of the inner end portion is located below the upper surface of the nozzle hole 610.

Figure 24:
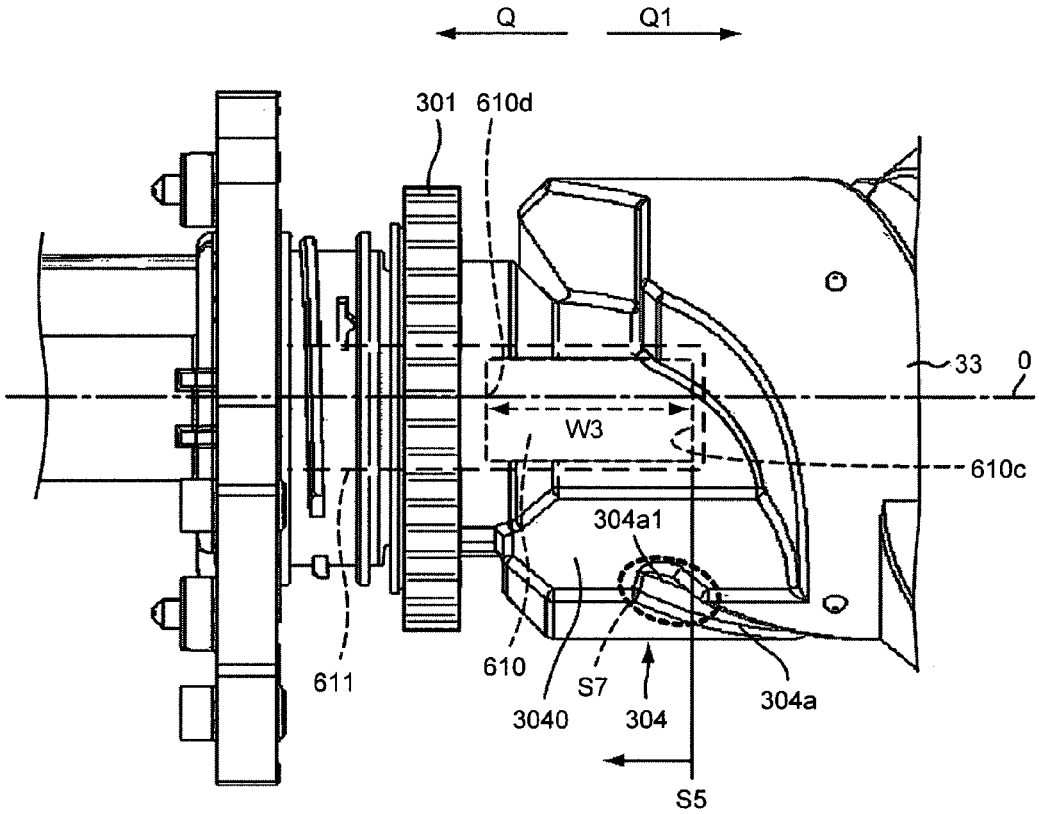
FIG. 24 is an enlarged view for explaining a positional relationship between a connection portion of the scooping portion and a conveying portion and a powder receiving hole of the conveying portion.
Figure 32:
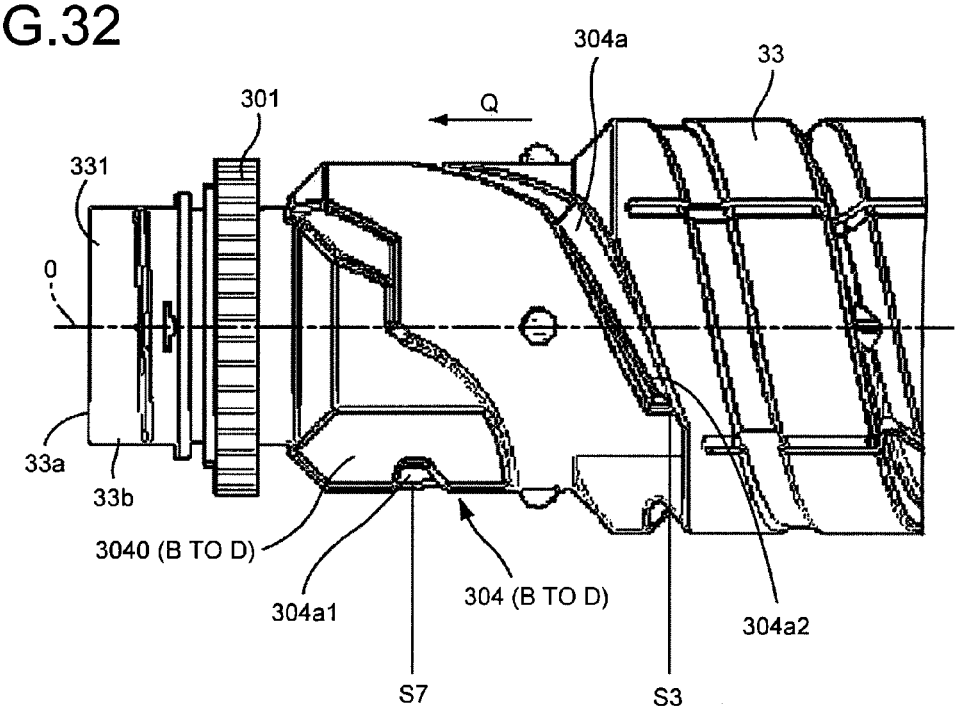
FIG. 32 is an enlarged view for explaining a positional relationship between the conveying portion and the scooping portion in the rotation axis direction.

As illustrated in FIGS. 13 and 14, there is a space S, which serves as a toner holding space, in a region facing the scooping surface 3040 in the scooping portion 304. The space S is surrounded by the scooping surface 3040 and the inner wall surface 33*c* of the container body 33. As illustrated in FIG. 24, the spiral rib 304*a* at the scooping portion, which serves as a conveying portion, is used for conveying toner toward the receiving opening 331 in the space S. A first end 304*a*1 of the spiral rib at the scooping portion, which serves as a terminated portion at the scooping portion, is connected to the scooping surface 3040. And a second end 304*a*2 of the spiral rib at the scooping portion on a side distant from the opening is located on the downstream in the detachment direction Q1 relative to the first end 304*a*1 of the spiral rib at the scooping portion. The second end 304*a*2 is indicated in FIG. 32. A connection portion S7 between the scooping surface 3040 and the first end 304*a*1 of the spiral rib at the scooping portion is located inside an opening range W3 in the rotation axis direction of the nozzle hole 610 when the conveying nozzle 611 is inserted. The connection portion S7 serves as a start position or a starting point of the conveying portion (i.e., as a start position of the spiral rib 304*a* at the scooping portion). In other words, the conveying portion is connected to the scooping surface 3040 at the connection portion S7, and the connection portion S7 is in the opening range W3 of the nozzle hole 610 in the rotation axis direction. The opening range W3 is an interval between end portions 610*c* and 610*d* of the nozzle hole 610, which are arranged opposite to each other in the rotation axis direction. Namely, in the container body 33, the connection portion S7 is located on the downstream in the attachment direction Q relative to a position S5 of the end portion 610*c* of the nozzle hole 610 that is arranged in the rotation axis direction. A wall 3041 is provided on the scooping portion 304 in a region of the container front end of the space S. The wall 3041 serves as a container front wall connected to the scooping surface 3040 and the receiving opening 331 and extends along the rotation direction. The wall 3041 defines the space S (toner holding space) in the rotation axis direction. The scooping surface 3040 defines upstream side of the space S in the rotation direction. The wall 3041 is located in an opening range W2 of the nozzle hole 610 in the axial direction. The opening range W2 will be described later. The toner T on the scooping surface 3040 is supplied from the space S toward the receiving opening 331, that is, the nozzle hole 610, through the wall 3041.

In this manner, in the second embodiment, the scooping surface 3040 and the edge (side) 3042 of the inner end portion of the scooping portion 304 arranged on the container body 33 are located inside the opening range W2 of the nozzle hole 610, which is an opening range of the powder receiving hole in the rotation direction, above the nozzle hole 610 as illustrated in FIG. 23B. Therefore, when the scooping surface 3040 is inclined along with rotation of the container body 33, and even if toner with high fluidity slips down along the scooping surface 3040 at an early timing, it is possible to supply the toner to the nozzle hole 610. Consequently, it is possible to efficiently supply the toner T to the nozzle hole 610 of the conveying nozzle 611 inserted in the container body 33.

Figure 23C:
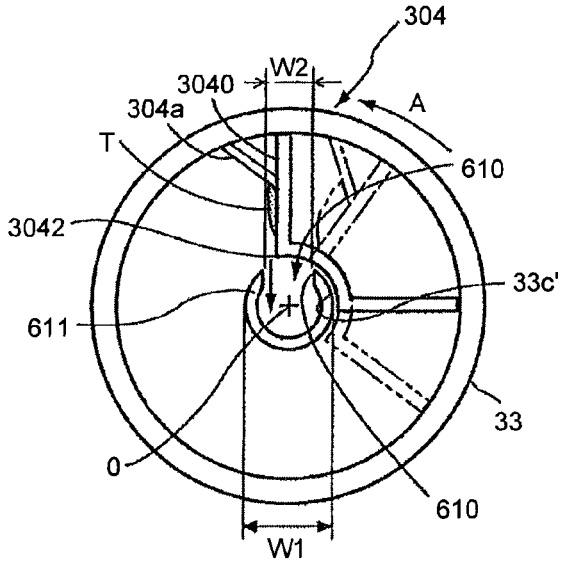

Further, the scooping surface 3040 is located above the virtual line X1 when the scooping surface 3040 faces upward as illustrated in FIG. 23A. Therefore, even when the scooping surface 3040 is oriented perpendicular to the rotation axis O because of rotation of the container body 33 as illustrated in FIG. 23C, the scooping surface 3040 is located inside the opening range W2. Therefore, even if toner with low fluidity remains on the scooping surface 3040, it is possible to supply the toner to the nozzle hole 610. Consequently, it is possible to efficiently supply the toner T to the nozzle hole 610 of the conveying nozzle 611 inserted in the container body 33, and reduce remaining toner in the container body 33.

When the spiral rib 304*a* at the scooping portion is not provided, and if the rotation speed of the container body 33 is fast, toner scooped up to the container outer peripheral side of the scooping surface 3040 (on the inner wall surface 33*c* side distant from the rotation axis O) may pass by the nozzle hole 610 before slipping down to the edge (side) 3042 side of the inner end portion of the scooping surface 3040.

However, in the second embodiment, toner is conveyed to the space S facing the scooping surface 3040 by the spiral rib 304*a* at the scooping portion; therefore, even when rotation fluctuation of the container body 33 occurs or the fluidity of toner changes, it is possible to supply a sufficient amount of toner onto the scooping surface 3040. Consequently, it is possible to stably and efficiently supply the toner T to the nozzle hole 610.

The connection portion S7 between the scooping surface 3040 and the first end 304*a*1 of the spiral rib 304*a* at the scooping portion is located inside the opening range W3 in the rotation axis direction of the nozzle hole 610; therefore, toner conveyed by the spiral rib 304*a* at the scooping portion is collected around the nozzle hole 610. Therefore, it is possible to reduce the amount of toner that slips down to other than the nozzle hole 610, enabling to more efficiently supply the toner on the scooping surface 3040 to the nozzle hole 610.

Figure 25:
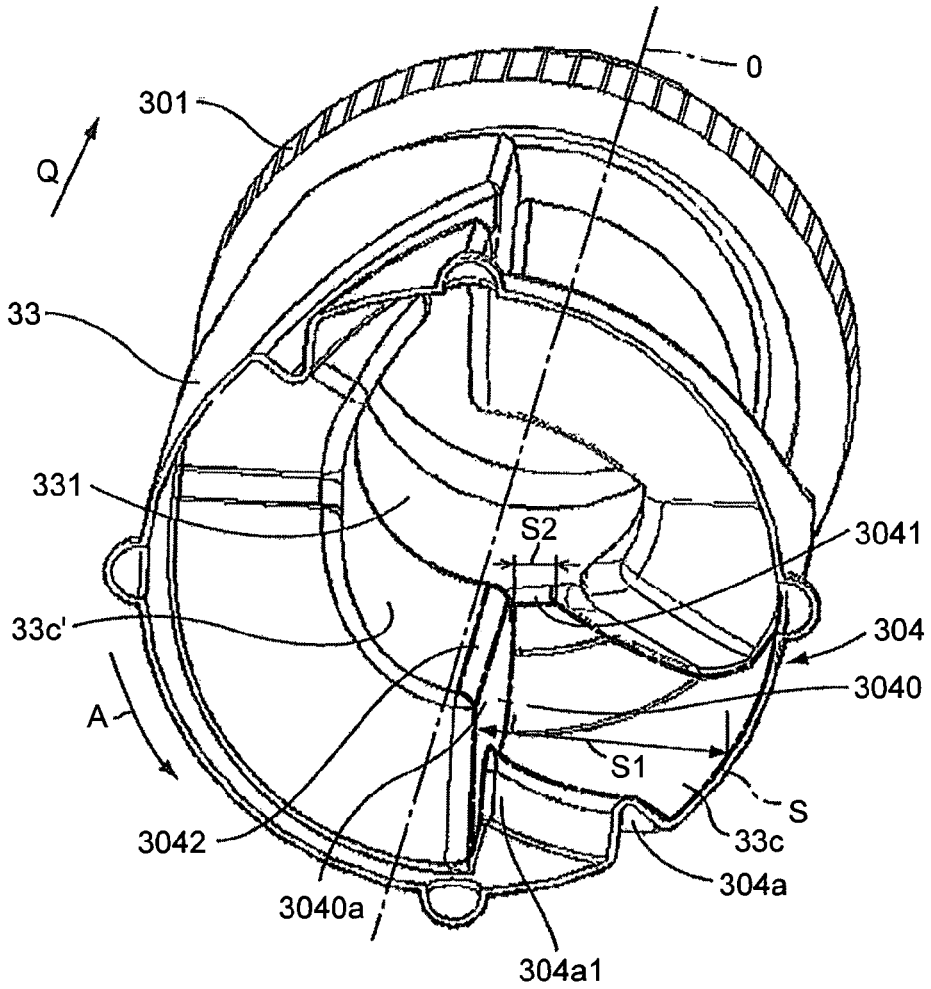
FIG. 25 is an enlarged perspective view for explaining a shape of a space in the scooping portion.

In the second embodiment, as illustrated in FIG. 25, the space S has a shape that is narrowed toward the receiving opening 331 serving as an opening. Namely, a width S2 of the wall 3041, as a container front wall, near the receiving opening 331 in the space S is smaller than a width S1 on the side distant from the receiving opening 331. The widths S1 and S2 described herein correspond to a direction perpendicular to the rotation axis O and the scooping surface 3040.

In this manner, when the space S has a shape that is narrowed at the wall 3041 located on the receiving opening 331 side, it is possible to adjust the amount of toner that flows from the scooping surface 3040 to the receiving opening 331 through the wall 3041 by adjusting the width S2 of the wall 3041. Therefore, it is possible to supply a stable amount of toner to the nozzle hole 610.

Figure 26A:
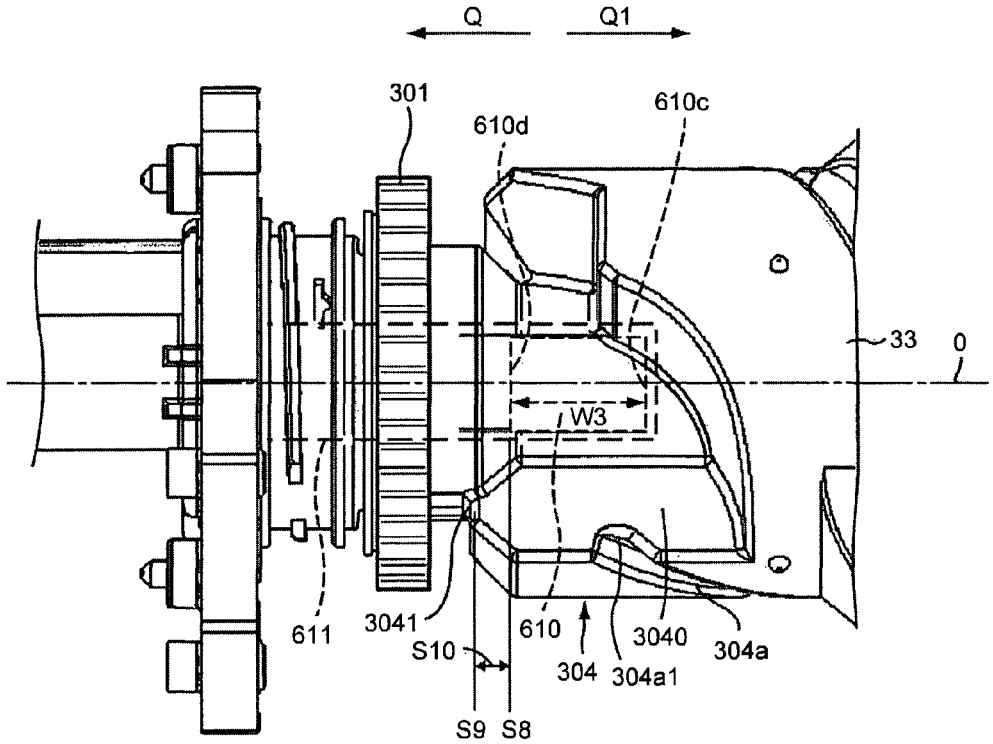
FIGS. 26A and 26B are enlarged views for explaining a positional relationship between a wall located near the powder receiving hole provided on the scooping portion and the powder receiving hole.

As illustrated in FIG. 26A, if a position S9 of the wall 3041 is located on the downstream in the attachment direction Q relative to a position S8 of the end portion 610*d* of the nozzle hole 610, toner that has passed through the wall 3041 is conveyed to a region ahead of the nozzle hole 610 in the attachment direction Q. A region S10 between the position S8 and the position S9 is deviated from the nozzle hole 610 in the rotation axis direction, and therefore, may cause toner to remain as remaining toner that may not be supplied to the nozzle hole 610.

Figure 26B:
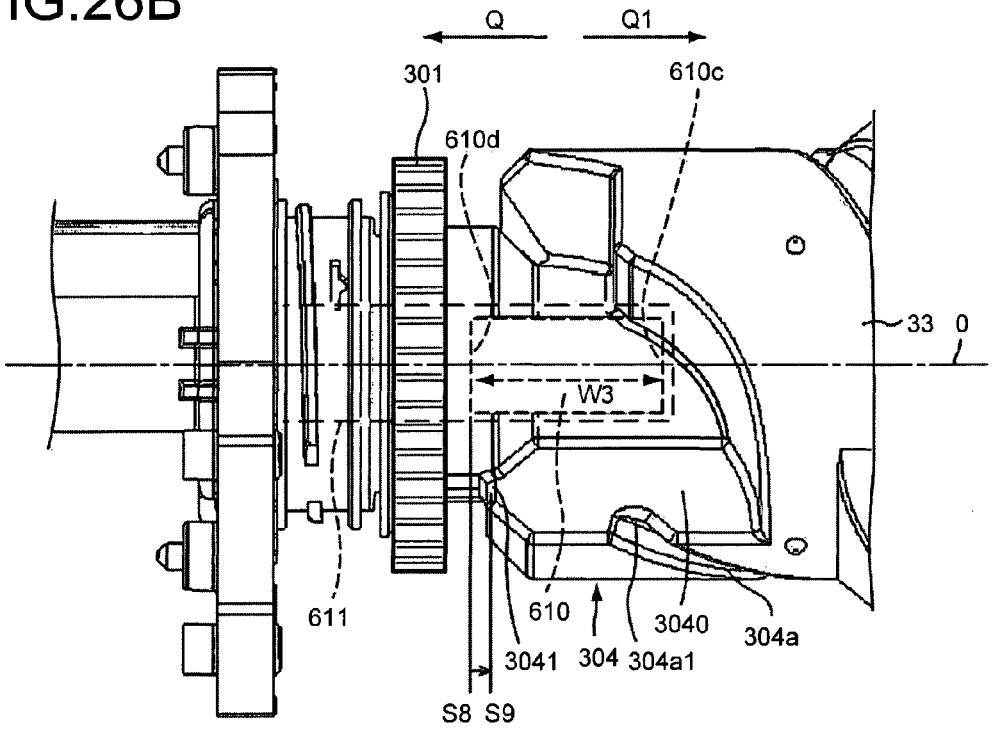

Therefore, as illustrated in FIG. 26B, the wall 3041 is provided so as to be located inside the opening range W3 in the axial direction of the nozzle hole 610 when the conveying nozzle 611 is inserted in the receiving opening 331. Namely, the position S9 of the wall 3041 is located on the downstream in the detachment direction Q1 relative to the position S8 of the end portion 610*d* of the nozzle hole 610. By defining the position of the wall 3041 serving as a toner supplying portion as described above, it is possible to reliably supply the toner T on the scooping surface 3040 to the nozzle hole 610 through the wall 3041.

Figure 27A:
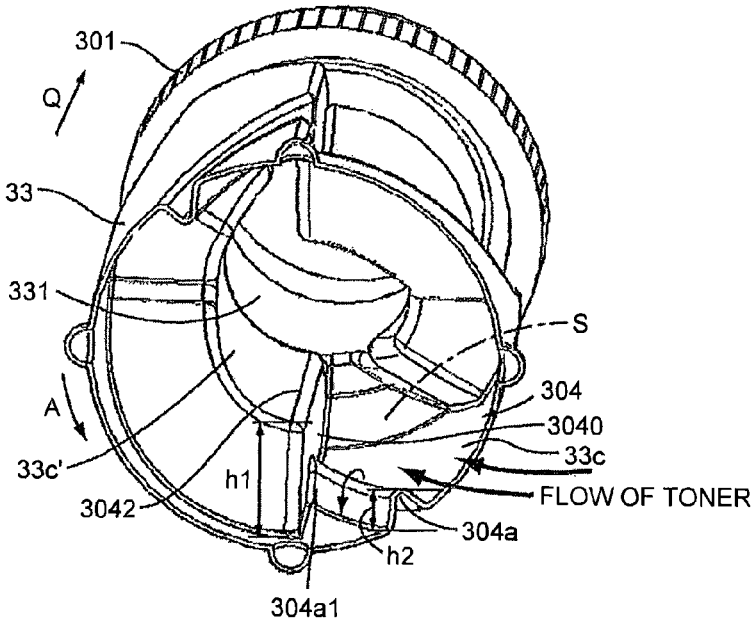
FIGS. 27A to 27C are diagrams for explaining a relationship and actions between the conveying portion located inside the scooping portion and the scooping surface.
Figure 27B:
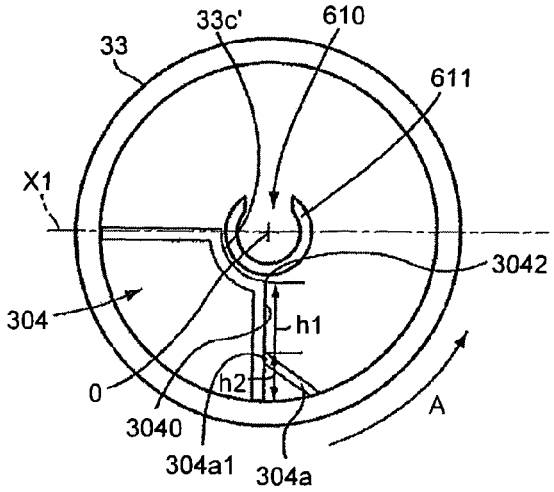
Figure 27C:
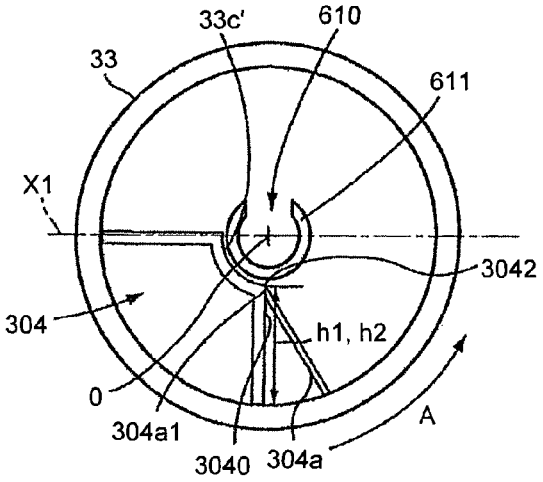

As illustrated in FIGS. 27A and 27B, if a protrusion amount h2, as a height of the spiral rib 304*a* at the scooping portion, that protrudes from the inner wall surface 33*c* toward the rotation axis O is smaller than a height h1 from the inner wall surface 33*c* to the scooping surface 3040 (the edge (side) 3042 of the inner end portion), toner collected by the spiral rib 304*a* at the scooping portion may pass over the protrusion of the spiral rib 304*a* at the scooping portion when the container body 33 rotates. The toner that has passed over the spiral rib 304*a* at the scooping portion may move to a region that does not contribute to toner conveying, and it may be difficult to guide the toner to the receiving opening 331. Therefore, as illustrated in FIG. 27C, it is preferable that the protrusion amount (height) h2 of the spiral rib 304*a* at the scooping portion is equal to the height h1 of the scooping surface 3040. With this configuration, toner is prevented from entering the back side (the region that does not contribute to toner conveying) of the spiral rib 304*a* at the scooping portion while the toner is being scooped up by the scooping surface 3040. Therefore, it is possible to more efficiently supply toner to the nozzle hole 610.

Figure 28:
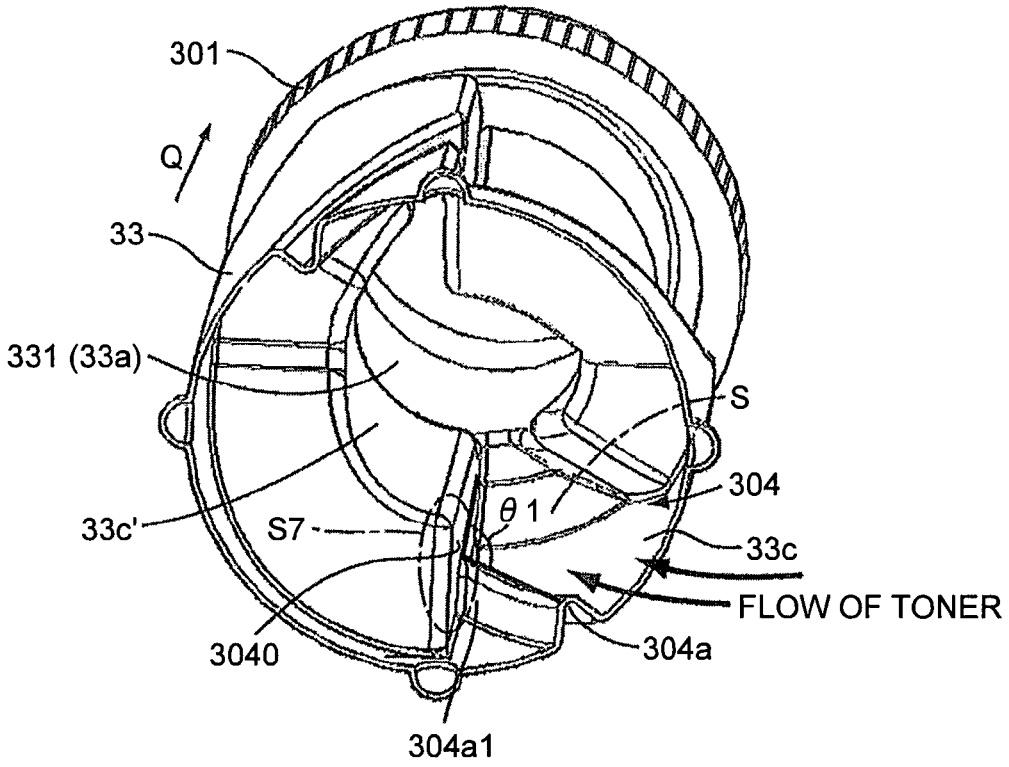
FIG. 28 is an enlarged perspective view for explaining an angle defined by the conveying portion and the scooping surface.

As illustrated in FIG. 28, an angle θ1 between the spiral rib 304*a* at the scooping portion and the scooping surface 3040 may be set to be equal to or greater than a repose angle of the toner T. In this example, the inclined angle of the scooping surface 3040 at the connection portion S7 is set to the angle θ1. By setting the angle θ1 as described above, toner is less likely to accumulate on the spiral rib 304*a* at the scooping portion. Therefore, it is possible to efficiently convey toner to the scooping surface 3040. Consequently, it is possible to more efficiently supply toner on the scooping surface 3040 to the nozzle hole 610.

Third Embodiment

Figure 29A:
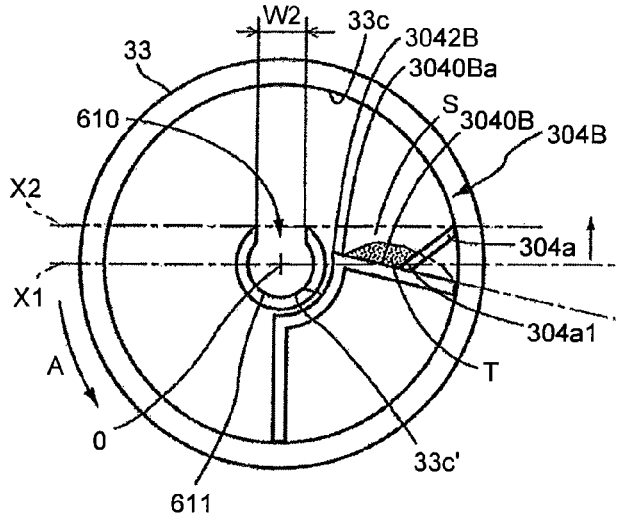
FIGS. 29A to 29C are operation diagrams for schematically illustrating a change with rotation of a scooping portion according to a third embodiment of the present invention.
Figure 29B:
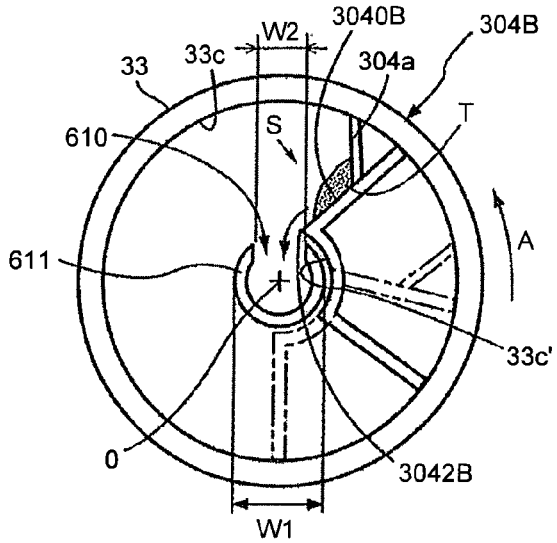
Figure 29C:
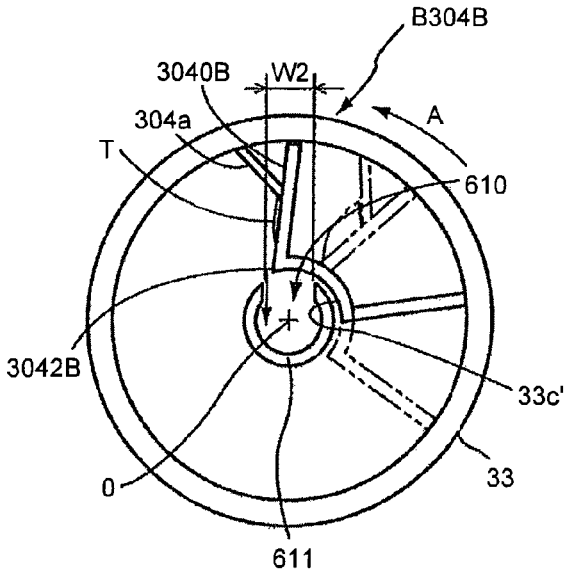

As illustrated in FIGS. 29A to 29C, in a third embodiment, a scooping portion 304B provided on the receiving opening 331 (the container opening 33*a*) side of the container body 33 scoops up the toner T conveyed to the receiving opening 331 along with rotation of the container body 33 in the rotation direction A, and supplies the toner T to the nozzle hole 610.

The scooping portion 304B includes a scooping surface 3040B that extends from the inner wall surface 33*c* of the container body 33 toward the rotation axis O of the container body (however, an extended line of the scooping surface 3040B does not pass through the rotation axis O). An inner end portion 3040Ba of the scooping surface 3040B on the nozzle hole 610 side extends in a direction approximately parallel to the rotation axis O, and has an edge (side) 3042B. The edge (side) 3042B of the inner end portion 3040Ba is approximately parallel to the rotation axis O such that, when rotating from the position illustrated in FIG. 29A to the position illustrated in FIG. 29C upon attachment to the toner replenishing device 60, the edge (side) 3042B is located inside the cross-sectional range W1 of the conveying nozzle 611, and more preferably, inside the opening range W2 of the nozzle hole 610, above the nozzle hole 610. In the third embodiment, in contrast with the configuration of the second embodiment, the scooping surface 3040B is inclined such that the scooping surface 3040B on the side near the inner wall surface 33*c* is lower than the edge (side) 3042B of the inner end portion 3040Ba.

In the third embodiment, a range in which the edge (side) 3042B of the inner end portion extends in the rotation axis direction overlaps with at least a part of the nozzle hole 610 in the rotation axis direction when the container body 33 is attached to the toner replenishing device 60. As illustrated in FIG. 29A, the scooping surface 3040B is located above the virtual line X1, which extends in the horizontal direction while passing through the rotation axis O, in the horizontal state. In the third embodiment, the center of the nozzle hole 610 is arranged so as to coincide with the center of the rotation axis O. Therefore, the virtual line X1 crosses the nozzle hole 610 in the horizontal direction. The virtual line X2 serving as an extended line of the upper surface of the nozzle hole 610 is a plane approximately parallel to the virtual line X1. Namely, in the third embodiment, as illustrated in FIG. 29A, the scooping surface 3040B including the edge (side) 3042B of the inner end portion is located below the upper surface of the nozzle hole 610.

There is a space S in a region facing the scooping surface 3040B in the scooping portion 304B. The space S is surrounded by the scooping surface 3040B and the inner wall surface 33*c* of the container body 33. The spiral rib 304*a* at the scooping portion, which serves as a conveying portion, is used for conveying toner toward the receiving opening 331 (container front end) in the scooping portion including the space S. The first end 304*a*1 of the spiral rib at the scooping portion is connected to the scooping surface 3040B. On the scooping portion 304B, the wall 3041 (container front wall, see FIGS. 13 and 14) connected to the scooping surface 3040B and the receiving opening 331 is provided in a region of the container front end of the space S. The toner T on the scooping surface 3040B is supplied from the space S toward the receiving opening 331, that is, the nozzle hole 610, through the wall 3041.

In this manner, the scooping surface 3040B and the edge (side) 3042B of the scooping portion 304B arranged on the container body 33 are located inside the opening range W2 in the rotation direction of the nozzle hole 610, above the nozzle hole 610, as illustrated in FIG. 29B. Therefore, when the scooping surface 3040B is inclined along with rotation of the container body 33, and even if toner with high fluidity slips down along the scooping surface 3040B at an early timing, it is possible to supply the toner to the nozzle hole 610. Consequently, it is possible to efficiently supply the toner T to the nozzle hole 610 of the conveying nozzle 611 inserted in the container body 33.

Further, the scooping surface 3040B is located above the virtual line X1 when the scooping surface 3040B faces upward as illustrated in FIG. 29A. Therefore, even when the scooping surface 3040B is oriented perpendicular to the rotation axis O because of rotation of the container body 33 as illustrated in FIG. 29C, the scooping surface 3040B is located inside the opening range W2. Therefore, even if toner with low fluidity remains on the scooping surface 3040B, it is possible to supply the toner to the nozzle hole 610. Consequently, it is possible to efficiently supply the toner T to the nozzle hole 610 of the conveying nozzle 611 inserted in the container body 33, and reduce remaining toner in the container body 33.

When the spiral rib 304*a* at the scooping portion is not provided, and if the rotation speed of the container body 33 is fast, the container body 33 may cause the toner T scooped up to the container outer peripheral side of the scooping surface 3040B (on the inner wall surface 33*c* side distant from the rotation axis O) to pass by the nozzle hole 610 before the toner T slips down to the edge (side) 3042B side of the inner end portion of the scooping surface 3040B.

However, in the third embodiment, toner is conveyed to the space S facing the scooping surface 3040B by the spiral rib 304*a* at the scooping portion; therefore, even when rotation fluctuation of the container body 33 occurs or the fluidity of toner changes, it is possible to supply a sufficient amount of toner onto the scooping surface 3040B. Consequently, it is possible to stably and efficiently supply the toner T to the nozzle hole 610.

Fourth Embodiment

Figure 30A:
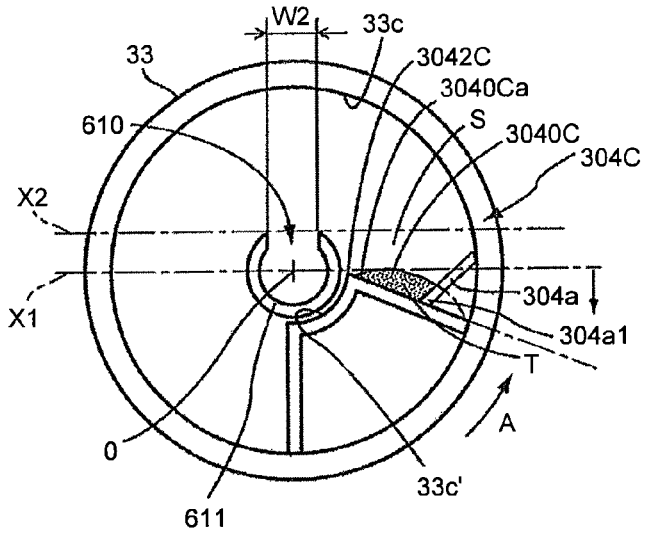
FIGS. 30A to 30C are operation diagrams for schematically illustrating a change with rotation of a scooping portion according to a fourth embodiment of the present invention.
Figure 30B:
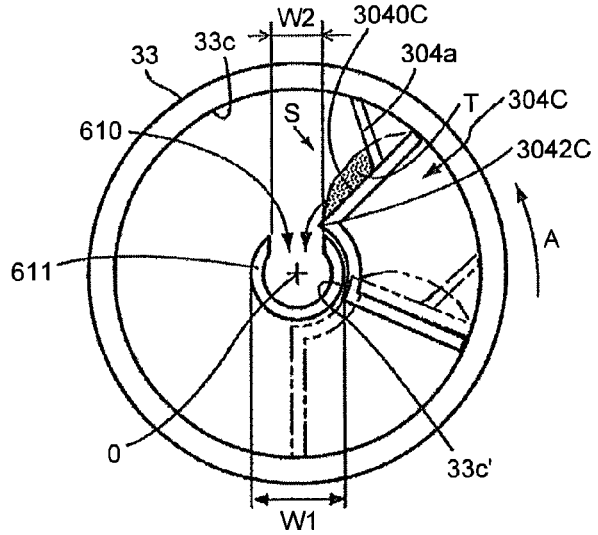
Figure 30C:
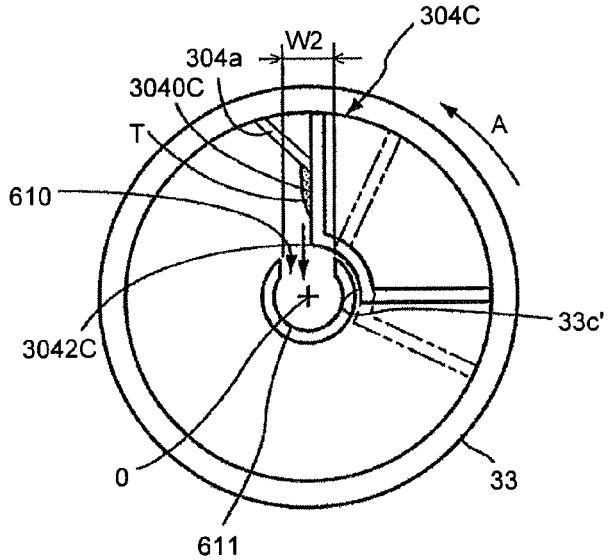

As illustrated in FIGS. 30A to 30C, in a fourth embodiment, a scooping portion 304C provided on the receiving opening 331 (the container opening 33*a*) side of the container body 33 scoops up the toner T conveyed to the receiving opening 331 along with rotation of the container body 33 in the rotation direction A, and supplies the toner T to the nozzle hole 610.

The scooping portion 304C includes a scooping surface 3040C that extends from the inner wall surface 33*c* of the container body 33 toward the rotation axis O of the container body (however, an extended line of the scooping surface 3040C does not pass through the rotation axis O). An inner end portion 3040Ca of the scooping surface 3040C on the nozzle hole 610 side extends in a direction approximately parallel to the rotation axis O, and has an edge (side) 3042C. The edge (side) 3042C is approximately parallel to the rotation axis O such that, when rotating from the position illustrated in FIG. 30A to the position illustrated in FIG. 30C upon attachment to the toner replenishing device 60, the edge (side) 3042C is located inside the cross-sectional range W1 of the conveying nozzle 611, and more preferably, inside the opening range W2 of the nozzle hole 610, above the nozzle hole 610. In the forth embodiment, the scooping surface 3040C is inclined such that the scooping surface 3040C on the side near the inner wall surface 33*c* is lower than the edge (side) 3042C of the inner end portion 3040Ca.

In the fourth embodiment, a range in which the edge (side) 3042C of the inner end portion extends in the rotation axis direction overlaps with at least a part of the nozzle hole 610 in the rotation axis direction when the container body 33 is attached to the toner replenishing device 60. As illustrated in FIG. 30A, the scooping surface 3040C is located below the virtual line X1, which extends in the horizontal direction while passing through the rotation axis O, in the horizontal state. In the fourth embodiment, the center of the nozzle hole 610 is arranged so as to coincide with the center of the rotation axis O. Therefore, the virtual line X1 crosses the nozzle hole 610 in the horizontal direction. The virtual line X2 serving as an extended line of the upper surface of the nozzle hole 610 is a plane approximately parallel to the virtual line X1. Namely, in the fourth embodiment, as illustrated in FIG. 30A, the scooping surface 3040C including the edge (side) 30420 is located below the upper surface of the nozzle hole 610.

There is a space S in a region facing the scooping surface 3040C in the scooping portion 304C. The space S is surrounded by the scooping surface 3040C and the inner wall surface 33*c* of the container body 33. The spiral rib 304*a* at the scooping portion, which serves as a conveying portion, is used for conveying toner toward the receiving opening 331 (container front end) in the space S. The first end 304*a*1 of the spiral rib at the scooping portion is connected to the scooping surface 3040C. On the scooping portion 304C, the wall 3041 (container front wall, see FIGS. 13 and 14) connected to the scooping surface 3040C and the receiving opening 331 is provided in a region of the container front end of the space S. The toner T on the scooping surface 3040C is supplied from the space S toward the receiving opening 331, that is, the nozzle hole 610, through the wall 3041.

In this manner, in the fourth embodiment, the scooping surface 3040C and the edge (side) 3042C of the inner end portion of the scooping portion 304C arranged on the container body 33 are located inside the opening range W2 in the rotation direction of the nozzle hole 610, above the nozzle hole 610, as illustrated in FIG. 30B. Therefore, when the scooping surface 3040C is inclined along with rotation of the container body 33, and even if toner with high fluidity slips down along the scooping surface 3040C at an early timing, it is possible to supply the toner to the nozzle hole 610. Consequently, it is possible to efficiently supply the toner T to the nozzle hole 610 of the conveying nozzle 611 inserted in the container body 33.

Further, the scooping surfaces 3040C is located below the virtual line X1 when the scooping surfaces 3040C faces upward as illustrated in FIG. 30A. Therefore, even when the scooping surface 3040C is oriented perpendicular to the rotation axis O because of rotation of the container body 33 as illustrated in FIG. 30C, the scooping surface 3040C is located inside the opening range W2. Therefore, even if toner with low fluidity remains on the scooping surface 3040C, it is possible to supply the toner to the nozzle hole 610. Consequently, it is possible to efficiently supply the toner T to the nozzle hole 610 of the conveying nozzle 611 inserted in the container body 33, and reduce remaining toner in the container body 33.

When the spiral rib 304*a* at the scooping portion is not provided, and if the rotation speed of the container body 33 is fast, the container body 33 may cause the toner T scooped up to the container outer peripheral side of the scooping surface 3040C (on the inner wall surface 33*c* side distant from the rotation axis O) to pass by the nozzle hole 610 before the toner T slips down to the edge (side) 3042C side of the inner end portion of the scooping surface 3040C.

However, in the fourth embodiment, toner is conveyed to the space S facing the scooping surface 3040C by the spiral rib 304*a* at the scooping portion; therefore, even when rotation fluctuation of the container body 33 occurs or the fluidity of toner changes, it is possible to supply a sufficient amount of toner onto the scooping surface 3040C. Consequently, it is possible to stably and efficiently supply the toner T to the nozzle hole 610.

Figure 31A:
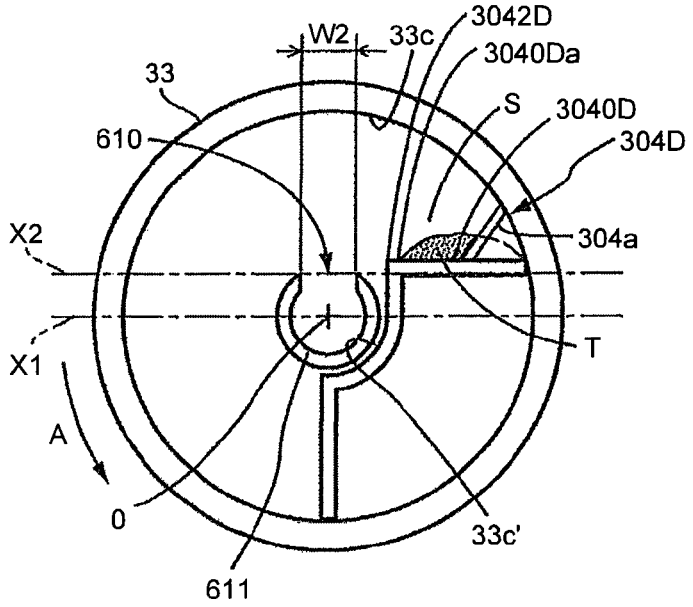
FIGS. 31A and 31B are operation diagrams for schematically illustrating a configuration according to a modification of the present invention and a change with rotation of a scooping portion.

Each of the scooping surfaces 3040 to 3040C as described above has a configuration such that each of the edges (side) 3042 to 3042C is located below the virtual line X2 serving as the extend line of the upper surface of the nozzle hole 610; however, the present invention is not limited to these embodiments. For example, as illustrated in FIG. 31A, a scooping surface 3040D has a configuration such that an edge (side) 3042D is located above the virtual line X1 and the virtual line X2 serving as the extended line of the upper surface of the nozzle hole 610.

Figure 31B:
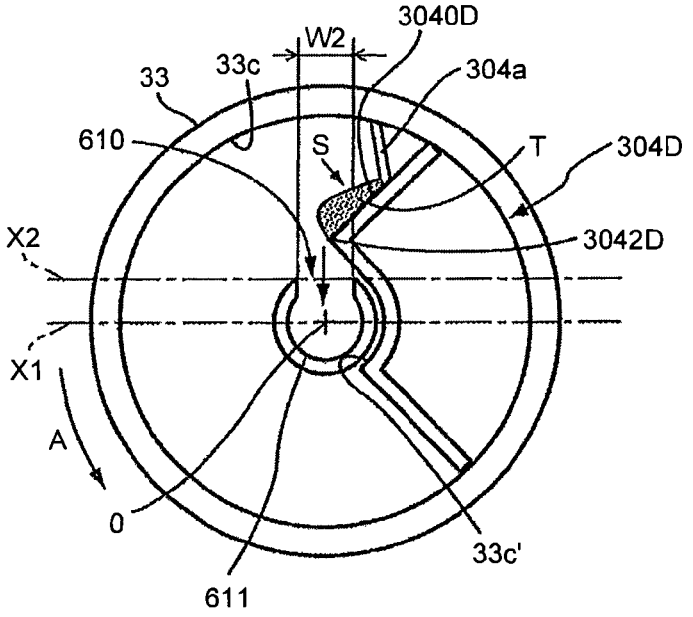

In this configuration, as illustrated in FIG. 31B, the scooping surface 3040D and the edge (side) 3042D of the inner end portion of the scooping portion 304D arranged on the container body 33 are located inside the opening range W2 in the rotation direction of the nozzle hole 610, above the nozzle hole 610. Therefore, when the scooping surface 3040D is inclined along with rotation of the container body 33, and even if toner with high fluidity slips down along the scooping surface 3040D at an early timing, it is possible to supply the toner to the nozzle hole 610. Consequently, it is possible to efficiently supply the toner T to the nozzle hole 610 of the conveying nozzle 611 inserted in the container body 33.

Even in the third and the fourth embodiments, similarly to the first embodiment illustrated in FIG. 25, the space S has a shape that is narrowed toward the receiving opening 331 serving as an opening, and the width S2 of the wall 3041 near the receiving opening 331 in the space S is set to be smaller than the width S1 on the side distant from the receiving opening 331.

In this manner, when the space S has a shape that is narrowed at the wall 3041 located on the receiving opening 331 side, it is possible to adjust the amount of toner that flows from each of the scooping surfaces 3040 to 3040D to the receiving opening 331 through the wall 3041 by adjusting the width S2 of the wall 3041. Therefore, it is possible to supply a stable amount of toner to the nozzle hole 610.

In the third and the fourth embodiments, similarly to the first embodiment illustrated in FIG. 26A, if the position S9 of the wall 3041 is located on the downstream in the attachment direction Q relative to the position S8 of the end portion 610*d* of the nozzle hole 610, toner that has passed by the wall 3041 is conveyed to a region ahead of the nozzle hole 610 in the attachment direction Q. The region S10 between the position S8 and the position S9 is deviated from the nozzle hole 610 in the rotation axis direction, and therefore, may cause toner to remain as remaining toner that may not be supplied to the nozzle hole 610.

Therefore, similarly to the first embodiment as illustrated in FIG. 26B, the wall 3041 is located inside the opening range W1 in the axial direction of the nozzle hole 610 when the conveying nozzle 611 is inserted in the receiving opening 331. Namely, the position S9 of the wall 3041 is located on the downstream in the detachment direction Q1 relative to the position S8 of the end portion 610*d* of the nozzle hole 610. By defining the position of the wall 3041 serving as a toner supplying portion as described above, it is possible to reliably supply the toner T on each of the scooping surfaces 3040 to 3040D to the nozzle hole 610 through the wall 3041.

In the third and the fourth embodiments, similarly to the first embodiment as illustrated in FIGS. 27A and 27B, if the protrusion amount h2, as the height of the spiral rib 304*a* at the scooping portion, that protrudes from the inner wall surface 33*c* toward the rotation axis O is smaller than the height h1 from the inner wall surface 33*c* to each of the scooping surfaces 3040 to 3040D (the edges (sides) 3042 to 3042D), toner collected by the spiral rib 304*a* at the scooping portion may pass over the protrusion of the spiral rib 304*a* at the scooping portion when the container body 33 rotates. The toner that has passed over the spiral rib 304*a* at the scooping portion may move to a region that does not contribute to toner conveying, and it is difficult to guide the toner to the receiving opening 331. Hereinafter, similarly to the first embodiment as illustrated in FIG. 27C, if the protrusion amount (height) h2 of the spiral rib 304*a* at the scooping portion is equal to the height h1 of each of the scooping surfaces 3040 to 3040D, toner is prevented from entering the back side (the region that does not contribute to toner conveying) of the spiral rib 304*a* at the scooping portion while the toner is being scooped up by each of the scooping surfaces 3040 to 3040D. Therefore, it is possible to more efficiently supply toner to the nozzle hole 610.

In the third and the fourth embodiments, similarly to the first embodiment as illustrated in FIG. 28, the angle θ1 defined by the spiral rib 304*a* at the scooping portion and each of the scooping surfaces 3040 to 3040D may be set to be equal to or greater than a repose angle of the toner T. In this example, the inclined angle of each of the scooping surfaces 3040 to 3040D at the connection portion S7 is set to the angle θ1. By setting the angle θ1 as described above, toner is less likely to accumulate on the spiral rib 304*a* at the scooping portion. Therefore, it is possible to efficiently convey toner to each of the scooping surfaces 3040 to 3040D. Consequently, it is possible to more efficiently supply toner on each of the scooping surfaces 3040 to 3040D to the nozzle hole 610.

As illustrated in FIG. 32, the scooping portions 304 to 304D may be provided at positions near the receiving opening 331 (the container opening 33*a*) in the rotation axis direction relative to a position S3 of the second end 304*a*2 of the spiral rib 304*a* at the scooping portion on the side distant from the receiving opening 331. In this configuration, toner conveyed from the second end 304*a*2 of the spiral rib 304*a* at the scooping portion on the side distant from the opening is scooped up by each of the scooping portions on the upstream side (front side) in the toner conveying direction relative to the receiving opening 331. This configuration is preferable because it is possible to efficiently supply toner on the scooping surfaces 3040 to 3040D to the nozzle hole 610.

In the above described embodiments, it is explained that the scooping portions 304, 304B, and 304D are located above the virtual line X1, and the scooping portion 304C is located below the virtual line X1. However, with the assumption that each of the sides or each of the scooping surfaces is located in the opening range W2 when the receiving opening 331 rotates along with rotation of the container body 33, the scooping portions may be located in the same position as the virtual line X1 in the rotation direction A, that is, in the same plane.

In the first embodiment, the inclined angle θ of the scooping surface 3040 in a predetermined range in the rotation direction A is defined as 25±5 degrees, the range of the predetermined rotation frequency (rpm) of the container body 33 is defined as 110±15 rpm, and the range of the apparent density (g/cm3) of the toner is defined as 0.41 to 0.48 g/cm3. However, the inclined angle θ in the predetermined range, the predetermined rotation frequency (rpm), and the apparent density (g/cm3) may be applied to the second to the fourth embodiments. In this case, toner does not wastefully spill from each of the scooping surfaces 3040 to 3040D before the toner flows in the nozzle hole 610 of the conveying nozzle 611, and each of the scooping surfaces 3040 to 3040D does not pass above the nozzle hole 610 while holding the toner T. Therefore, each of the scooping surfaces 3040 to 3040D can scoop the toner T up to an appropriate position, so that it is possible to reduce variation in the amount of toner flowing in the nozzle hole 610 even in the conditions in which the fluidity of the toner changes due to the apparent density, an environment, or the like.

Fifth Embodiment

Next, movement of toner in the container body 33 near the container opening 33*a* of the toner container 32 serving as a powder container will be described below.

If the toner bottle 32, in which toner as powder developer is sealed in the container body 33, is maintained in the same posture for a long time, the toner may be cohered. Therefore, in some cases, preliminary operation may be needed to loosen the toner by shaking the bottle up and down or right and left before use. Further, as a way to store the toner container 32, it is normally recommended to place the toner bottle 32 horizontally in the same manner as in the case of attachment to the toner replenishing device 60 (the copier 500). However, for the sake of storage space, the toner bottle 32 may be stored in a standing manner with the container opening 33*a* face down.

Figure 39A:
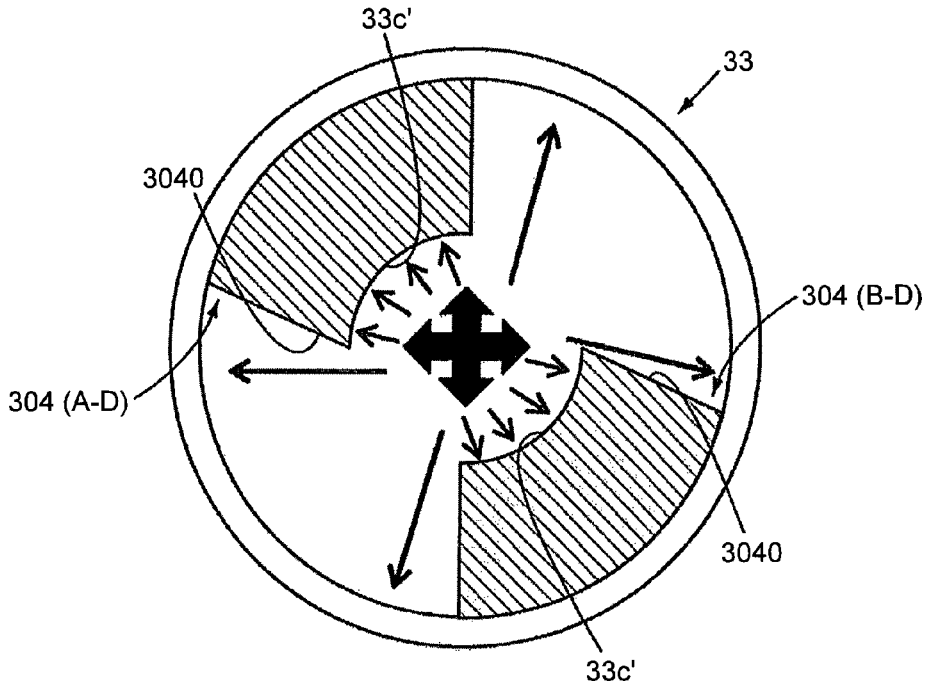
FIG. 39A is a schematic diagram illustrating diffusivity of toner when an internal space of the container body is small.

In this case, when the present inventors shook the toner bottle 32 of the first to the fourth embodiments up and down or right and left a certain number of times that is determined as the number of reciprocations based on the horizontal storage state, and thereafter attached the toner bottle 32 to the toner replenishing device 60 (the copier 500), it was sometimes difficult to fully insert the conveying nozzle 611 in the container opening 33*a*. The inventors have traced the source of the problem and found that, because the portion 33*c*' protruding toward rotation axis O of the container body 33 connected to the edge 3042 (3042B to 3042D) of the scooping surface 3040 (3040B to 3040D) protrudes in the form of a concave surface toward the inside of the container as illustrated in FIG. 39A, even when the toner bottle 32 is shaken in the preliminary operation, a force is distributed at the concave surface and a space for the toner to escape in the container is limited; therefore, it is difficult to fully loosen the toner (it is difficult to cause a loosening force to act on the toner). It can be said that the portion 33*c*' includes a circular-arc-shaped concave surface along the rotation direction in the cross-section perpendicular to the rotation axis.

Therefore, in a fifth embodiment, the shape of the portion 33*c*' of the container body 33, which protrudes in the form of a concave surface toward the inside of the container, that is, the shape of the scooping portion, is changed to a convex shape such that the force is concentrated with the aid of the convex shape and the space for the toner to escape in the container is increased so that the space for the toner to escape is not limited.

With reference to FIGS. 33A to 39B, a configuration of the toner container according to the fifth embodiment will be described below. A difference from the first to the fourth embodiments is in that a configuration of a powder scooping portion 304E provided on the container body 33 differs from that of the scooping portion 304 (304B to 304D) of the other embodiments, but the basic configuration is the same as those of the above described embodiments. Therefore, the configuration of the scooping portion 304E according to the fifth embodiment will be mainly described.

Figure 33A:
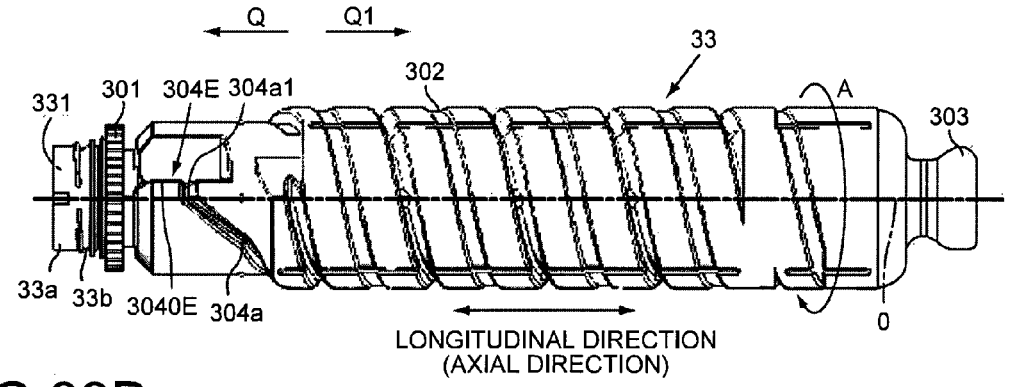
FIG. 33A is a plan view illustrating a configuration of a container body according to a fifth embodiment of the present invention.
Figure 33B:
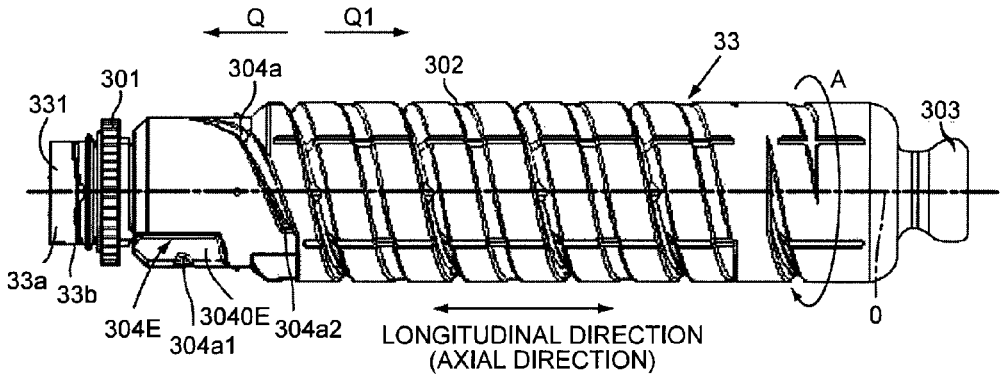
FIG. 33B is a side view illustrating the configuration of the container body according to the fifth embodiment of the present invention.
Figure 34:
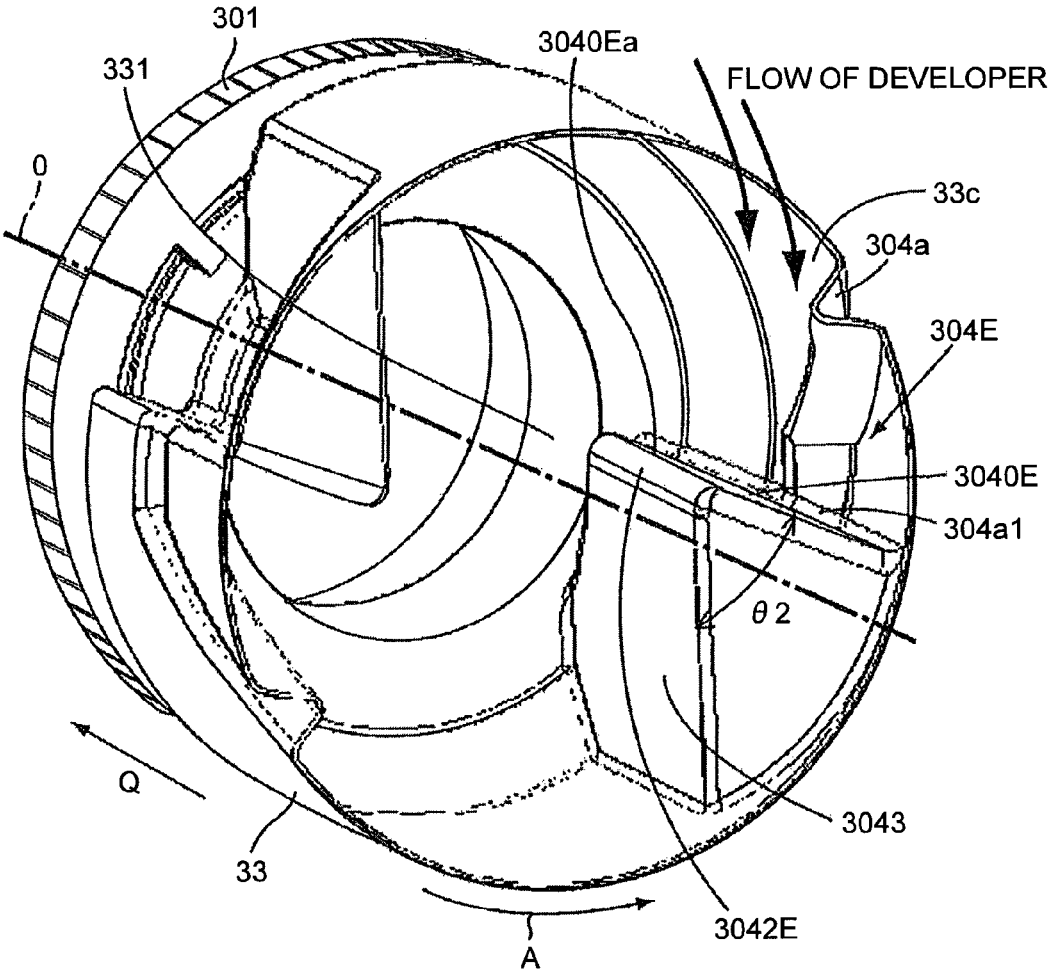
FIG. 34 is an enlarged perspective view for explaining a configuration of an opening side of the container body according to the fifth embodiment of the present invention.
Figure 35:
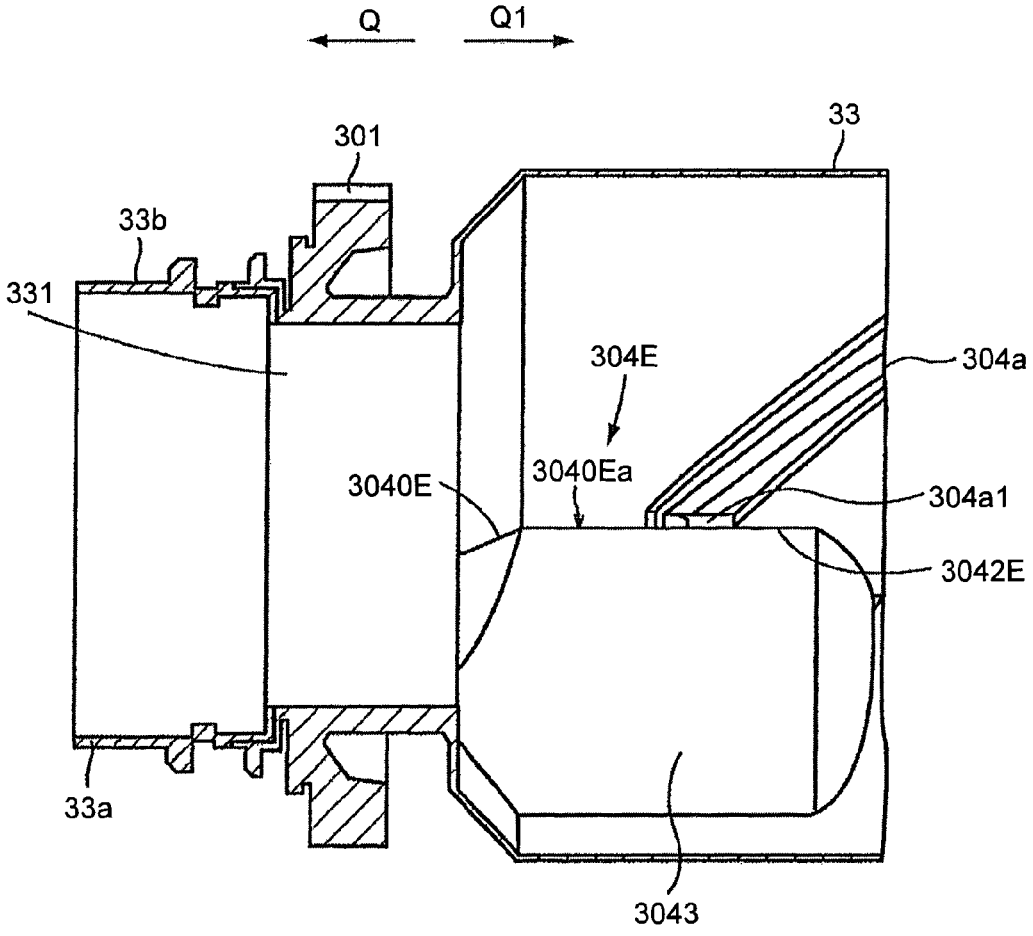
FIG. 35 is an enlarged cross-sectional view for explaining the configuration of the opening side of the container body according to the fifth embodiment of the present invention.
Figure 36:
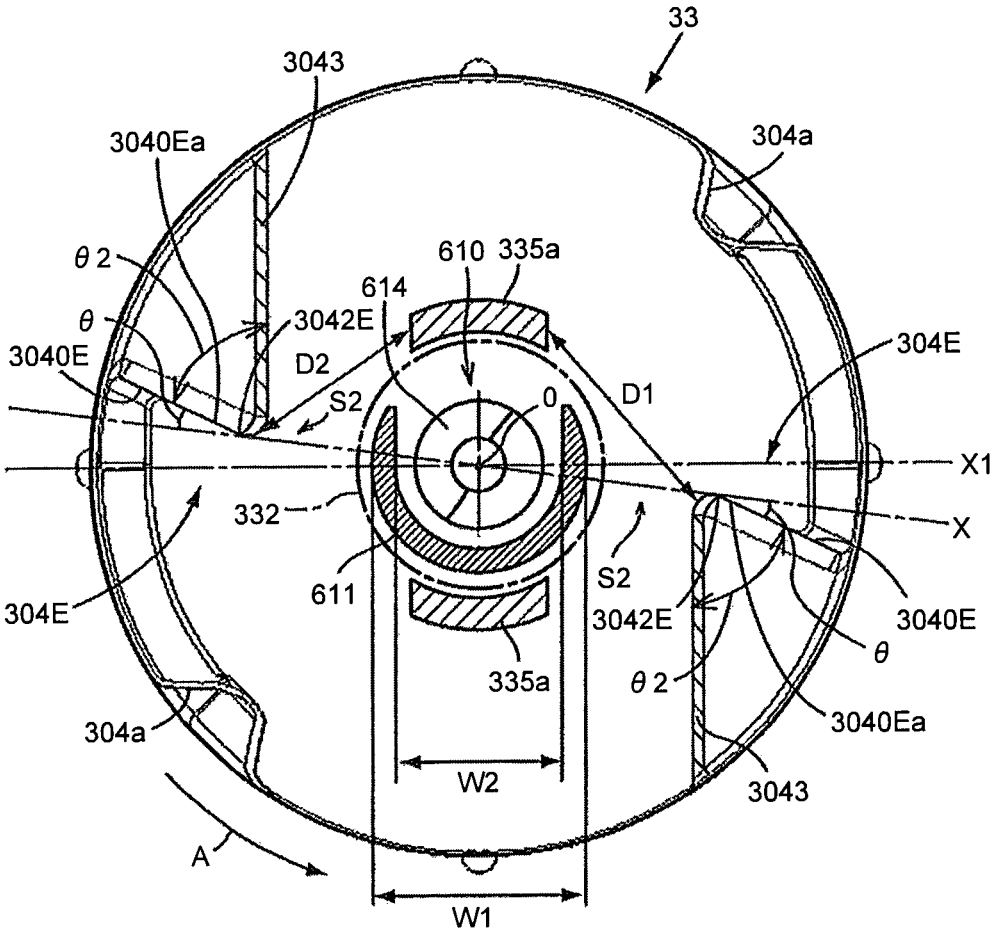
FIG. 36 is an enlarged view for explaining a configuration of a scooping surface of a scooping portion according to the fifth embodiment of the present invention.
Figure 37A:
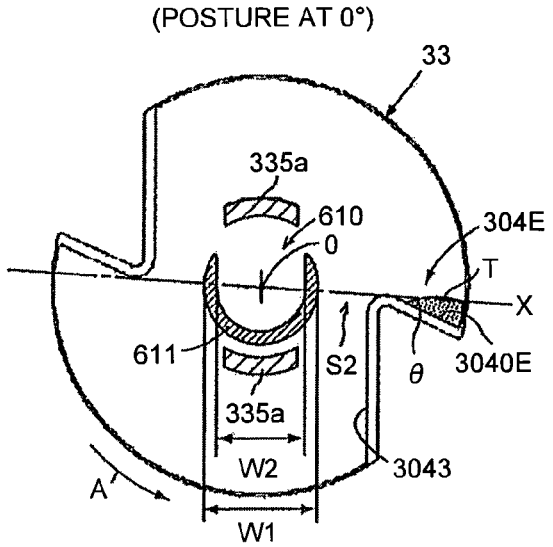
FIGS. 37A to 37C are operation diagrams for schematically explaining a change of the scooping portion with rotation according to the fifth embodiment of the present invention.
Figure 37B:
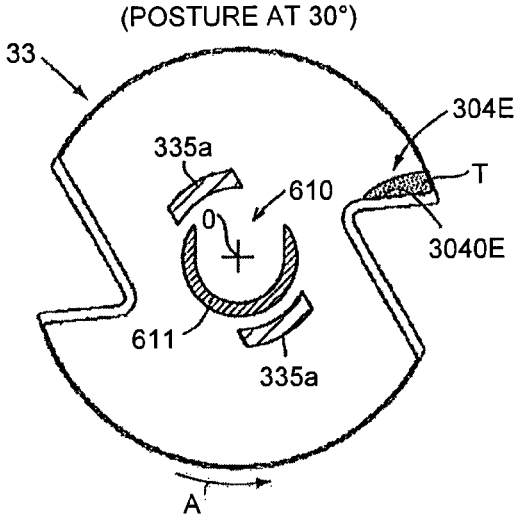
Figure 37C:
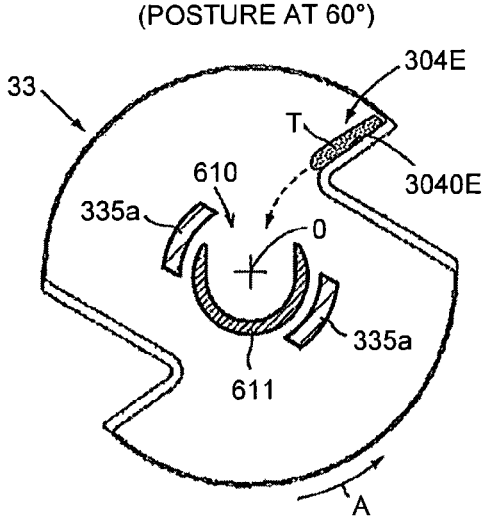
Figure 38A:
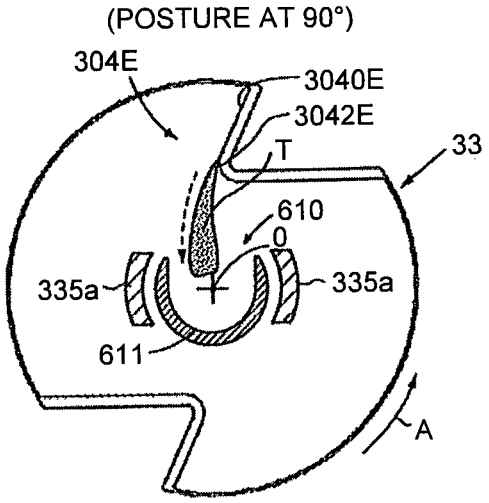
FIGS. 38A to 38C are operation diagrams for schematically explaining a change the scooping portion with rotation of continued from FIG. 37C.
Figure 38B:
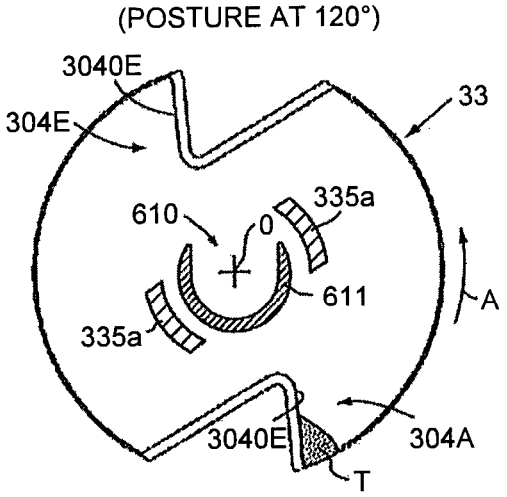
Figure 38C:
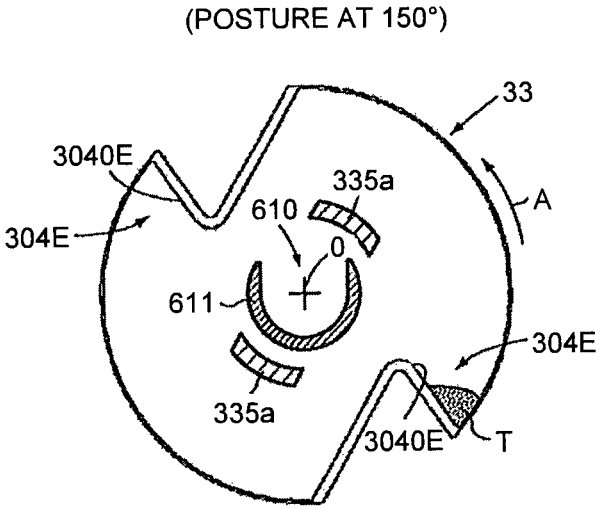
Figure 39B:
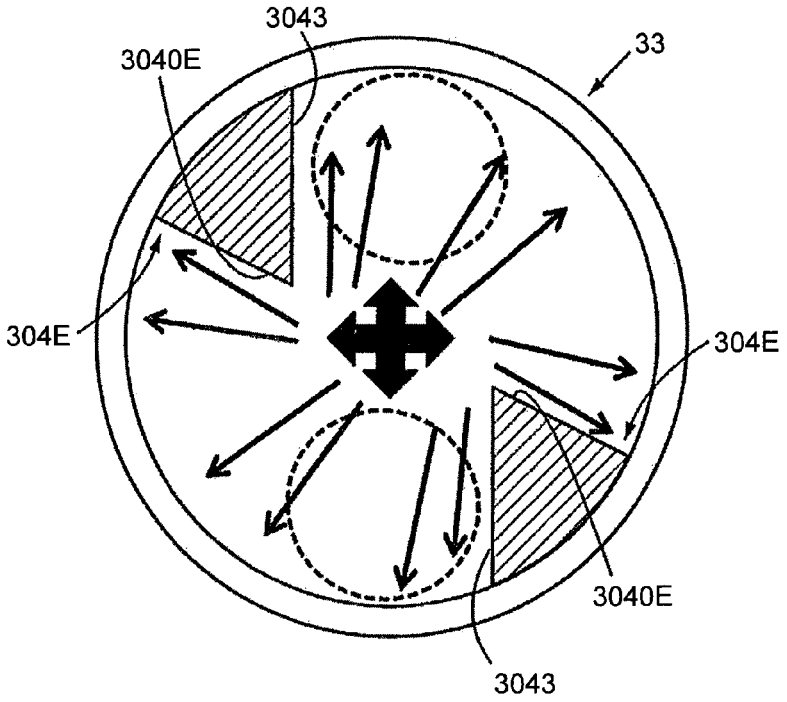
FIG. 39B is a schematic diagram illustrating diffusivity of toner when the internal space of the container body according to the fifth embodiment is, increased.

FIG. 33A is a plan view illustrating a configuration of the container body 33 including the scooping portion 304E. FIG. 33B is a side view illustrating the configuration of the container body 33 including the scooping portion 304E. FIG. 34 is an enlarged perspective view for explaining a configuration of an opening side of the container body. FIG. 35 is an enlarged cross-sectional view for explaining the configuration of the opening side of the container body. FIG. 36 is an enlarged view for explaining a configuration of a scooping surface 3040E of the scooping portion 304E, when viewed from the container rear end to the container front end. FIGS. 37A to 37C are operation diagrams for schematically explaining a change of the scooping portion 304E with rotation. FIGS. 38A to 38C are operation diagrams for schematically explaining a change of the scooping portion 304E with rotation continued from FIG. 37C. FIGS. 37A to 37C and 38A to 38C are cross-sectional views when viewed from the container rear end to the container front end, similarly to FIG. 36. FIG. 39A is a schematic diagram illustrating diffusivity of toner when an internal space of the container body 33 is small. FIG. 39B is a schematic diagram illustrating diffusivity of toner when the internal space of the container body 33 including the scooping portion 304E according to the fifth embodiment is increased.

In the fifth embodiment, the scooping portion 304E provided on the container opening 33*a* side of the container body 33 scoops up the toner T that is conveyed to the container opening 33*a* along with rotation of the container body 33 in the rotation direction A, and supplies the toner T to the nozzle hole 610 (see FIG. 15). The nozzle receiver 330 is inserted in and attached to the container opening 33*a*; therefore, in the description of the scooping portion 304 below, the container opening 33*a* of the container body 33 is described as the receiving opening 331. Namely, as illustrated in FIGS. 34 and 36, the scooping portion 304E that scoops up toner along with rotation of the container body 33 is provided on the inner wall of the container front end of the container body 33. The scooping portion 304E scoops toner, which has been conveyed by the conveying force of the spiral rib 302, upward by using the scooping surface 3040E along with the rotation of the container body 33. Therefore, the toner can be scooped up so as to be located above the inserted conveying nozzle 611. In the fifth embodiment, the scooping portions 304E are provided at two positions displaced by 180 degrees with respect to the rotation axis O as illustrated in FIG. 36.

Further, as illustrated in FIGS. 34 and 35, the spiral rib 304*a* at the scooping portion is provided on the inner surface of each of the scooping portions 304E, similarly to the spiral rib 302. The spiral rib 304*a* has a spiral shape and serves as a conveying portion to convey internally-located toner to the scooping surface 3040E.

In the fifth embodiment, each of the scooping portions 304E includes the scooping surface 3040E that extends from the inner wall surface 33*c* of the container body 33 toward the rotation axis O (however, an extended line of the scooping surface 3040E does not pass through the rotation axis O).

An inner end portion 3040Ea of each of the scooping surfaces 3040E on the rotation axis O side extends in a direction along the rotation axis direction of the container body 33. Specifically, an edge (side) 3042E closest to the rotation axis O side on the inner end portion 3040Ea of the scooping surface extends approximately parallel to the rotation axis O and constitutes a ridge line along the rotation axis O between the portion 33*c*' protruding toward the rotation axis O of the inner wall surface 33*c* of the container body 33 and the scooping surfaces 3040E. Further, as illustrated in FIG. 36, in the cross-section perpendicular to the rotation axis, the scooping surfaces 3040E are inclined by a certain angle in a predetermined range toward the upstream side in the rotation direction A of the container body 33 with respect to the virtual line X. The virtual line passes through the rotation axis O and is tangent to the edges (side) 3042E of the inner end portions of the scooping surfaces 3040E. Even in the fifth embodiment, the predetermined range of the inclined angle θ is set to 25±5 degrees (25°±5°).

In the fifth embodiment, each of the scooping portions 304E includes the scooping surface 3040E which protrudes from the inner wall surface 33*c* toward the inside of the bottle. The scooping surface 3040E includes the edge (side) 3042E arranged most inner side of the bottle. Each of the scooping portions 304E is shaped so that the scooping surface 3040E and a surface 3043 which is continued from the edge (side) 3042E constitute a triangular protrusion. The edge (side) 3042E is an apex of the mountain shape of the triangular protrusion in the cross-section perpendicular to the rotation axis O. The triangular protrusion within the powder storage extends along a length of the powder storage. And an angle between the scooping surface 3040E and the surface 3043 is set in θ2. θ2 is an acute angle.

In blow molding of the container body 33, it is difficult to protrude only the scooping surface 3040E in the form of a plate from the inner wall surface 33*c* in the scooping portion 304E. Therefore, the scooping portion 304E is configured to have the approximately acute angle θ2 at the edge 3042E serving as an apex in the cross section perpendicular to the rotation axis (FIG. 36). This makes it possible to easily provide the container body 33 by blow molding, and ensure the internal space as indicated by a dotted line in FIG. 39B.

As illustrated in FIGS. 33A, 33B and 34, the first end 304*a*1 of the spiral rib extends so as to be connected to the scooping surface 3040E. In the fifth embodiment, the first end 304*a*1 serving as a terminated portion of the spiral rib at the scooping portion has a shape that stands from the scooping surface 3040E so as to be approximately perpendicular to the scooping surface 3040E. In other words, the first end 304*a*1 serving as the terminated portion of the spiral rib at the scooping portion extends in the circumferential direction, and the scooping surface 3040E extends in the rotation axis direction. Namely, the terminated portion of the spiral rib perpendicularly crosses with the scooping surface 3040E. Thus, a part of the scooping surface 3040E is inwardly recessed by being connected with the terminated portion. Therefore, it is possible to cause a space surrounded by the first end 304*a*1 of the spiral rib at the scooping portion, by the scooping surface 3040E, and by the inner wall surface 33*c* of the toner container 32 to function as a holding portion that can hold a greater amount of toner.

Further, the scooping surface 3040E on the side near the container opening 33*a* of the toner container 32 relative to the first end 304*a*1 serving as the terminated portion of the spiral rib at the scooping portion in the rotation axis direction is located so as to face the nozzle hole 610 when the toner container 32 is attached to the image forming apparatus (the toner replenishing device).

In this configuration, the holding portion constituted by the first end 304*a*1 of the spiral rib and the scooping surface 3040E can face the nozzle hole 610 and hold the toner conveyed by the spiral rib 304*a* at the scooping portion; therefore, the scooping portion 304E can efficiently scoop up the toner and flow the toner into the nozzle hole 610.

Further, the first end 304*a*1 of the spiral rib is approximately perpendicular to the direction in which the nozzle hole 610 extends (the axial direction of the conveying nozzle 611); therefore, it is advantageous in that toner flowing is not disturbed.

Of course, in the fifth embodiment, each of the edges (sides) 3042E of the inner end portions has a configuration such that, when rotating to the position illustrated in FIG. 36 upon attachment to the toner replenishing device 60 and upon rotation of the container body 33 in the rotation direction A, each of the edges (sides) 3042E is located inside the cross-sectional range W1 of the conveying nozzle 611, and more preferably, inside the opening range W2 of the nozzle hole 610 above the nozzle hole 610.

Scooping operation by the scooping portion 304E configured as described above will be described below with reference to FIGS. 37A to 37C and 38A to 38C. FIG. 37A illustrates a state before the container body 33 is attached to the toner replenishing device 60 (the copier 500) and rotated. This state is referred to as a posture at 0 degree. In the posture at 0 degree, a pair of the opposing shutter side supporting portions 335*a* of the nozzle receiver 330 are arranged such that one is located in the upper side of the nozzle hole 610 of the conveying nozzle 611 that is in the upper portion in the figure, and the other is located in the lower side of the nozzle hole 610 of the conveying nozzle 611 so as to be displayed by 180 degrees from the shutter side supporting portion in the upper side. Further, each of the scooping surfaces 3040E is inclined by a predetermined angle θ toward the upstream side in the rotation direction A of the container body 33 with respect to the virtual line X1 that passes through the rotation axis O and that is tangent to the edge 3042E. In this manner, the pair of the opposing shutter side supporting portions 335*a* of the nozzle receiver 330 and the two scooping surfaces 3040E have an arrangement relationship such that their positions in the rotation direction A are approximately perpendicular to each other with respect to the rotation axis O.

More specifically, the shutter side supporting portions 335*a* are arranged at positions so as not to face the edges 3042E of the scooping surfaces, that is, positions deviated from the virtual line X that is tangent to the edges 3042E of the scooping surfaces and passes through the rotation axis O in the rotation direction. In this configuration, it is possible to prevent the shutter side supporting portions 335*a* from interrupting toner falling from the scooping surfaces 3040E to the nozzle hole 610.

Further, more preferably, as illustrated in FIG. 36, if focus is placed on the shutter side supporting portion 335*a* located in the upper side (the downstream side in the rotation direction. A) relative to one of the scooping surfaces 3040E that already holds the toner T, it is preferable that an interval D1 between an upstream end (on the right side in FIG. 36) of the shutter side supporting portion 335*a* in the rotation direction A and the edge 3042E of the one of the scooping surfaces 3040E is greater than an interval D2 between a downstream end (on the left side in FIG. 36) of the shutter side supporting portion 335*a* in the rotation direction A and the edge 3042E of the other one of the scooping surfaces 3040E (on the left side relative to the above described shutter side supporting portion 335*a* in FIG. 36). In the relative arrangement as described above, it becomes possible to easily ensure a toner flowing passage.

Meanwhile, in the posture at 0 degree, the toner T is already held by one of the scooping surfaces 3040E. From this state, when the container body 33 rotates counterclockwise indicated by an arrow A in the figures, the toner T on the scooping surface 3040E is further moved upward while the toner T remains held as illustrated in FIG. 37B. FIG. 37B illustrates a posture at 30 degrees, which is rotated counterclockwise by 30 degrees from the posture at 0 degree. Further, when the container body 33 rotates counterclockwise as indicated by the arrow A in the figures, the pair of the shutter side supporting portions 335*a* of the nozzle receiver 330 integrally rotate, so that the toner T on the scooping surface 3040E is further moved upward while the toner T remains held as illustrated in FIG. 37C. FIG. 37C illustrates a posture at 60 degrees, which is rotated counterclockwise by 60 degrees from the posture at 30 degrees. In this state, the shutter side supporting portions 335*a* further move from the nozzle hole 610, so that the nozzle hole 610 is opened. Further, the scooping surface 3040E is inclined downward with respect to the rotation axis O, so that the toner T on the scooping surface 3040E gradually slides down by gravity and starts to fall in the nozzle hole 610.

As illustrated in FIG. 38A, when the container body 33 rotates from the posture at 60 degrees to the posture at 90 degrees, all of the toner T on the scooping surface 3040E fall by gravity, and are supplied to the nozzle hole 610. Further, in the posture at 90 degrees, the other one of the scooping portions 304E is located in the lower part of the container body 33, and the scooping surface 3040E catches the toner T accumulated in the lower part.

When the container body 33 further rotates from the posture at 90 degrees to the posture at 120 degrees, as illustrated in FIG. 38B, the scooping surface 3040E starts to newly scoop up the toner T accumulated in the lower part, and the other one of the shutter side supporting portions 335*a* covers a part of the upper side of the nozzle hole 610.

Further, as illustrated in FIG. 38C, when the container body 33 further rotates from the posture at 120 degrees to the posture at 150 degrees, the scooping surface 3040E further scoops up toner, and the other one of the shutter side supporting portions 335*a* moves to the upper side of the nozzle hole 610 to prevent toner replenishing.

In this manner, when the container body 33 rotates in the rotation direction A, it is possible to supply the toner T scooped up by the scooping surface 3040E from the upper side of the nozzle hole 610 to the inside of the conveying nozzle 611.

Further, in the fifth embodiment, each of the scooping portions 304E includes the scooping surface 3040E which protrudes from the inner wall surface 33*c* toward the inside of the bottle. The scooping surface 3040E includes the edge (side) 3042E arranged most inner side of the bottle. Each of the scooping portions 304E is shaped so that the scooping surface 3040E and a surface 3043 which is continued from the edge (side) 3042E constitute a triangular protrusion. The edge (side) 3042E is an apex of the mountain shape of the triangular protrusion in the cross-section perpendicular to the rotation axis O in the cross-section perpendicular to the rotation axis O. The triangular protrusion within the powder storage extends along a length of the powder storage. And the angle between the scooping surface 3040E and the surface 3043 is set in θ2. θ2 is an acute angle. Therefore, as illustrated in FIG. 39B, the internal space in the container body 33 can be increased by an area corresponding to a dashed circle in FIG. 39A, so that the space S2 defined with the container shutter 332 can be increased (see FIGS. 36 and 37A to 37C). Consequently, it is possible to increase the space for the toner T to escape at the time of preliminary operation, enabling to easily loosen the toner T.

The configuration of the fifth embodiment as described above may be applied to the scooping portions 304 (304B to 304D) described in the first to the fourth embodiments.

According to the embodiments of the present invention, it is possible to efficiently supply developer that is powder contained in the powder container to a powder receiving hole of a nozzle inserted in the powder container.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

The present invention further includes the following aspects.

Aspect A1

A powder container used in an image forming apparatus, to which the powder container containing powder for image formation is detachably attached, which includes a nozzle with a powder receiving hole that is opened upward and that receives the powder from the powder container, and which rotates the powder container at a rotation frequency in a predetermined range when rotating the attached powder container, the powder container comprising:

a rotatable powder storage that stores therein the powder for image formation;

an opening that is on one end of the powder storage and that allows the nozzle to be inserted in a position being a center of rotation of the power container;

a rotary conveyor that conveys the powder in the powder storage to an opening side; and a scooping portion that scoops up powder on the opening side and supplies the powder to the powder receiving hole along with rotation of the powder storage, wherein the scooping portion includes a scooping surface that extends from an inner wall surface of the powder storage toward a rotation axis side, and an inner end portion of the scooping surface on a rotation axis side extends in a rotation axis direction of the powder storage, an edge of the inner end portion is approximately parallel to the rotation axis, and in a cross-section perpendicular to the rotation axis, the scooping surface is inclined by an inclined angle in a predetermined range toward an upstream side in a rotation direction of the powder storage with respect to a virtual line that passes through the rotation axis and is tangent to the edge of the inner end portion.

Aspect A2

The powder container according to Aspect A1, wherein the inclined angle of the scooping surface is in a range of 25±5 degrees.

Aspect A3

The powder container according to Aspect A1 or A2, wherein the predetermined range of the rotation frequency of the powder container is a range of 110±15 revolution per minute.

Aspect A4

The powder container according to any one of Aspects A1 to A3, wherein the powder is toner with an apparent density of 0.41 to 0.48 g/cm3.

Aspect A5

The powder container according to any one of Aspects A1 to A4, wherein when the powder storage rotates, the edge of the inner end portion of the scooping surface is located in an opening range of the powder receiving hole in a rotation direction, above the powder receiving hole.

Aspect A6

The powder container according to Aspect A5, wherein the edge of the inner end portion overlaps with at least a part of the powder receiving hole in the rotation axis direction, and when the scooping surface faces upward, is located at the same position as or above a virtual line that passes through the rotation axis and extends in a horizontal direction.

Aspect A7

The powder container according to Aspect A5 or A6, further comprising a conveying portion that conveys the powder to the opening side of a space facing the scooping surface.

Aspect A8

The powder container according to Aspect A7, wherein a start position of the conveying portion in front of the scooping surface is in an opening range of the powder receiving hole in an axial direction when the conveying nozzle is inserted in the opening.

Aspect A9

The powder container according to Aspect A7 or A8, wherein a downstream portion of the space in the rotation direction is narrowed toward the opening.

Aspect A10

The powder container according to any one of Aspects A7 to A9, wherein the scooping portion includes a wall connected to the scooping surface and the opening in the downstream portion of the space in the rotation direction, and the wall is located in an opening range of the powder receiving hole in an axial direction when the conveying nozzle is inserted in the opening.

Aspect A11

The powder container according to any one of Aspects A7 to A10, wherein the scooping portion is located on the opening side relative to an end of the conveying portion on a side distant from the opening in the rotation axis direction.

Aspect A12

The powder container according to any one of Aspects A7 to A11, wherein the conveying portion is a spiral protrusion protruding to an inside of the powder storage, and the spiral protrusion extends in the rotation axis direction and a part of the spiral protrusion is located in the space.

Aspect A13

The powder container according to Aspect A12, wherein a height of the protrusion in the powder storage is same as a height of the scooping surface.

Aspect A14

The powder container according to Aspect A12, wherein an angle between the protrusion and the scooping surface is equal to or greater than a repose angle of the powder.

Aspect A15

The powder container according to Aspect A1, wherein an inner wall surface of the powder container constituting the scooping surface has a mountain shape in which the edge of the scooping surface serves as an apex.

Aspect A16

The powder container according to Aspect A15, wherein an angle between two surfaces forming a convex of the mountain shape, in which the end of the scooping surface serves as the apex, is an approximately acute angle.

Aspect A17

An image forming apparatus comprising:

the powder container according to any one of Aspects A1 to A16; and an image forming unit that forms an image on an image bearer by using the powder conveyed from the powder container.

Aspect A18

The image forming apparatus according to Aspect A17, wherein the predetermined range of the rotation frequency of the powder container is a range of 110±15 revolution per minute.

Aspect B1

A powder container used in an image forming apparatus, the powder container comprising:

a rotatable powder storage that stores therein the powder for image formation, the rotatable powder storage to rotate about a rotation axis;

an opening on one end of the powder storage, through which a nozzle of the image forming apparatus is to be inserted; and a scooping portion to scoop up powder on an opening side, and to supply the powder to a powder receiving hole of the nozzle when the powder storage rotates, wherein the scooping portion includes a scooping surface that extends inwardly from an inner wall surface of the powder storage, an inner end portion of the scooping surface extends in a rotation axis direction of the powder storage, an edge of the inner end portion is approximately parallel to the rotation axis, and in a cross-section perpendicular to the rotation axis, the scooping surface is inclined toward an upstream side in a rotation direction of the powder storage with respect to a virtual line that passes through the rotation axis and is tangent to the edge of the inner end portion.

Aspect B2

The powder container according to Aspect B1, wherein the scooping surface is inclined by an inclined angle in a predetermined range, and the inclined angle of the scooping surface is in a range of 25±5 degrees.

Aspect B3

The powder container according to Aspect B1 or B2, wherein the powder container is to be rotated at a rotation frequency in a predetermined range, and the predetermined range of the rotation frequency of the powder container is a range of 110±15 revolution per minute.

Aspect B4

The powder container according to any one of Aspects B1 to B3, wherein the powder is toner with an apparent density of 0.41 to 0.48 g/cm3.

Aspect B5

The powder container according to any one of Aspects B1 to B4, wherein when the powder storage rotates and the scooping surface is located above the powder receiving hole, the edge of the inner end portion of the scooping surface is located in an opening range of the powder receiving hole in a rotation direction.

Aspect B6

The powder container according to Aspect B5, wherein when the powder storage rotates and the scooping surface is located above the powder receiving hole, the edge of the inner end portion overlaps with at least a part of the powder receiving hole in the rotation axis direction.

Aspect B7

The powder container according to Aspect B5 or B6, wherein when the scooping surface faces upward, the scooping surface is located above a virtual line that passes through the rotation axis and extends in a horizontal direction.

Aspect B8

The powder container according to any one of Aspects B1 to B7, further comprising a rotary conveyor that conveys the powder in the powder storage to the opening side.

Aspect B9

The powder container according to any one of Aspects B1 to B8, further comprising a conveying portion that conveys the powder toward the opening side in the scooping portion.

Aspect B10

The powder container according to Aspect B9, wherein the conveying portion is connected to the scooping surface at a start position, and the start position of the conveying portion is in an opening range of the powder receiving hole in an axial direction.

Aspect B11

The powder container according to any one of Aspects B1 to B10, wherein the scooping portion includes a wall to be connected to the opening side of the scooping surface and to extend along the rotation direction, the wall defines a holding space of the powder in the rotation axis direction, the scooping surface defines upstream side of the holding space in the rotation direction, and the wall is located in an opening range of the powder receiving hole in an axial direction.

Aspect B12

The powder container according to Aspect B11, wherein the holding space is narrowed toward the opening in the rotation axis direction.

Aspect B13

The powder container according to any one of Aspects B9 to B12, wherein the scooping portion is located on the opening side relative to an end of the conveying portion on a side distant from the opening in the rotation axis direction.

Aspect B14

The powder container according to any one of Aspects B9 to B13, wherein the conveying portion is a spiral rib protruding to an inside of the powder storage, and the spiral rib extends in the rotation axis direction and a part of the spiral rib is located in the scooping portion.

Aspect B15

The powder container according to Aspect B14, wherein a length of the spiral rib from an inner surface of the powder storage is same as a length of the scooping surface in the direction perpendicular to the rotation axis.

Aspect B16

The powder container according to Aspect B14, wherein an angle between the spiral rib and the scooping surface is equal to or greater than a repose angle of the powder.

Aspect, B17

The powder container according to any one of Aspects B1 to B11, wherein the scooping portion includes a triangular protrusion extending along an rotation axis direction.

Aspect B18

The powder container according to Aspect B17, wherein the edge of the scooping surface serves as an apex of the triangular protrusion.

Aspect B19

The powder container according to Aspect B17 or B18, wherein an angle between two surfaces of the triangular protrusion is an acute angle.

Aspect B20

The powder container according to any one of Aspects B1 to B19, wherein the powder stored inside of the powder storage includes toner.

Aspect B21

The powder container according to Aspect B20, wherein the powder further includes carrier particle.

Aspect B22

An image forming apparatus comprising the powder container according to any one of Aspects B1 to B21.

REFERENCE SIGNS LIST

32Y, 32M, 32C, 32K TONER CONTAINER (POWDER CONTAINER)
33 CONTAINER BODY (POWDER STORAGE)
33*a* OPENING (CONTAINER OPENING)
33*c* INNER WALL SURFACE OF CONTAINER BODY
34 CONTAINER FRONT END COVER (CONTAINER COVER)
41 PHOTOCONDUCTOR (IMAGE BEARER)
46Y, 46M, 46C, 46K IMAGE FORMING SECTION
50 DEVELOPING DEVICE
60 TONER REPLENISHING DEVICE (POWDER REPLENISHING (SUPPLY) DEVICE)
100 PRINTER (COPIER MAIN BODY)
200 SHEET FEED TABLE (SHEET FEEDER)
301 CONTAINER GEAR
302 SPIRAL RIB (ROTARY CONVEYOR)
304, 304B to 304E SCOOPING PORTION (POWDER SCOOPING PORTION)
304*a* SPIRAL RIB AT SCOOPING PORTION (CONVEYING PORTION)
304*a*1 FIRST END OF SPIRAL RIB AT SCOOPING PORTION (TERMINATED PORTION AT SCOOPING PORTION)
304*a*2 SECOND END OF SPIRAL RIB AT SCOOPING PORTION ON SIDE DISTANT FROM OPENING
3040, 3040B to 3040E SCOOPING SURFACE
3040*a*, 3040Ba to 3040Ea INNER END PORTION OF SCOOPING SURFACE
3041 WALL (CONTAINER FRONT WALL)
3042, 3042B to 3042E EDGE (SIDE)
3043 SURFACE
330 NOZZLE RECEIVER (NOZZLE INSERTION MEMBER)
331 RECEIVING OPENING (NOZZLE INSERTION OPENING)

332 CONTAINER SHUTTER (OPENING/CLOSING MEMBER)
335 SHUTTER REAR END SUPPORTING PORTION (SHUTTER REAR PORTION)
335*a* SHUTTER SIDE SUPPORTING PORTION (SIDE PORTION)
335*b* OPENING OF SHUTTER SUPPORTING PORTION (SHUTTER SIDE OPENING)
340 CONTAINER SHUTTER SUPPORTER (SUPPORTER)
500 COPIER (IMAGE FORMING APPARATUS)
608 SETTING COVER
610 NOZZLE HOLE (POWDER RECEIVING HOLE)
611 CONVEYING NOZZLE
615 CONTAINER SETTING SECTION (CONTAINER RECEIVING SECTION)
θ INCLINED ANGLE OF SCOOPING SURFACE
θ1 ANGLE BETWEEN PROTRUSION AND SCOOPING SURFACE
θ2 ANGLE BETWEEN TWO SURFACES FORMING EDGE OF SCOOPING SURFACE
O ROTATION AXIS
h1 HEIGHT OF SCOOPING SURFACE
h2 HEIGHT OF PROTRUSION
S SPACE (TONER HOLDING SPACE)
S7 START POSITION OF TONER CONVEYING (STARTING POINT, CONNECTION PORTION)
T TONER (POWDER FOR IMAGE FORMATION)
W OPENING RANGE OF POWDER RECEIVING HOLE IN ROTATION DIRECTION
W1 OPENING RANGE OF POWDER RECEIVING HOLE IN AXIAL DIRECTION
X, X1 VIRTUAL LINE
P RECORDING MEDIUM
G DEVELOPER
Q ATTACHMENT DIRECTION
Q1 DETACHMENT DIRECTION

The invention claimed is:

1. A powder container used in an image forming apparatus, the powder container comprising:

a rotatable powder storage that stores therein a powder for image formation, the rotatable powder storage to rotate about a rotation axis;

an opening on one end of the powder storage, through which a nozzle of the image forming apparatus is to be inserted;

a scooping portion to scoop up powder on an opening side, and to supply the powder to a powder receiving hole of the nozzle when the powder storage rotates; and a conveying portion that conveys the powder toward the opening side, wherein:

the scooping portion includes a scooping surface that extends inwardly from an inner wall surface of the powder storage, an inner end portion of the scooping surface extends in a rotation axis direction of the powder storage, an edge of the inner end portion is approximately parallel to the rotation axis, in a cross-section perpendicular to the rotation axis, the scooping surface is inclined toward an upstream side in a rotation direction of the powder storage with respect to a virtual line that passes through the rotation axis and is tangent to the edge of the inner end portion, the conveying portion is directly connected to the scooping surface at a position corresponding to the powder receiving hole in the rotation axis direction.

2. The powder container according to claim 1, wherein:

the scooping surface is inclined toward the upstream side in the rotation direction of the powder storage with respect to the virtual line that passes through the rotation axis and is tangent to the edge of the inner end portion by an inclined angle in a predetermined range, and the inclined angle of the scooping surface is in a range of 25±5 degrees.

3. The powder container according to claim 1, wherein:

the powder container is to be rotated at a rotation frequency in a predetermined range, and the predetermined range of the rotation frequency of the powder container is a range of 110±15 revolutions per minute.

4. The powder container according to claim 1, wherein the powder is toner with an apparent density of 0.41 to 0.48 g/cm$^3$.

5. The powder container according to claim 1, wherein when the powder storage rotates and the scooping surface is located above the powder receiving hole, the edge of the inner end portion of the scooping surface is located in an opening range of the powder receiving hole in a rotation direction.

6. The powder container according to claim 5, wherein when the powder storage rotates and the scooping surface is located above the powder receiving hole, the edge of the inner end portion overlaps with at least a part of the powder receiving hole in the rotation axis direction.

7. The powder container according to claim 5, wherein when the scooping surface faces upward, the scooping surface is located above a virtual line that passes through the rotation axis and extends in a horizontal direction.

8. The powder container according to claim 1, further comprising a rotary conveyor that conveys the powder in the powder storage to the opening side.

9. The powder container according to claim 1, wherein the scooping portion includes a wall connected to the scooping surface at an opening side of the scooping surface, and that extends along the rotation direction, the wall defines a holding space of the powder in the rotation axis direction, the scooping surface defines an upstream side of the holding space in the rotation direction, and the wall is located in an opening range of the powder receiving hole in the rotation axis direction.

10. The powder container according to claim 9, wherein the holding space is narrowed toward the opening in the rotation axis direction.

11. The powder container according to claim 9, wherein the scooping portion is located on the opening side relative to an end of the conveying portion furthest from the opening in the rotation axis direction.

12. The powder container according to claim 9, wherein:

the conveying portion is a spiral rib protruding to an inside of the powder storage, and the spiral rib extends in the rotation axis direction and a part of the spiral rib is located in the scooping portion.

13. The powder container according to claim 12, wherein a length of the spiral rib from the inner wall surface of the powder storage is the same as a length of the scooping surface from the inner wall surface of the powder storage.

14. The powder container according to claim 12, wherein an angle between the spiral rib and the scooping surface is equal to or greater than a repose angle of the powder.

15. The powder container according to claim 1, wherein the scooping portion is located on the opening side relative to an end of the conveying portion furthest from the opening in the rotation axis direction.

16. The powder container according to claim 1, wherein:

the conveying portion is a spiral rib protruding to an inside of the powder storage, and the spiral rib extends in the rotation axis direction and a part of the spiral rib is located in the scooping portion.

17. The powder container according to claim 16, wherein a length of the spiral rib from the inner wall surface of the powder storage is the same as a length of the scooping surface from the inner wall surface of the powder storage.

18. The powder container according to claim 16, wherein an angle between the spiral rib and the scooping surface is equal to or greater than a repose angle of the powder.

19. The powder container according to claim 1, wherein the scooping portion includes a triangular protrusion extending along the rotation axis direction.

20. The powder container according to claim 19, wherein the edge of the scooping surface serves as an apex of the triangular protrusion.

21. The powder container according to claim 19, wherein an angle between two surfaces of the triangular protrusion is an acute angle.

22. The powder container according to claim 1, wherein the powder stored inside of the powder storage includes toner.

23. The powder container according to claim 22, wherein the powder further includes carrier particles.

24. An image forming apparatus comprising the powder container according to claim 1.

* * * * *